US009613568B2

(12) United States Patent
Umezaki

(10) Patent No.: US 9,613,568 B2
(45) Date of Patent: Apr. 4, 2017

(54) SEMICONDUCTOR DEVICE AND DRIVING METHOD THEREOF

(71) Applicant: Semiconductor Energy Laboratory Co., Ltd., Atsugi-shi, Kanagawa-ken (JP)

(72) Inventor: Atsushi Umezaki, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 61 days.

(21) Appl. No.: 14/147,698

(22) Filed: Jan. 6, 2014

(65) Prior Publication Data

US 2014/0118653 A1 May 1, 2014

Related U.S. Application Data

(63) Continuation of application No. 11/456,296, filed on Jul. 10, 2006, now Pat. No. 8,629,819.

(30) Foreign Application Priority Data

Jul. 14, 2005 (JP) ..... 2005-205147

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/20* (2013.01); *G09G 3/3225* (2013.01);
(Continued)

(58) Field of Classification Search
CPC ..... G09G 3/32–3/3258; G09G 3/3659; G09G 2300/0852; G09G 2300/0861;
(Continued)

(56) References Cited

U.S. PATENT DOCUMENTS 4,429,305 A 1/1984 Hosokawa
4,890,097 A 12/1989 Yamashita
(Continued)

FOREIGN PATENT DOCUMENTS

CN 1437178 A 8/2003
CN 1510652 A 7/2004
(Continued)

OTHER PUBLICATIONS

Tomoyuki Shirasaki et al.; "57.4L: Late-News Paper: Full-color Polymer AM-OLED using Ink-jet and a Si TFT Technologies"; SID 04 Digest; pp. 1516-1519 (2004).
(Continued)

*Primary Examiner* — Patrick F Marinelli
(74) *Attorney, Agent, or Firm* — Fish & Richardson P.C.

(57) ABSTRACT

There has been a problem that power consumption is increased if a potential of a signal line changes every time a video signal is applied to a driving transistor from the signal line, since the parasitic capacitance of the signal line stores and releases electric charges. In a configuration of a display portion provided with a gate signal line for selecting an input of a video signal to a pixel and a source signal line for inputting a video signal to the pixel, a switch is connected in series with the source signal line, the switch being controlled to be in on state when the pixel is not selected by the gate signal line, and in off state when the pixel is selected by the gate signal line. Accordingly, the parasitic capacitance of the source signal line which stores and releases electric charges affects only pixels between an output side of a source driver up to and including the pixel selected to be written with a video signal. Consequently, power consumed by the charging and discharging of the source signal line can be reduced, and thus low power consumption can be achieved.

24 Claims, 28 Drawing Sheets

(51) Int. Cl.
*G09G 3/3225* (2016.01)
*G09G 3/36* (2006.01)

(52) U.S. Cl.
CPC ... *G09G 3/3659* (2013.01); *G09G 2300/0819* (2013.01); *G09G 2300/0852* (2013.01); *G09G 2300/0861* (2013.01); *G09G 2310/0251* (2013.01); *G09G 2320/0223* (2013.01); *G09G 2320/043* (2013.01); *G09G 2330/021* (2013.01)

(58) Field of Classification Search
CPC ..... H01L 27/1214–27/1255; G02F 1/1362; G02F 1/136213; G02F 1/134336; G02F 1/34363
See application file for complete search history.

(56) References Cited

U.S. PATENT DOCUMENTS 5,303,072 A 4/1994 Takeda
5,485,019 A * 1/1996 Yamazaki et al. ..... 257/57
5,731,856 A 3/1998 Kim et al.
5,744,864 A 4/1998 Cillessen et al.
6,028,333 A 2/2000 Yamazaki
6,229,506 B1 5/2001 Dawson
6,294,274 B1 9/2001 Kawazoe et al.
6,563,174 B2 5/2003 Kawasaki et al.
6,727,522 B1 4/2004 Kawasaki et al.
6,737,813 B2 * 5/2004 Kawasaki et al. ..... 315/169.3
6,828,950 B2 12/2004 Koyama
6,838,836 B2 * 1/2005 Seo et al. ..... 315/169.3
7,049,190 B2 5/2006 Takeda et al.
7,061,014 B2 6/2006 Hosono et al.
7,064,346 B2 6/2006 Kawasaki et al.
7,105,868 B2 9/2006 Nause et al.
7,199,768 B2 4/2007 Ono
7,211,825 B2 5/2007 Shih et al
7,221,342 B2 * 5/2007 Fish ..... G09G 3/325 345/205
7,221,352 B2 5/2007 Kodate
7,224,334 B2 5/2007 Choi
7,282,782 B2 10/2007 Hoffman et al.
7,297,977 B2 11/2007 Hoffman et al.
7,319,443 B2 * 1/2008 Kimura et al. ..... 345/76
7,323,356 B2 1/2008 Hosono et al.
7,362,289 B2 * 4/2008 Yamazaki et al. ..... 345/76
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,674,650 B2 3/2010 Akimoto et al.
7,732,819 B2 6/2010 Akimoto et al.
7,864,139 B2 * 1/2011 Hara ..... 345/76
7,864,141 B2 * 1/2011 Goh ..... 345/82
7,924,244 B2 4/2011 Kimura
7,928,937 B2 * 4/2011 Ozaki ..... 345/82
7,940,233 B2 * 5/2011 Kim et al. ..... 345/76
8,044,895 B2 * 10/2011 Miyake ..... G09G 3/3233 315/169.3
8,355,015 B2 * 1/2013 Kimura et al. ..... 345/212
8,497,823 B2 7/2013 Kimura
8,629,819 B2 * 1/2014 Umezaki ..... 345/84
2001/0028226 A1 * 10/2001 Malaviya et al. ..... 315/169.3
2001/0030633 A1 10/2001 Van Velzen
2001/0046027 A1 11/2001 Tai et al.
2002/0021293 A1 2/2002 Tam
2002/0056838 A1 5/2002 Ogawa
2002/0132454 A1 9/2002 Ohtsu et al.
2003/0011584 A1 * 1/2003 Azami ..... G09G 3/3258 345/204
2003/0030602 A1 2/2003 Kasai
2003/0090481 A1 5/2003 Kimura
2003/0117352 A1 * 6/2003 Kimura ..... 345/87
2003/0137503 A1 * 7/2003 Kimura et al. ..... 345/212
2003/0179166 A1 9/2003 Li
2003/0189401 A1 10/2003 Kido et al.
2003/0214245 A1 * 11/2003 Yamazaki et al. ..... 315/169.3
2003/0218222 A1 11/2003 Wager, III et al.
2004/0017161 A1 * 1/2004 Choi ..... 315/169.3
2004/0026723 A1 * 2/2004 Miyazawa ..... 257/277
2004/0038446 A1 2/2004 Takeda et al.
2004/0070557 A1 * 4/2004 Asano et al. ..... 345/76
2004/0100427 A1 * 5/2004 Miyazawa ..... 345/76
2004/0127038 A1 7/2004 Carcia et al.
2004/0145547 A1 * 7/2004 Oh ..... 345/76
2004/0174354 A1 9/2004 Ono
2004/0196224 A1 * 10/2004 Kwon ..... 345/82
2004/0196239 A1 * 10/2004 Kwon ..... 345/92
2004/0239600 A1 12/2004 Lin
2004/0246241 A1 12/2004 Sato
2004/0256617 A1 12/2004 Yamada
2004/0263440 A1 * 12/2004 Kimura ..... G09G 3/2011 345/76
2005/0017302 A1 1/2005 Hoffman
2005/0052366 A1 * 3/2005 Kim ..... 345/76
2005/0057459 A1 * 3/2005 Miyazawa ..... 345/76
2005/0083270 A1 * 4/2005 Miyazawa ..... 345/76
2005/0099412 A1 5/2005 Kasai
2005/0140600 A1 * 6/2005 Kim et al. ..... 345/76
2005/0140605 A1 * 6/2005 Jung ..... 345/76
2005/0151705 A1 * 7/2005 Fish ..... G09G 3/325 345/76
2005/0190126 A1 * 9/2005 Kimura et al. ..... 345/76
2005/0199959 A1 9/2005 Chiang et al.
2005/0200575 A1 * 9/2005 Kim et al. ..... 345/76
2005/0200618 A1 * 9/2005 Kim et al. ..... 345/204
2005/0206590 A1 * 9/2005 Sasaki et al. ..... 345/76
2005/0206593 A1 * 9/2005 Kwon ..... 345/76
2005/0243036 A1 * 11/2005 Ikeda ..... G09G 3/3233 345/76
2005/0259494 A1 * 11/2005 Kimura et al. ..... 365/222
2005/0275038 A1 * 12/2005 Shih et al. ..... 257/382
2006/0022605 A1 * 2/2006 Ha et al. ..... 315/169.3
2006/0035452 A1 2/2006 Carcia et al.
2006/0043377 A1 3/2006 Hoffman et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0139259 A1 * 6/2006 Choi ..... G09G 3/3241 345/76
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0292777 A1 12/2006 Dunbar
2007/0001205 A1 1/2007 Kimura
2007/0013613 A1 * 1/2007 Umezaki ..... 345/55
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.

(56) References Cited

U.S. PATENT DOCUMENTS

| | | | |
|---|---|---|---|
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0106208 | A1 | 5/2008 | Choi |
| 2008/0128689 | A1 | 6/2008 | Lee et al. |
| 2008/0129195 | A1 | 6/2008 | Ishizaki et al. |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0278122 | A1 | 11/2009 | Hosono et al. |
| 2009/0280600 | A1 | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |
| 2014/0118653 | A1* | 5/2014 | Umezaki ..... 349/43 |

FOREIGN PATENT DOCUMENTS

| | | | |
|---|---|---|---|
| CN | 1558390 | A | 12/2004 |
| EP | 1 331 627 | A2 | 7/2003 |
| EP | 1737044 | A | 12/2006 |
| EP | 2226847 | A | 9/2010 |
| EP | 2 348 502 | A2 | 7/2011 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 06-324642 | A | 11/1994 |
| JP | 08-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-514320 | T | 5/2002 |
| JP | 2002-289859 | A | 10/2002 |
| JP | 2003-086000 | A | 3/2003 |
| JP | 2003-086808 | A | 3/2003 |
| JP | 2003-271095 | A | 9/2003 |
| JP | 2003-344823 | A | 12/2003 |
| JP | 2004-103957 | A | 4/2004 |
| JP | 2004-273614 | A | 9/2004 |
| JP | 2004-273732 | A | 9/2004 |
| JP | 5132097 | A | 1/2013 |
| WO | WO 98/48403 | A1 | 10/1998 |
| WO | WO-2004/114391 | | 12/2004 |

OTHER PUBLICATIONS

Office Action (Application No. 200610106350.1) dated Oct. 23, 2009 with English Translation. 20 pages.

Chinese Office Action (CN Application No. 201110330222.6) dated Aug. 1, 2013, 6 pages.

Office Action, Chinese Patent Application No. 201110330222.6, dated Aug. 1, 2013, 7 pages with full English translation.

Asakuma.N et al., "Crystallization and Reduction of Sol-Gel-Derived Zinc Oxide Films by Irradation with Ultraviolet Lamp", Journal of Sol-Gel Science and Technology, 2003, vol. 26, pp. 181-184.

Asaoka.Y et al., "29.1:Polarizer-Free Reflective LCD Combined With Ultra Low-Power Driving Technology", SID Digest '09 : SID International Symposium Digest of Technical Papers, May 31, 2009, pp. 395-398.

Chern.H et al., "An Analytical Model for the Above-Threshold Characteristics of Polysilicon Thin-Film Transistors", IEEE Transactions on Electron Devices, Jul. 1, 1995, vol. 42, No. 7, pp. 1240-1246.

Cho.D et al., "21.2:Al and Sn-Doped Zinc Indium Oxide Thin Film Transistors for AMOLED Back Plane", SID Digest '09 : SID International Symposium Digest of Technical Papers, May 31, 2009, pp. 280-283.

Clark.S et al., "First Principles Methods Using CASTEP", Zeitschrift fur Kristallographie, 2005, vol. 220, pp. 567-570.

Coates.D et al., "Optical Studies of the Amorphous Liquid-Cholesteric Liquid Crystal Transition:The "Blue Phase"", Physics Letters, Sep. 10, 1973, vol. 45A, No. 2, pp. 115-116.

Costello.M et al., "Electron Microscopy of a Cholesteric Liquid Crystal and Its Blue Phase", Phys. Rev. A (Physical Review. A), May 1, 1984, vol. 29, No. 5, pp. 2957-2959.

Dembo.H et al., "RFCPUS on Glass and Plastic Substrates Fabricated by TFT Transfer Technology", IEDM 05: Technical Digest of International Electron Devices Meeting, Dec. 5, 2005, pp. 1067-1069.

Fortunato.E et al., "Wide-Bandgap High-Mobility ZnO Thin-Film Transistors Produced at Room Temperature", Appl. Phys. Lett. (Applied Physics Letters) , Sep. 27, 2004, vol. 85, No. 13, pp. 2541-2543.

Fung.T et al., "2-D Numerical Simulation of High Performance Amorphous In—Ga—Zn—O TFTs for Flat Panel Displays", AM-FPD '08 Digest of Technical Papers, Jul. 2, 2008, pp. 251-252, The Japan Society of Applied Physics.

Godo.H et al., "P-9:Numerical Analysis on Temperature Dependence of Characteristics of Amorphous In—Ga—Zn-Oxide TFT", SID Digest '09 : SID International Symposium Digest of Technical Papers, May 31, 2009, pp. 1110-1112.

Godo.H et al., "Temperature Dependence of Characteristics and Electronic Structure for Amorphous In—Ga—Zn-Oxide TFT", AM-FPD '09 Digest of Technical Papers, Jul. 1, 2009, pp. 41-44.

Hayashi.R et al., "42.1: Invited Paper: Improved Amorphous In—Ga—Zn—O TFTs", SID Digest '08 : SID International Symposium Digest of Technical Papers, May 20, 2008, vol. 39, pp. 621-624.

Hirao.T et al., "Novel Top-Gate Zinc Oxide Thin-Film Transistors (ZnO TFTs) for AMLCDs", J. Soc. Inf. Display (Journal of the Society for Information Display), 2007, vol. 15, No. 1, pp. 17-22.

Hosono.H et al., "Working hypothesis to explore novel wide band gap electrically conducting amorphous oxides and examples", J. Non-Cryst. Solids (Journal of Non-Crystalline Solids), 1996, vol. 198-200, pp. 165-169.

Hosono.H, "68.3:Invited Paper:Transparent Amorphous Oxide Semiconductors for High Performance TFT", SID Digest '07 : SID International Symposium Digest of Technical Papers, 2007, vol. 38, pp. 1830-1833.

Hsieh.H et al., "P-29:Modeling of Amorphous Oxide Semiconductor Thin Film Transistors and Subgap Density of States", SID Digest '08 : SID International Symposium Digest of Technical Papers, May 20, 2008, vol. 39, pp. 1277-1280.

Ikeda.T et al., "Full-Functional System Liquid Crystal Display Using Cg-Silicon Technology", SID Digest '04 : SID International Symposium Digest of Technical Papers, 2004, vol. 35, pp. 860-863.

Janotti.A et al., "Native Point Defects in ZnO", Phys. Rev. B (Physical Review. B), Oct. 4, 2007, vol. 76, No. 16, pp. 165202-1-165202-22.

Janotti.A et al., "Oxygen Vacancies in ZnO", Appl. Phys. Lett. (Applied Physics Letters) , 2005, vol. 87, pp. 122102-1-122102-3.

(56) References Cited

OTHER PUBLICATIONS

Jeong.J et al., "3.1: Distinguished Paper: 12.1-Inch WXGA AMOLED Display Driven by Indium-Gallium-Zinc Oxide TFTs Array", SID Digest '08 : SID International Symposium Digest of Technical Papers, May 20, 2008, vol. 39, No. 1, pp. 1-4.
Jin.D et al., "65.2:Distinguished Paper:World-Largest (6.5") Flexible Full Color Top Emission AMOLED Display on Plastic Film and Its Bending Properties", SID Digest '09 : SID International Symposium Digest of Technical Papers, May 31, 2009, pp. 983-985.
Kanno.H et al., "White Stacked Electrophosphorecent Organic Light-Emitting Devices Employing MOO3 as a Charge-Generation Layer", Adv. Mater. (Advanced Materials), 2006, vol. 18, No. 3, pp. 339-342.
Kikuchi.H et al., "39.1:Invited Paper:Optically Isotropic Nano-Structured Liquid Crystal Composites for Display Applications", SID Digest '09 : SID International Symposium Digest of Technical Papers, May 31, 2009, pp. 578-581.
Kikuchi.H et al., "62.2:Invited Paper:Fast Electro-Optical Switching in Polymer-Stabilized Liquid Crystalline Blue Phases for Display Application", SID Digest '07 : SID International Symposium Digest of Technical Papers, 2007, vol. 38, pp. 1737-1740.
Kikuchi.H et al., "Polymer-Stabilized Liquid Crystal Blue Phases", Nature Materials, Sep. 2, 2002, vol. 1, pp. 64-68.
Kim.S et al., "High-Performance oxide thin film transistors passivated by various gas plasmas", 214th ECS Meeting, 2008, No. 2317, ECS.
Kimizuka.N et al., "Spinel,YbFe2O4, and Yb2Fe3O7 Types of Structures for Compounds in the In2O3 and Sc2O3—A2O3—BO Systems [A; Fe, Ga, or Al; B: Mg, Mn, Fe, Ni, Cu,or Zn] at Temperatures Over 1000° C", Journal of Solid State Chemistry, 1985, vol. 60, pp. 382-384.
Kimizuka.N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3-ZnGa2O4-ZnO System", Journal of Solid State Chemistry, Apr. 1, 1995, vol. 116, No. 1, pp. 170-178.
Kitzerow.H et al., "Observation of Blue Phases in Chiral Networks", Liquid Crystals, 1993, vol. 14, No. 3, pp. 911-916.
Kurokawa.Y et al., "UHF RFCPUS on Flexible and Glass Substrates for Secure RFID Systems", Journal of Solid-State Circuits , 2008, vol. 43, No. 1, pp. 292-299.
Lany.S et al., "Dopability, Intrinsic Conductivity, and Nonstoichiometry of Transparent Conducting Oxides", Phys. Rev. Lett. (Physical Review Letters), Jan. 26, 2007, vol. 98, pp. 045501-1-045501-4.
Lee.H et al., "Current Status of, Challenges to, and Perspective View of AM-OLED", IDW '06 : Proceedings of the 13th International Display Workshops, Dec. 7, 2006, pp. 663-666.
Lee.J et al., "World's Largest (15-Inch) XGA AMLCD Panel Using IGZO Oxide TFT", SID Digest '08 : SID International Symposium Digest of Technical Papers, May 20, 2008, vol. 39, pp. 625-628.
Lee.M et al., "15.4:Excellent Performance of Indium-Oxide-Based Thin-Film Transistors by DC Sputtering", SID Digest '09 : SID International Symposium Digets of Technical Papers, May 31, 2009, pp. 191-193.
Li.C et al., "Modulated Structures of Homologous Compounds InMO3(ZnO)m (M=In,Ga; m=Integer) Described by Four-Dimensional Superspace Group", Journal of Solid State Chemistry, 1998, vol. 139, pp. 347-355.
Masuda.S et al., "Transparent thin film transistors using ZnO as an active channel layer and their electrical properties", J. Appl. Phys. (Journal of Applied Physics) , Feb. 1, 2003, vol. 93, No. 3, pp. 1624-1630.
Meiboom.S et al., "Theory of the Blue Phase of Cholesteric Liquid Crystals", Phys. Rev. Lett. (Physical Review Letters), May 4, 1981, vol. 46, No. 18, pp. 1216-1219.
Miyasaka.M, "SUFTLA Flexible Microelectronics on Their Way to Business", SID Digest '07 : SID International Symposium Digest of Technical Papers, 2007, vol. 38, pp. 1673-1676.
Mo.Y et al., "Amorphous Oxide TFT Backplanes for Large Size AMOLED Displays", IDW '08 : Proceedings of the 6th International Display Workshops, Dec. 3, 2008, pp. 581-584.
Nakamura.M et al., "The phase relations in the In2O3—Ga2ZnO4—ZnO system at 1350° C", Journal of Solid State Chemistry, Aug. 1, 1991, vol. 93, No. 2, pp. 298-315.
Nakamura.M, "Synthesis of Homologous Compound with New Long-Period Structure", Nirim Newsletter, Mar. 1, 1995, vol. 150, pp. 1-4.
Nomura.K et al., "Amorphous Oxide Semiconductors for High-Performance Flexible Thin- Film Transistors", Jpn. J. Appl. Phys. (Japanese Journal of Applied Physics) , 2006, vol. 45, No. 5B, pp. 4303-4308.
Nomura.K et al., "Carrier transport in transparent oxide semiconductor with intrinsic structural randomness probed using single-crystalline InGaO3(ZnO)5 films", Appl. Phys. Lett. (Applied Physics Letters) , Sep. 13, 2004, vol. 85, No. 11, pp. 1993-1995.
Nomura.K et al., "Room-Temperature Fabrication of Transparent Flexible Thin-Film Transistors Using Amorphous Oxide Semiconductors", Nature, Nov. 25, 2004, vol. 432, pp. 488-492.
Nomura.K et al., "Thin-Film Transistor Fabricated in Single-Crystalline Transparent Oxide Semiconductor", Science, May 23, 2003, vol. 300, No. 5623, pp. 1269-1272.
Nowatari.H et al., "60.2: Intermediate Connector With Suppressed Voltage Loss for White Tandem OLEDs", SID Digest '09 : SID International Symposium Digest of Technical Papers, May 31, 2009, vol. 40, pp. 899-902.
Oba.F et al., "Defect energetics in ZnO: A hybrid Hartree-Fock density functional study", Phys. Rev. B (Physical Review. B), 2008, vol. 77, pp. 245202-1-245202-6.
Oh.M et al., "Improving the Gate Stability of ZnO Thin-Film Transistors With Aluminum Oxide Dielectric Layers", J. Electrochem. Soc. (Journal of the Electrochemical Society), 2008, vol. 155, No. 12, pp. H1009-H1014.
Ohara.H et al., "21.3:4.0 In. QVGA AMOLED Display Using In—Ga—Zn-Oxide TFTs With a Novel Passivation Layer", SID Digest '09 : SID International Symposium Digest of Technical Papers, May 31, 2009, pp. 284-287.
Ohara.H et al., "Amorphous In—Ga—Zn-Oxide TFTs with Suppressed Variation for 4.0 inch QVGA AMOLED Display", AM-FPD '09 Digest of Technical Papers, Jul. 1, 2009, pp. 227-230, The Japan Society of Applied Physics.
Orita.M et al., "Amorphous transparent conductive oxide InGaO3(ZnO)m (m<4):a Zn4s conductor", Philosophical Magazine, 2001, vol. 81, No. 5, pp. 501-515.
Orita.M et al., "Mechanism of Electrical Conductivity of Transparent InGaZnO4", Phys. Rev. B (Physical Review. B), Jan. 15, 2000, vol. 61, No. 3, pp. 1811-1816.
Osada.T et al., "15.2: Development of Driver-Integrated Panel using Amorphous In—Ga—Zn-Oxide TFT", SID International Symposium Digest of Technical Papers, May 31, 2009, vol. 40, pp. 184-187.
Osada.T et al., "Development of Driver-Integrated Panel Using Amorphous In—Ga—Zn—Oxide TFT", AM-FPD '09 Digest of Technical Papers, Jul. 1, 2009, pp. 33-36.
Park.J et al., "Amorphous Indium-Gallium-Zinc Oxide TFTs and Their Application for Large Size AMOLED", AM-FPD '08 Digest of Technical Papers, Jul. 2, 2008, pp. 275-278.
Park.J et al., "Dry etching of ZnO films and plasma-induced damage to optical properties", J. Vac. Sci. Technol. B (Journal of Vacuum Science & Technology B), Mar. 1, 2003, vol. 21, No. 2, pp. 800-803.
Park.J et al., "Electronic Transport Properties of Amorphous Indium-Gallium-Zinc Oxide Semiconductor Upon Exposure to Water", Appl. Phys. Lett. (Applied Physics Letters) , 2008, vol. 92, pp. 072104-1-072104-3.
Park.J et al., "High performance amorphous oxide thin film transistors with self-aligned top-gate structure", IEDM 09: Technical Digest of International Electron Devices Meeting, Dec. 7, 2009, pp. 191-194.
Park.J et al., "Improvements in the Device Characteristics of Amorphous Indium Gallium Zinc Oxide Thin-Film Transistors by Ar Plasma Treatment", Appl. Phys. Lett. (Applied Physics Letters) , Jun. 26, 2007, vol. 90, No. 26, pp. 262106-1-262106-3.

(56) References Cited

OTHER PUBLICATIONS

Park.S et al., "Challenge to Future Displays: Transparent AM-OLED Driven by PEALD Grown ZnO TFT", IMID '07 Digest, 2007, pp. 1249-1252.

Park.Sang-Hee et al., "42.3: Transparent ZnO Thin Film Transistor for the Application of High Aperture Ratio Bottom Emission AM-OLED Display", SID Digest '08 : SID International Symposium Digest of Technical Papers, May 20, 2008, vol. 39, pp. 629-632.

Prins.M et al., "A Ferroelectric Transparent Thin-Film Transistor", Appl. Phys. Lett. (Applied Physics Letters) , Jun. 17, 1996, vol. 68, No. 25, pp. 3650-3652.

Sakata.J et al., "Development of 4.0-In. AMOLED Display With Driver Circuit Using Amorphous In—Ga—Zn-Oxide TFTs", IDW '09 : Proceedings of the 16th International Display Workshops, 2009, pp. 689-692.

Son.K et al., "42.4L: Late-News Paper: 4 Inch QVGA AMOLED Driven by the Threshold Voltage Controlled Amorphous GIZO (Ga2O3—In2O3—ZnO) TFT", SID Digest '08 : SID International Symposium Digest of Technical Papers, May 20, 2008, vol. 39, pp. 633-636.

Takahashi.M et al., "Theoretical Analysis of IGZO Transparent Amorphous Oxide Semiconductor", IDW '08 : Proceedings of the 15th International Display Workshops, Dec. 3, 2008, pp. 1637-1640.

Tsuda.K et al., "Ultra Low Power Consumption Technologies for Mobile TFT-LCDs", IDW '02 : Proceedings of the 9th International Display Workshops, Dec. 4, 2002, pp. 295-298.

Ueno.K et al., "Field-Effect Transistor on SrTiO3 With Sputtered Al2O3 Gate Insulator", Appl. Phys. Lett. (Applied Physics Letters) , Sep. 1, 2003, vol. 83, No. 9, pp. 1755-1757.

Van de Walle.C, "Hydrogen as a Cause of Doping in Zinc Oxide", Phys. Rev. Lett. (Physical Review Letters), Jul. 31, 2000, vol. 85, No. 5, pp. 1012-1015.

* cited by examiner

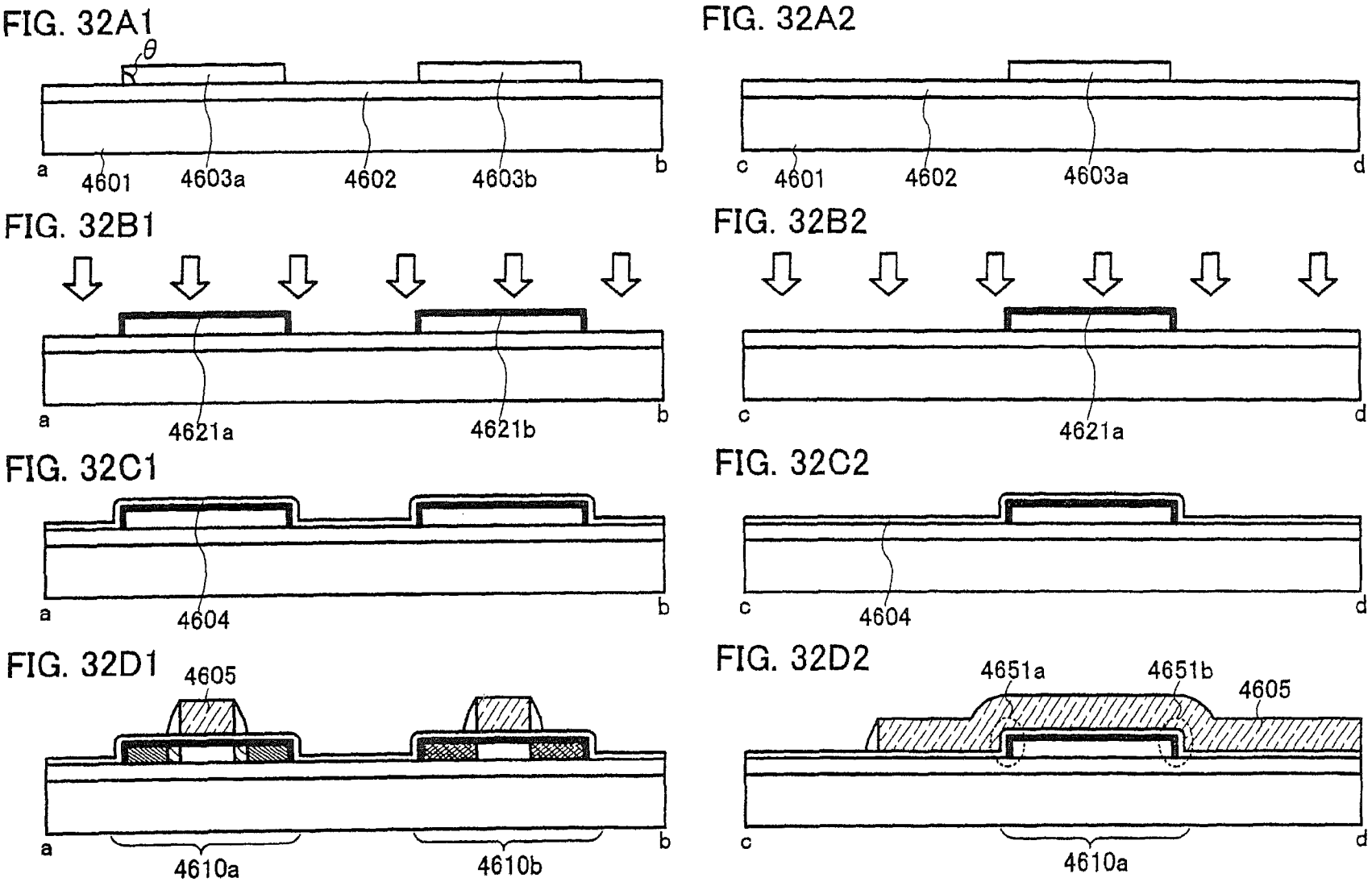
FIG. 32A1
θ
4601
4603a
4602
4603b
a
b
FIG. 32A2
4601
4603a
4602
c
d
FIG. 32B1
4621a
4621b
a
b
FIG. 32B2
4621a
c
d
FIG. 32C1
4604
a
b
FIG. 32C2
4604
c
d
FIG. 32D1
4605
4610a
4610b
a
b
FIG. 32D2
4605
4651a
4651b
4610a
c
d

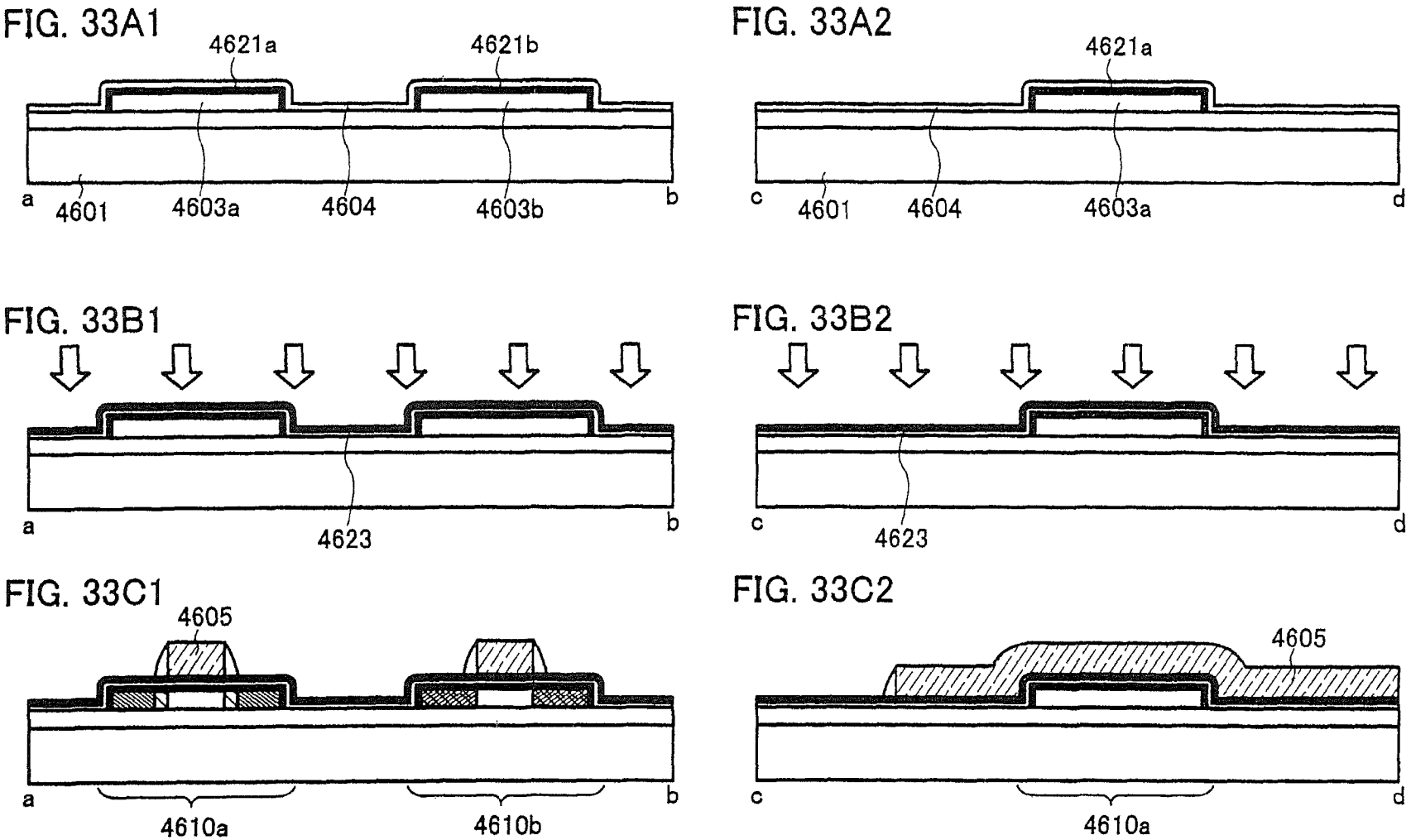
FIG. 33A1
4621a
4621b
4603a
4603b
4604
4601
a
b
FIG. 33A2
4621a
4603a
4604
4601
c
d
FIG. 33B1
4623
a
b
FIG. 33B2
4623
c
d
FIG. 33C1
4605
4610a
4610b
a
b
FIG. 33C2
4605
4610a
c
d

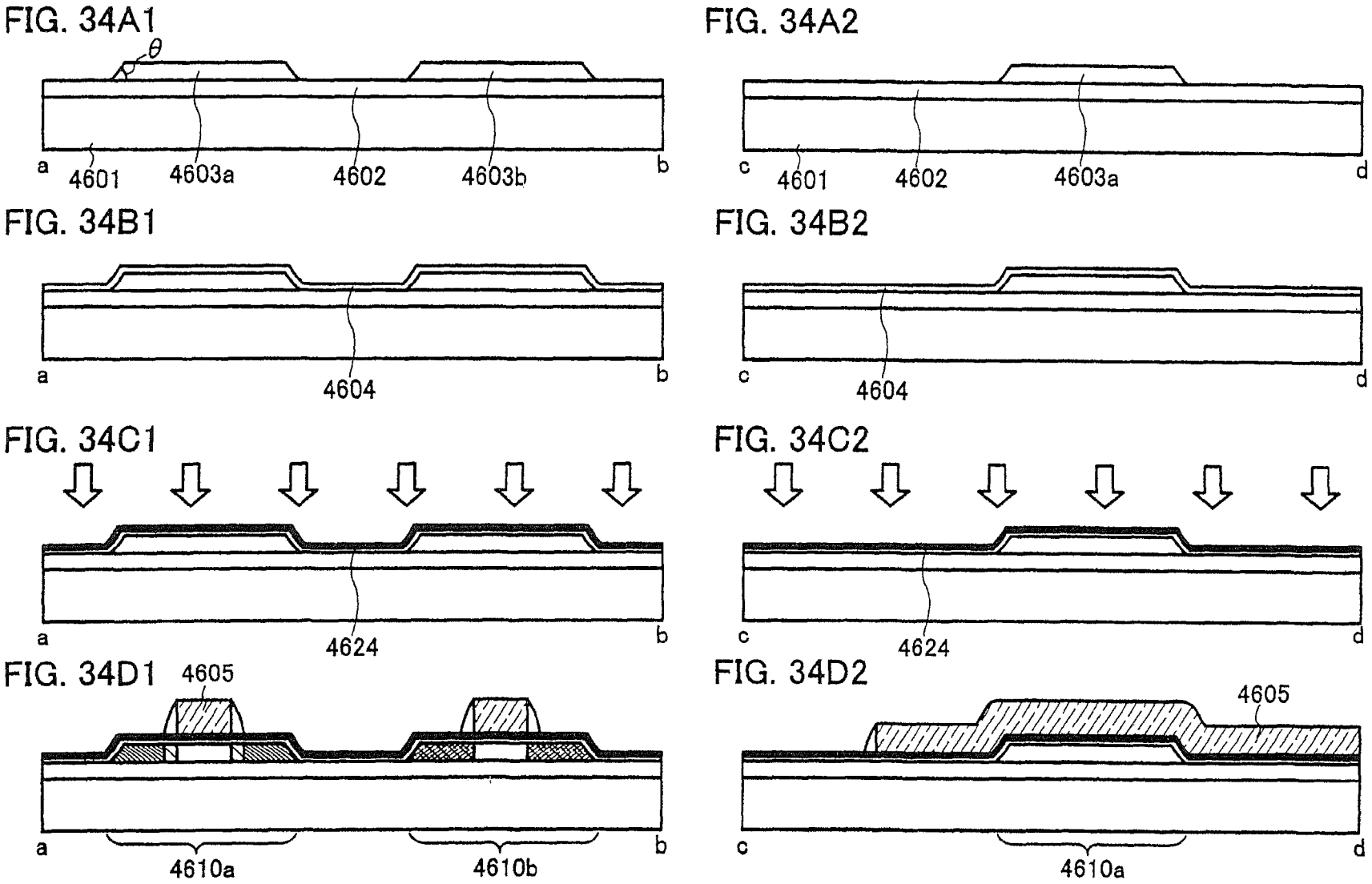
FIG. 34A1
FIG. 34A2
FIG. 34B1
FIG. 34B2
FIG. 34C1
FIG. 34C2
FIG. 34D1
FIG. 34D2
a
b
c
d
θ
4601
4602
4603a
4603b
4604
4605
4610a
4610b
4624

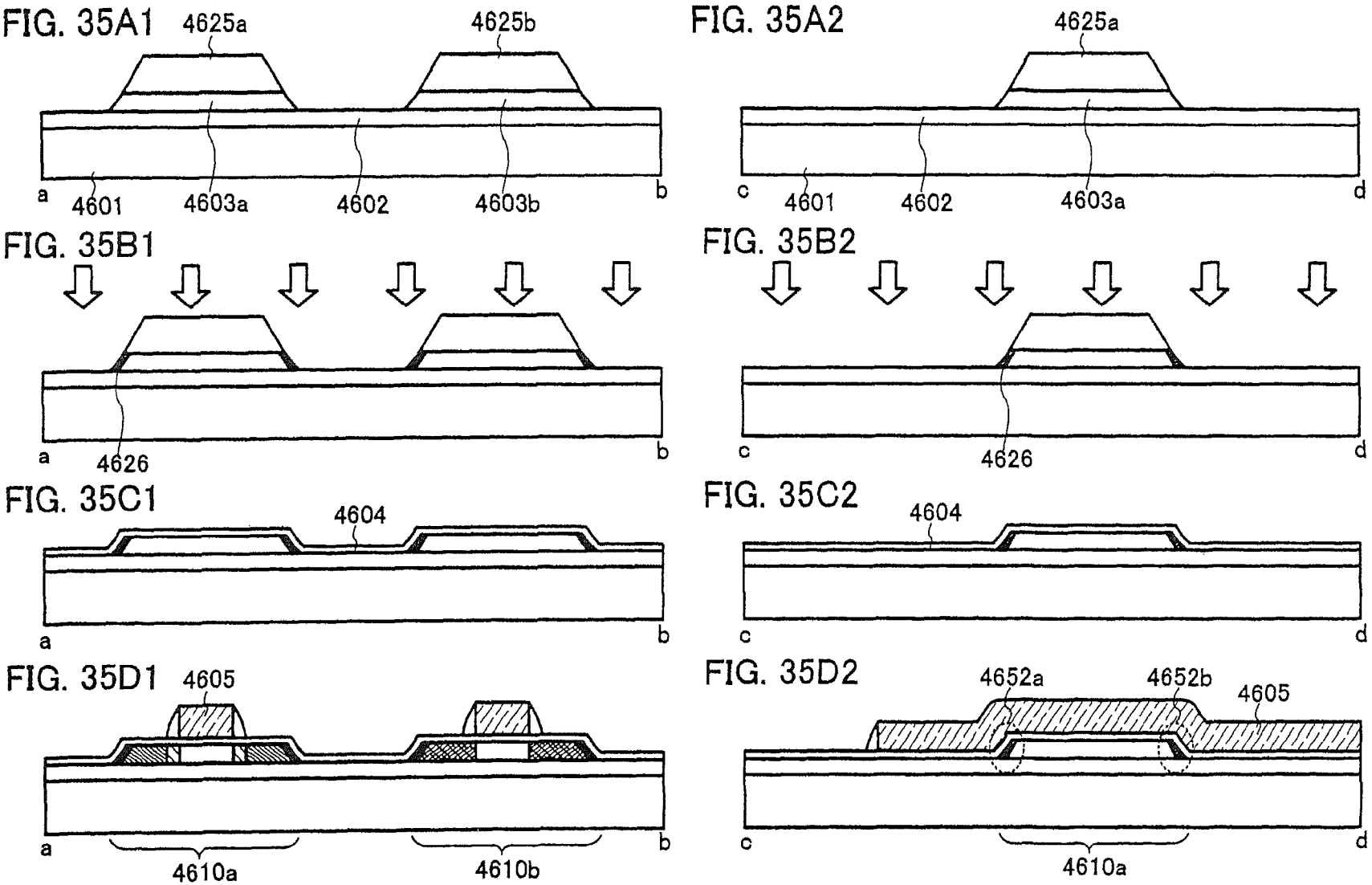
FIG. 35A1
4625a
4625b
4603a
4603b
4602
4601
a
b
FIG. 35B1
4626
FIG. 35C1
4604
FIG. 35D1
4605
4610a
4610b
FIG. 35A2
4625a
4603a
4602
4601
c
d
FIG. 35B2
4626
FIG. 35C2
4604
FIG. 35D2
4605
4652b
4652a
4610a

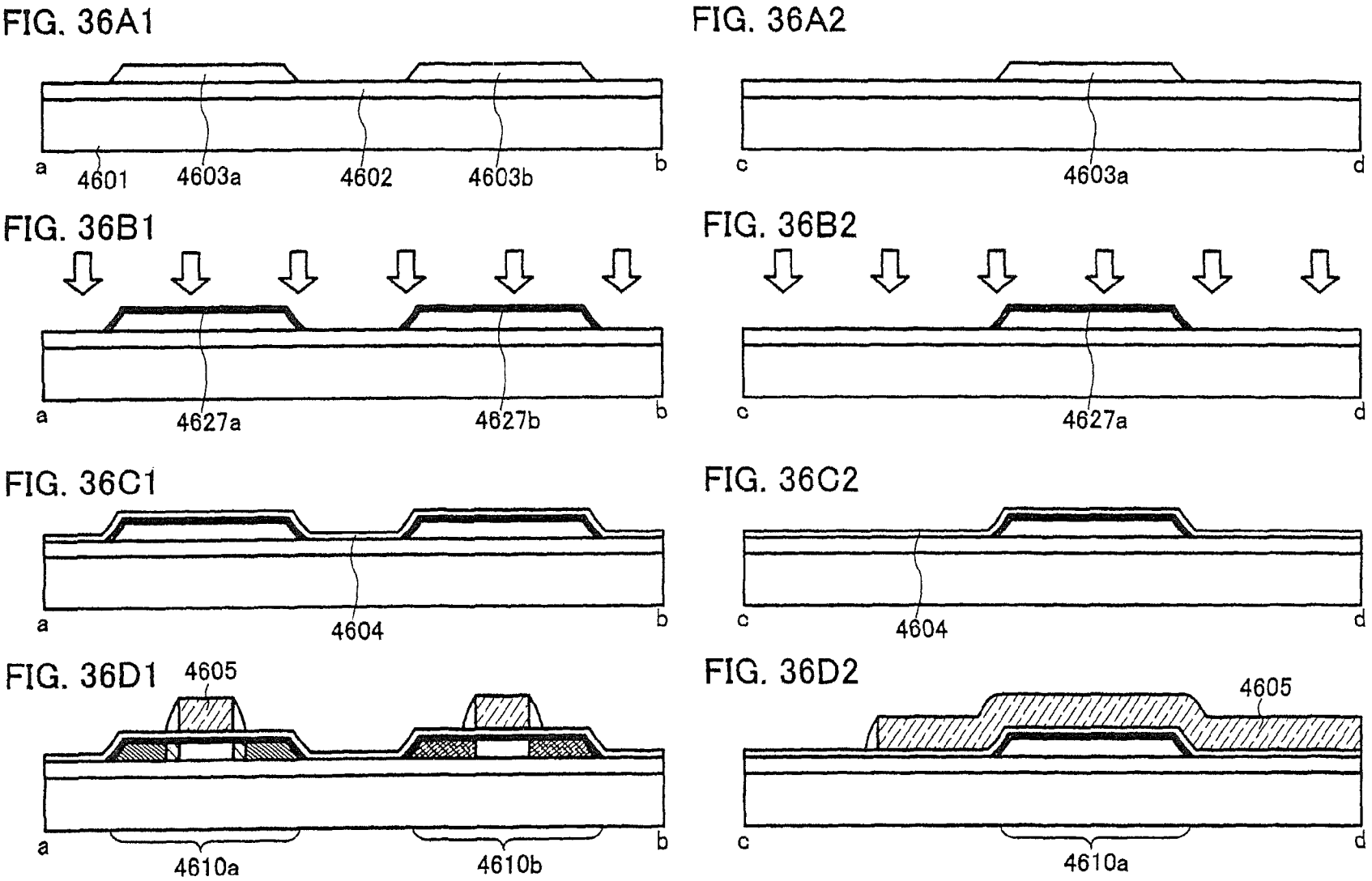
FIG. 36A1
FIG. 36A2
FIG. 36B1
FIG. 36B2
FIG. 36C1
FIG. 36C2
FIG. 36D1
FIG. 36D2
4601
4602
4603a
4603b
4627a
4627b
4604
4605
4610a
4610b
a
b
c
d

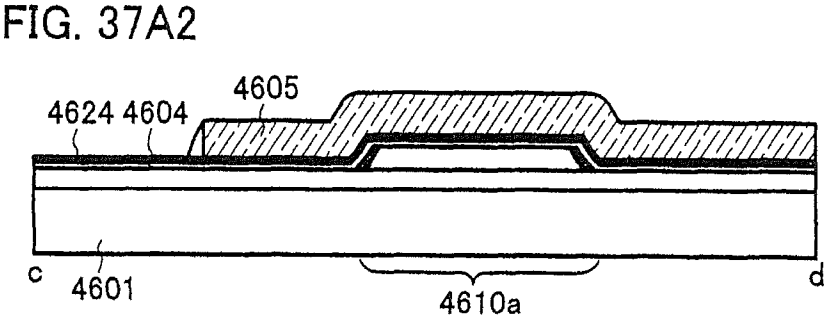
FIG. 37A2
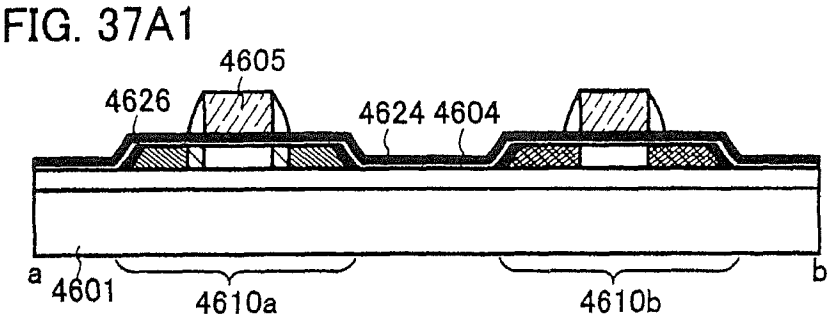
FIG. 37A1
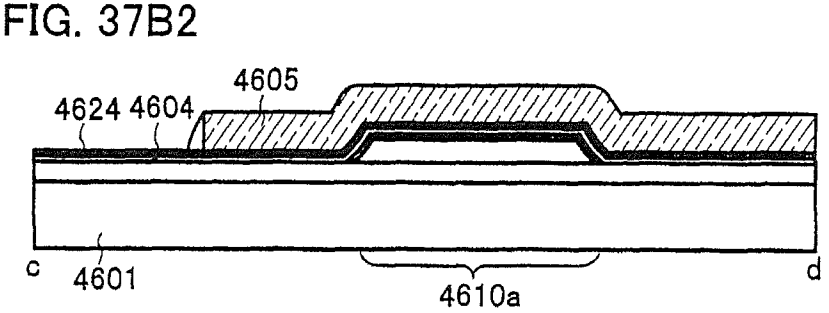
FIG. 37B2
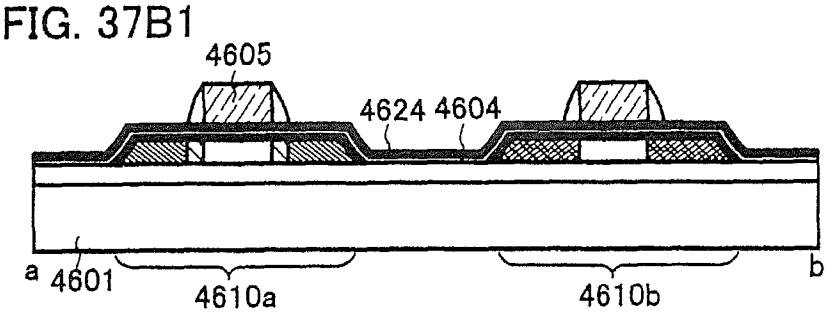
FIG. 37B1

SEMICONDUCTOR DEVICE AND DRIVING METHOD THEREOF

CROSS-REFERENCE TO RELATED APPLICATIONS

This application is a continuation of U.S. application Ser. No. 11/456,296, filed Jul. 10, 2006, now allowed, which claims the benefit of a foreign priority application filed in Japan as Serial No. 2005-205147 on Jul. 14, 2005, both of which are incorporated by reference.

BACKGROUND OF THE INVENTION

1. Field of the Invention

The present invention relates to a semiconductor device having transistors and a driving method thereof. In particular, the invention relates to a semiconductor device having pixels each including a thin film transistor (hereinafter also called a "TFT") and a driving method thereof.

2. Description of the Related Art

In recent years, a thin display (also called a flat panel display) using elements which use the electrooptic property of liquid crystals or emit light with electroluminescence has been drawing attention and the market of such industries is expected to enter into the expansion phase. So-called active matrix displays where pixels are formed with TFTs over a glass substrate have been gaining importance as a thin display. In particular, a TFT having a channel portion formed of a polycrystalline silicon film can achieve a high-speed operation since it has higher electron field-effect mobility in comparison with a conventional TFT using an amorphous silicon film. Therefore, the pixels can be controlled with a driver circuit which is formed by using TFTs over the same substrate as the pixels. A display where pixels and a functional circuit are formed over the same substrate by using TFTs has various advantages such as reduction of component parts, improvement in yield by the simplified manufacturing process, and improvement in productivity.

An active matrix display where electroluminescence elements (hereinafter also called "EL elements" in this specification) and TFTs are combined (hereinafter also called an "EL display") can achieve reduction in thickness and weight; therefore, it has been drawing attention as a next-generation display. Such a display is examined to be developed to displays with various sizes, for example from a small size of 1 to 2 inches to a large size of over 40 inches.

Luminance of an EL element has a proportional relationship with the amount of current flowing therein. Therefore, an EL display which uses an EL element as a display medium can express gray scales by using current. As a method for expressing gray scales, a method of controlling the amount of current flowing in an EL element is known, where the EL element and a TFT (hereinafter also called a "driving TFT") are connected in series between two power supply lines, and a gate-source voltage of the driving TFT operating in the saturation region is changed to control the amount of current flowing in the EL element (for example, see Reference 1: Japanese Patent Laid-Open No. 2003-271095). In addition, there is also a driving method for expressing gray scales by using a constant current and controlling the time when the current flows in an EL element (for example, see Reference 2: Japanese Patent Laid-Open No. 2002-514320).

However, the conventional pixel configuration has a problem in that power consumption is increased if a potential of a wire for outputting a video signal (hereinafter also called a "signal line") changes every time a video signal is applied to a gate of a driving TFT (driving transistor) from the signal line, since the parasitic capacitance of the signal line stores and releases electric charges.

SUMMARY OF THE INVENTION

In view of the foregoing problem, it is an object of the invention to reduce power consumption of a semiconductor device having TFTs.

A semiconductor device of the invention includes a pixel to which a video signal is input, a gate signal line for selecting a pixel to which a video signal is input, and a source signal line for inputting a video signal to the pixel. The semiconductor device further includes a switch connected in series with the source signal line, the switch being controlled to be in on state when the pixel is not selected by the gate signal line, and in off state when the pixel is selected by the gate signal line.

A semiconductor device in accordance with one aspect of the invention includes: a plurality of pixels to which a video signal is input, the pixels being arranged in matrix of rows and columns; a plurality of gate signal lines extending in a row direction, each of which selects an input of a video signal to the plurality of pixels; a plurality of source signal lines extending in a column direction, each of which inputs a video signal to the plurality of pixels; and a plurality of switches which are respectively connected in series with the plurality of source signal lines corresponding to the plurality of pixels. The switches in a row not selected by the gate signal line are in on state, while the switches in a row selected by the gate signal line are in off state.

A semiconductor device in accordance with one aspect of the invention includes: a pixel to which a video signal is input; a gate signal line for selecting an input of a video signal to the pixel; a source signal line for inputting a video signal to the pixel; and a first transistor connected in series with the source signal line. The first transistor is in on state when the pixel is not selected by the gate signal line, while in off state when the pixel is selected by the gate signal line. In addition, the pixel includes: a light-emitting element; a light-emission control circuit for controlling a light-emitting state of the light-emitting element in accordance with a video signal; and a second transistor, one of either a source or a drain of the second transistor being connected to the first transistor, and the other thereof being connected to the light-emission control circuit.

A semiconductor device in accordance with one aspect of the invention includes: a plurality of pixels to which a video signal is input, the pixels being arranged in matrix of rows and columns; a plurality of gate signal lines extending in a row direction, each of which selects an input of a video signal to the plurality of pixels; a plurality of source signal lines extending in a column direction, each of which inputs a video signal to the plurality of pixels; and a plurality of first transistors which are respectively connected in series with the plurality of source signal lines corresponding to the plurality of pixels. The first transistors in a row not selected by the gate signal line are in on state, while the first transistors in a row selected by the gate signal line are in off state. In addition, each pixel includes: a light-emitting element; a light-emission control circuit for controlling a light-emitting state of the light-emitting element in accordance with a video signal; and a second transistor, one of either a source or a drain of the second transistor being connected to the first transistor, and the other thereof being connected to the light-emission control circuit.

A semiconductor device in accordance with one aspect of the invention includes: a pixel to which a video signal is input; a first gate signal line for selecting an input of a video signal to the pixel; a second gate signal line having a potential obtained by inverting a potential of the first gate signal line; a source signal line for inputting a video signal to the pixel; and a first transistor connected in series with the source signal line. A potential of the second gate signal line is applied to a gate of the first transistor. In addition, the pixel includes: a light-emitting element; a light-emission control circuit for controlling a light-emitting state of the light-emitting element in accordance with a video signal; and a second transistor, one of either a source or a drain of the second transistor being connected to the first transistor; the other thereof being connected to the light-emission control circuit; and a gate thereof being connected to the first gate signal line.

A semiconductor device in accordance with one aspect of the invention includes: a pixel to which a video signal is input; a first gate signal line for selecting an input of a video signal to the pixel; a source signal line for inputting a video signal to the pixel; a first transistor connected in series with the source signal line; and a second gate signal line connected to a gate of the first transistor. In addition, the pixel includes: a light-emitting element; a light-emission control circuit for controlling a light-emitting state of the light-emitting element in accordance with a video signal; and a second transistor, one of either a source or a drain of the second transistor being connected to the source signal line, the other thereof being connected to the light-emission control circuit, and a gate thereof being connected to the first gate signal line. Each of the first gate signal line and the second gate signal line has a potential which allows the first transistor in a row selected by the second gate signal line to be in off state when the second transistor connected to the first gate signal line is in on state, and allows the first transistor in a row selected by the second gate signal line to be in on state when the second transistor connected to the first gate signal line is in off state.

Various types of elements may be used as a switch of the invention. For example, there is an electrical switch or a mechanical switch. That is, anything that can control a current flow can be used, and various elements may be used without limiting to a certain element. For example, it may be a transistor, a diode (e.g., a PN junction diode, a PIN diode, a Schottky diode, or a diode-connected transistor), a thyristor, or a logic circuit combining such elements. Therefore, in the case of using a transistor as a switch, the polarity (conductivity type) thereof is not particularly limited because it operates just as a switch. However, when off-current is preferred to be small, a transistor of a polarity with small off-current is desirably used. As a transistor with small off-current, there is a transistor provided with an LDD region, a transistor with a multi-gate structure, or the like. Further, it is desirable that an n-channel transistor is employed when a potential of a source terminal of the transistor which is operated as a switch is closer to the low-potential-side power supply (e.g., Vss, GND, or 0 V), while a p-channel transistor is employed when the potential of the source terminal is closer to the high-potential-side power supply (e.g., Vdd). This helps the switch operate efficiently because the absolute value of the gate-source voltage of the transistor can be increased.

A CMOS switch may also be constructed by using n-channel and p-channel transistors. When a CMOS is used as a switch, a current can flow through the switch when either of the p-channel or the n-channel transistor is turned on. Thus, it can effectively function as a switch. For example, a voltage can be appropriately output regardless of whether an input voltage of the switch is high or low. Further, since a voltage swing of a signal for turning on or off the switch can be suppressed, power consumption can be suppressed.

In the case of using a transistor as a switch, the switch has an input terminal (one of either a source terminal or a drain terminal), an output terminal (the other of either the source terminal or the drain terminal), and a terminal (gate terminal) for controlling electrical conduction. On the other hand, in the case of using a diode as a switch, the switch may not have a terminal for controlling electrical conduction. Therefore, the number of wires for controlling terminals can be reduced.

In the invention, a "connection" means any of an electrical connection, a functional connection, and a direct connection. Accordingly, in the configurations disclosed in the invention, other elements may be interposed between elements having a predetermined connection relation. For example, one or more elements which enable an electrical connection (e.g., a switch, a transistor, a capacitor, an inductor, a resistor, or a diode) may be interposed between elements. In addition, one or more circuits which enable a functional connection can be provided in addition to the predetermined elements, such as a logic circuit (e.g., an inverter, a NAND circuit, or a NOR circuit), a signal converter circuit (e.g., a DA converter circuit, an AD converter circuit, or a gamma correction circuit), a potential level converter circuit (e.g., a power supply circuit such as a boosting circuit or a voltage step-down circuit, or a level shifter circuit for changing a potential level of an H signal or an L signal), a voltage source, a current source, a switching circuit, or an amplifier circuit (e.g., a circuit which can increase the signal amplitude or the amount of current, such as an operational amplifier, a differential amplifier circuit, a source follower circuit, or a buffer circuit). Alternatively, the elements may be directly connected without interposing other elements or circuits therebetween.

When elements in this specification are connected without interposing other elements or circuits therebetween, such elements are described as being "directly connected". On the other hand, when elements in this specification are described as being "electrically connected", there are a case where such elements are electrically connected (that is, connected by interposing other elements therebetween), a case where such elements are functionally connected (that is, connected by interposing other circuits therebetween), and a case where such elements are directly connected (that is, connected without interposing other elements or circuits therebetween).

A display element, a display device, a light-emitting element, and a light-emitting device may be in various modes. As an example of a display element disposed in a pixel, there is a display medium, the contrast of which changes by an electromagnetic action, such as an EL element (e.g., an organic EL element, an inorganic EL element, or an EL element containing both organic and inorganic materials); an electron-emissive element; a liquid crystal element; electronic ink; a grating light valve (GLV); a plasma display (PDP); a digital micromirror device (DMD); a piezoelectric ceramic element; or a carbon nanotube. In addition, a display device using an EL element includes an EL display; a display device using an electron-emissive element includes a field emission display (FED), a surface-conduction electron-emitter display (SED), or the like; a display device using a liquid crystal element includes a liquid crystal display, a transmissive liquid crystal display, a semi-transmissive liquid crystal display, and a reflective liquid crystal display; and a display device using electronic ink includes electronic paper.

Various kinds of transistors can be applied to a transistor of the invention without limiting to a certain type. For example, the invention may employ a thin film transistor (TFT) using a non-single crystalline semiconductor film typified by amorphous silicon or polycrystalline silicon. Accordingly, various advantages can be provided that such transistors can be manufactured at a low temperature and low cost, and can be formed over a large substrate as well as a light-transmissive substrate, and further, such transistors can transmit light. In addition, the invention may employ a MOS transistor formed with a semiconductor substrate or an SOI substrate, a junction transistor, a bipolar transistor, or the like. Accordingly, transistors with few variations, transistors with high current supply capability, and transistors with a small size can be manufactured, thereby a circuit with low power consumption can be constructed by using such transistors. Further, the invention may employ a transistor including a compound semiconductor such as ZnO, a-InGaZnO, SiGe, or GaAs or a thin film transistor obtained by thinning such semiconductors. Accordingly, such transistors can be manufactured at a low temperature, for example at a room temperature, and formed directly over a substrate having low heat resistance such as a plastic substrate or a film substrate. In addition, the invention may employ a transistor or the like formed by ink-jet deposition or printing. Accordingly, such transistors can be manufactured at a room temperature and low vacuum, and can be formed over a large substrate. In addition, since such transistors can be manufactured without using a mask (reticle), the layout design can be easily changed. In addition, a transistor including an organic semiconductor or a carbon nanotube, or other transistors may be employed as well. Accordingly, transistors can be formed over a substrate that can be bent flexibly. In the case of using a non-single crystalline semiconductor film, it may contain hydrogen or halogen. In addition, a substrate over which transistors are formed is not limited to a certain type, and various kinds of substrates can be used. Accordingly, transistors may be formed over, for example, a single crystalline substrate, an SOI substrate, a glass substrate, a quartz substrate, a plastic substrate, a paper substrate, a cellophane substrate, a stainless steel substrate, a substrate made of a stainless steel foil, or the like. In addition, after forming transistors over a substrate, the transistors may be transposed onto another substrate. By using the aforementioned substrates, transistors with excellent characteristics, and transistors with low power consumption can be formed, and thus a device with high tolerance and high heat resistance can be formed.

The structure of a transistor may be various modes, and thus is not limited to a certain type. For example, a multi-gate structure having two or more gate electrodes may be used. When a multi-gate structure is used, channel regions are connected in series; therefore, a structure where a plurality of transistors are connected in series is provided. Thus, by employing a multi-gate structure, off-current can be reduced as well as the withstand voltage can be increased to improve the reliability of the transistor, and even when a drain-source voltage fluctuates at the time when the transistor operates in the saturation region, flat characteristics can be provided without causing fluctuations of a drain-source current that much. In addition, a structure where gate electrodes are formed above and below a channel may also be employed. By using a structure where gate electrodes are formed above and below a channel, the channel region can be enlarged to increase the amount of current flowing therein, and a depletion layer can be easily formed to decrease the S value. When gate electrodes are formed above and below a channel, a structure where a plurality of transistors are connected in parallel is provided.

In addition, any of the following structures may be employed: a structure where a gate electrode is formed above a channel; a structure where a gate electrode is formed below a channel; a staggered structure; an inversely staggered structure; and a structure where a channel region is divided into a plurality of regions and connected in parallel or in series. In addition, a channel (or a part of it) may overlap with a source electrode or a drain electrode. By forming a structure where a channel (or a part of it) overlaps with a source electrode or a drain electrode, electric charges can be prevented from gathering in a part of the channel, which would otherwise result in the unstable operation. In addition, an LDD region may be provided. By providing an LDD region, off-current can be reduced as well as the withstand voltage can be increased to improve the reliability of the transistor, and even when a drain-source voltage fluctuates at the time when the transistor operates in the saturation region, flat characteristics can be provided without causing fluctuations of a drain-source current that much.

In the invention, various types of transistors may be used, and such transistors may be formed over various types of substrates. Accordingly, the whole circuits may be formed over a glass substrate, a plastic substrate, a single crystalline substrate, an SOI substrate, or any other substrates. By forming the whole circuits over the same substrate, the number of component parts can be reduced to cut cost, as well as the number of connections with the circuit components can be reduced to improve the reliability. Alternatively, a part of the circuits may be formed over one substrate, while the other parts of the circuits may be formed over another substrate. That is, not the whole circuits are required to be formed over the same substrate. For example, a part of the circuits may be formed with transistors over a glass substrate, while the other parts of the circuits may be formed over a single crystalline substrate, so that the IC chip is connected to the glass substrate by COG (Chip-On-Glass) bonding. Alternatively, the IC chip may be connected to the glass substrate by TAB (Tape Automated Bonding) or a printed board. In this manner, by forming parts of the circuits over the same substrate, the number of component parts can be reduced to cut cost, as well as the number of connections with the circuit components can be reduced to improve the reliability. In addition, by forming a portion with a high driving voltage or a high driving frequency which would consume large power, over a different substrate, increase in power consumption can be prevented.

In the invention, a pixel means one element, the brightness of which can be controlled. For example, a pixel means one color element, and the brightness is expressed with one color element. Thus, in the case of a color display device having color elements of R (Red), G (Green), and B (Blue), a minimum unit of an image is composed of three pixels of an R pixel, a G pixel, and a B pixel. Note that the color elements are not limited to three colors, and color elements with more than three colors may be employed, while at the same time, color elements other than the RGB may be employed. For example, there is RGBW (W means white) as an example of adding white, or RGB plus yellow, cyan, magenta, emerald green, and/or cinnabar red. In addition, another similar color may be added to at least one of R, G, and B. For example, four color elements of R, G, B1, and B2 may be formed. Although B1 and B2 are both blue colors, they have a little different absorption wavelengths. By using such color elements, display can be performed with closer colors to the real image, as well as the power consumption can be reduced. As another example, there is a case where one color element is controlled in brightness by using a plurality of regions. In such a case, one region corresponds to one pixel. For example, in the case of performing an area gray scale display, one color element has a plurality of regions to be controlled in brightness, so that the whole regions are used for expressing gray scales. In this case, one region to be controlled in brightness corresponds to one pixel. Accordingly, in such a case, one color element is composed of a plurality of pixels. Further, there may be a case where regions which contribute to displaying gray scales differ in size between each pixel. In addition, viewing angles may be widened by supplying slightly different signals to a plurality of regions to be controlled in brightness in one color element, that is, a plurality of pixels which form one color element.

The description of "one pixel (for three colors)" in this specification corresponds to the case where three pixels of R, G, and B are considered as one pixel. Meanwhile, the description of "one pixel (for one color)" in this specification corresponds to the case where a plurality of pixels which form one color element are collectively considered as one pixel.

In the invention, pixels may be provided (arranged) in matrix. Herein, when it is described that pixels are provided (arranged) in matrix, there may be a case where the pixels are provided linearly or not linearly in the longitudinal direction or the lateral direction. For example, in the case of performing a full color display with three color elements (e.g., RGB), there may be a case where dots of the three color elements are arranged in stripes or in delta pattern. Further, there may be a case where dots of the three color elements are provided in the Bayer arrangement. The area of display regions may differ between dots of the respective color elements. Accordingly, power consumption can be reduced, as well as a life of a display element can be lengthened.

A transistor is an element having at least three terminals of a gate, a drain, and a source. A channel region is provided between the drain region and the source region, and a current can flow through the drain, channel, and source regions. Here, since a source and a drain of a transistor may change depending on the structure, operating conditions, and the like of the transistor, it is difficult to define which of the two terminals is a source or a drain. Therefore, in the invention, regions functioning as a source and a drain may not be called a source or a drain. In such a case, for example, one of the source and the drain may be called a first terminal and the other may be called a second terminal.

Note also that a transistor may be an element having at least three terminals of a base, an emitter, and a collector. In this case also, one of the emitter and the collector may be called a first terminal and the other may be called a second terminal.

A gate means a part or all of a gate electrode and a gate wire (also called a gate line, a gate signal line, or the like). A gate electrode means a conductive film which overlaps with a semiconductor for forming a channel region or an LDD (Lightly Doped Drain) region with a gate insulating film sandwiched therebetween. A gate wire means a wire for connecting gate electrodes of different pixels, or a wire for connecting a gate electrode to another wire.

Note that there is a portion functioning as both a gate electrode and a gate wire. Such a region may be called either a gate electrode or a gate wire. That is, there is a region where a gate electrode and a gate wire cannot be clearly distinguished from each other. For example, in the case where a channel region overlaps with a gate wire which is extended, the overlapped region functions as both a gate wire and a gate electrode. Accordingly, such a region may be called either a gate electrode or a gate wire.

In addition, a region formed of the same material as the gate electrode, and connected to the gate electrode may be called a gate electrode. Similarly, a region formed of the same material as the gate wire, and connected to the gate wire may be called a gate wire. In a strict sense, such a region may not overlap with the channel region or may not have a function of connecting to another gate electrode. However, there is a region formed of the same material as the gate electrode or the gate wire, and connected to the gate electrode or the gate wire in order to provide a sufficient manufacturing margin. Accordingly, such a region may also be called either a gate electrode or a gate wire.

In the case of a multi-gate transistor, for example, a gate electrode of a transistor is often connected to a gate electrode of another transistor with the use of a conductive film which is formed of the same material as the gate electrode. Since this region connects a gate electrode to another gate electrode, it may be called a gate wire, while it may also be called a gate electrode since a multi-gate transistor may be regarded as one transistor. That is, a region may be called a gate electrode or a gate wire as long as it is formed of the same material as the gate electrode or the gate wire and connected thereto. In addition, a part of a conductive film which connects a gate electrode and a gate wire, for example, may also be called either a gate electrode or a gate wire.

Note that a gate terminal means a part of a gate electrode or a region electrically connected to the gate electrode.

Note also that a source means a part or all of a source region, a source electrode, and a source wire (also called a source line, a source signal line, or the like). A source region is a semiconductor region containing a large amount of p-type impurities (e.g., boron or gallium) or n-type impurities (e.g., phosphorus or arsenic). Accordingly, it does not include a region containing a slight amount of p-type impurities or n-type impurities, namely, an LDD (Lightly Doped Drain) region. A source electrode is a conductive layer formed of a different material from the source region, and electrically connected to the source region. Note that there is a case where a source electrode and a source region are collectively called a source electrode. A source wire is a wire for connecting source electrodes of different pixels, or a wire for connecting a source electrode to another wire.

Note that there is a portion functioning as both a source electrode and a source wire. Such a region may be called either a source electrode or a source wire. That is, there is a region where a source electrode and a source wire cannot be clearly distinguished from each other. For example, in the case where a source region overlaps with a source wire which is extended, the overlapped region functions as both a source wire and a source electrode. Accordingly, such a region may be called either a source electrode or a source wire.

In addition, a region formed of the same material as a source electrode, and connected to the source electrode, or a portion for connecting a source electrode to another source electrode may be called a source electrode. A part of a source wire which overlaps with a source region may be called a source electrode as well. Similarly, a region formed of the same material as the source wire, and connected to the source wire may be called a source wire as well. In a strict sense, such a region may not have a function of connecting to another source electrode. However, there is a region formed of the same material as the source electrode or the source wire, and connected to the source electrode or the source wire in order to provide a sufficient manufacturing margin. Accordingly, such a region may also be called either a source electrode or a source wire.

In addition, a part of a conductive film which connects a source electrode and a source wire may be called either a source electrode or a source wire, for example.

Note that a source terminal means a part of a source region, a source electrode, or a part of a region electrically connected to the source electrode. Note also that the same can be said for a drain.

In the invention, a "semiconductor device" means a device having a circuit including semiconductor elements (e.g., transistors or diodes). It also includes all devices that can function by utilizing semiconductor characteristics. In addition, a "display device" means a device having display elements (e.g., liquid crystal elements or light-emitting elements). Note that the display device also includes a display panel itself where a plurality of pixels each including a display element such as a liquid crystal element or an EL element are formed over the same substrate as a peripheral driver circuit for driving the pixels. In addition to such a display panel, the display device may include a peripheral driver circuit provided over the substrate by wire bonding or bump bonding, namely, chip-on-glass (COG) bonding. Further, the display device may include a flexible printed circuit (FPC) or a printed wiring board (PWB) attached to a display panel (e.g., an IC, a resistor, a capacitor, an inductor, or a transistor). Such a display device may further include an optical sheet such as a polarizing plate or a retardation plate. Further, it may include a backlight unit (which may include a light guide plate, a prism sheet, a diffusion sheet, a reflective sheet, and a light source (e.g., an LED or a cold-cathode tube)). In addition, a light-emitting device means a display device having self-luminous display elements, in particular, such as EL elements or elements used for an FED. A liquid crystal display device means a display device having liquid crystal elements.

In the invention, when it is described that an object is formed on another object, it does not necessarily mean that the object is in direct contact with the another object. In the case where the above two objects are not in direct contact with each other, still another object may be sandwiched therebetween. Accordingly, when it is described that a layer B is formed over a layer A, it means either a case where the layer B is formed in direct contact with the layer A, or a case where another layer (e.g., a layer C and/or a layer D) is formed in direct contact with the layer A, and then the layer B is formed in direct contact with the layer C or D. In addition, when it is described that an object is formed above another object, it does not necessarily mean that the object is in direct contact with the another object, and still another object may be sandwiched therebetween. Accordingly, when it is described that a layer B is formed above a layer A, it means either a case where the layer B is formed in direct contact with the layer A, or a case where another layer (e.g., a layer C and/or a layer D) is formed in direct contact with the layer A, and then the layer B is formed in direct contact with the layer C or D. Similarly, when it is described that an object is formed below or under another object, it means either a case where the objects are in direct contact with each other or not.

In this specification, a "source signal line" means a wire connected to an output of a source driver, in order to transmit a video signal from the source driver for controlling the operation of a pixel.

In addition, in this specification, a "gate signal line" means a wire connected to an output of a gate driver, in order to transmit a scan signal from the gate driver for controlling selection/non-selection of video signal writing to a pixel.

According to the invention, a video signal is written from a source signal line into a pixel which is selected by a gate signal line, and a switching element in a pixel which is not selected by the gate signal line is in on state, while a switching element in a pixel which is selected by the gate signal line is in off state, thereby adverse effects by the parasitic capacitance of the source signal line can be suppressed. That is, the parasitic capacitance of the source signal line which stores and releases electric charges affects only pixels between an output side of a source driver up to and including the pixel selected to be written with a video signal. In this manner, power consumed by the charging and discharging of the source signal line can be reduced, and thus low power consumption can be achieved.

BRIEF DESCRIPTION OF THE DRAWINGS

In the accompanying drawings,

FIGS. 32A1 to 32D2 show a method of manufacturing a semiconductor device according to Embodiment 3;

FIGS. 33A1 to 33C2 show a method of manufacturing a semiconductor device according to Embodiment 3;

FIGS. 34A1 to 34D2 show a method of manufacturing a semiconductor device according to Embodiment 3;

FIGS. 35A1 to 35D2 show a method of manufacturing a semiconductor device according to Embodiment 3;

FIGS. 36A1 to 36D2 show a method of manufacturing a semiconductor device according to Embodiment 3;

FIGS. 37A1 to 37B2 show a method of manufacturing a semiconductor device according to Embodiment 3;

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein.

Embodiment Mode 1

A semiconductor device with a first configuration in accordance with the invention will be described, with reference to FIG. 1.

Figure 1:
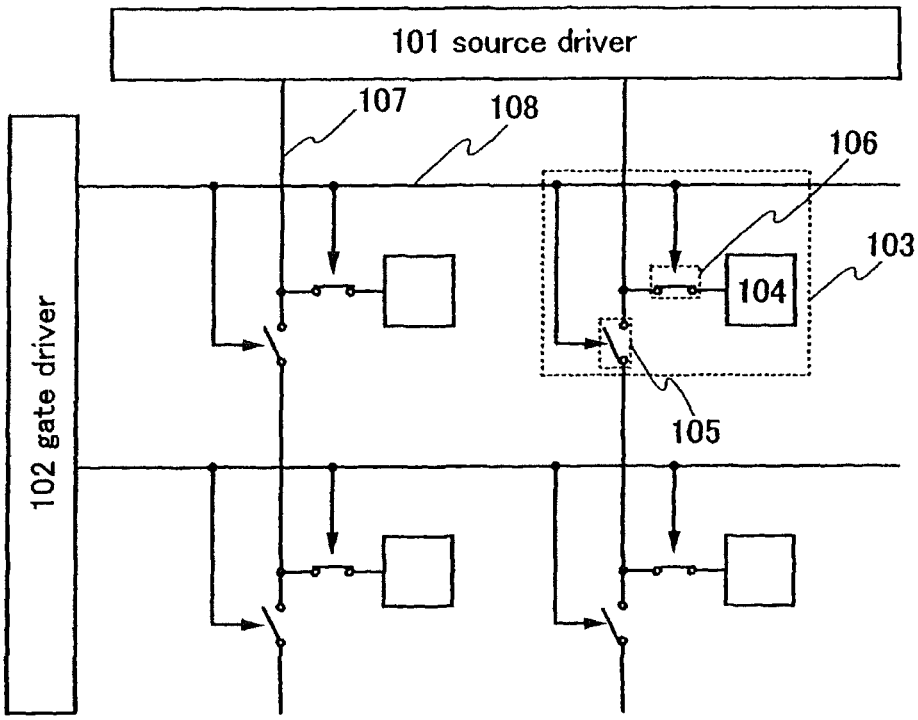
FIG. 1 shows a semiconductor device of the invention according to Embodiment Mode 1.

In FIG. 1, a plurality of pixels 103 are arranged in matrix of rows and columns. A source driver 101 has a circuit for outputting a video signal in response to a control signal input. The source driver 101 inputs a video signal into a pixel 103 which is selected to be written with a video signal, through a source signal line 107. A gate driver 102 has a circuit for scanning a gate signal line 108 in response to a control signal input to the gate driver 102, thereby selecting a pixel to be written with a video signal. The pixel 103 includes a light-emitting unit 104 and switches 105 and 106 which are turned on or off by the gate signal line 108. These two switches operate in such a manner that the switch 106 is off when the switch 105 is on, and vice versa, the switch 106 is on when the switch 105 is off. Note that the light-emitting unit 104 includes a light-emitting element and a circuit for controlling the light-emitting element.

In the semiconductor device with such a configuration, description is made of an operation of writing a video signal into the pixel 103 from the source driver 101 through the source signal line 107. In this case, the switch 105 is off and the switch 106 is on in the pixel 103 to which a video signal is input. Then, a video signal is input to the light-emitting unit 104 from the source driver 101 through the source signal line 107.

Next, an operation of writing no video signal into the pixel 103 is described. In this case, the switch 105 is on and the switch 106 is off in the pixel 103 to be written with no video signal. Therefore, a video signal is not written into the light-emitting unit 104 from the source driver 101 through the source signal line 107.

A video signal output from the source driver 101 may be either a voltage signal or a current signal. In addition, an internal configuration of the pixel is not specifically limited as long as a video signal can be input to the pixel. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current or the like. In addition, a power supply line and a signal line may be added according to need. In such a case, the power supply line may supply either a voltage or a current, and the signal line may be controlled with either a voltage or a current.

In this embodiment mode, the parasitic capacitance of the source signal line 107 affects only the pixels 103 between an output side of the source driver 101 up to and including the pixel 103 selected to be written with a video signal, by turning off the switch 105 provided in the pixel 103 selected to be written with a video signal. Therefore, the power consumption can be suppressed, which would otherwise be increased due to the charging and discharging by the parasitic capacitance of the source signal line 107.

In addition, since the parasitic capacitance of the source signal line 107 affects only the pixels 103 between the output side of the source driver 101 up to and including the pixel 103 selected to be written with a video signal, a writing period of a video signal into the pixel 103 can be shortened. This is a great advantage in the case of operating the pixel with a current input.

In this manner, according to this embodiment mode, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 2

A semiconductor device with a second configuration in accordance with the invention will be described, with reference to FIG. 2.

Figure 2:
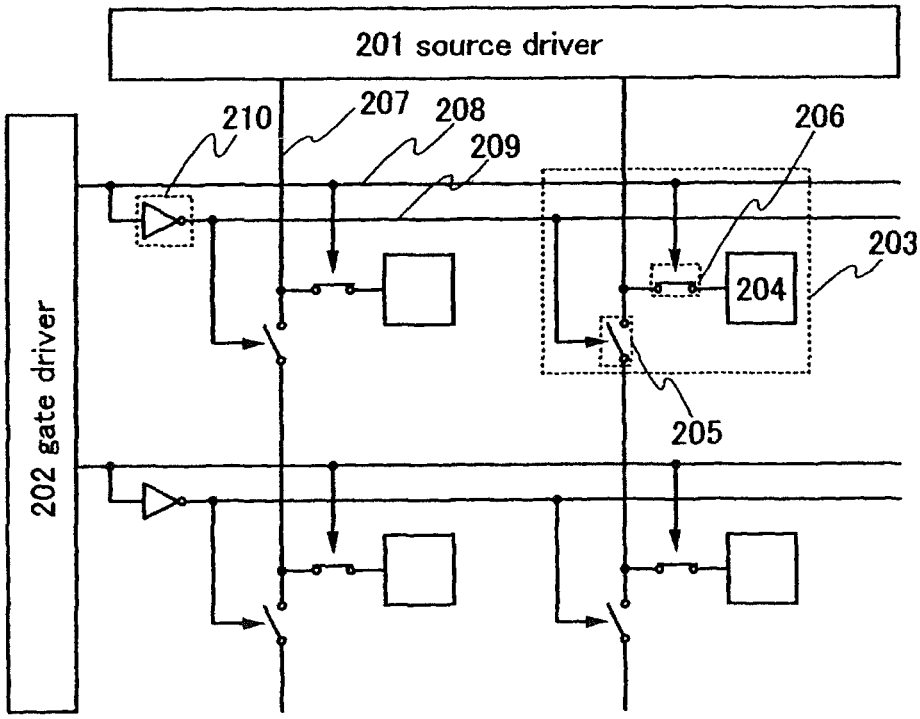
FIG. 2 shows a semiconductor device of the invention according to Embodiment Mode 2.

In FIG. 2, a plurality of pixels 203 are arranged in matrix of rows and columns. A source driver 201 is a circuit for outputting a video signal in response to a control signal input. The source driver 201 inputs a video signal into a pixel 203 which is selected to be written with a video signal, through a source signal line 207. A gate driver 202 scans a gate signal line 209 through a gate signal line 208 and an inverter 210, in response to a control signal input to the gate driver 202, so that a potential obtained by inverting the potential of the gate signal line 208 is output to the gate signal line 209, thereby selecting a pixel to be written with a video signal.

The pixel 203 includes a light-emitting unit 204 including a light-emitting element and a circuit for controlling the light-emitting element, a switch 206 which is turned on or off by the gate signal line 208, and a switch 205 which is turned on or off by the gate signal line 209. These two switches operate in such a manner that the switch 206 is off when the switch 205 is on, and vice versa, the switch 206 is on when the switch 205 is off.

Next, description is made of an operation of writing a video signal into the pixel 203 from the source driver 201 through the source signal line 207. In this case, the switch 205 is in off state and the switch 206 is in on state in the pixel 203 to be written with a video signal. Then, a video signal is written into the light-emitting unit 204 from the source driver 201 through the source signal line 207.

Next, description is made of an operation of writing no video signal into the pixel 203. In this case, the switch 205 is on and the switch 206 is off in the pixel 203 to be written with no video signal. Therefore, a video signal is not written into the light-emitting unit 204 from the source driver 201 through the source signal line 207.

In this embodiment mode, the switches 205 and 206 can be operated in such a manner that one of them is in on state while the other is in off state even when both of the switches 205 and 206 have the same characteristics, by controlling the switches 205 and 206 with signals which are inverted from each other.

In addition, the connection relation of the gate signal lines 208 and 209 with the switches 205 and 206 may be designed opposite. That is, on/off of the switch 205 may be controlled by the gate signal line 208, while on/off of the switch 206 may be controlled by the gate signal line 209.

A video signal output from the source driver 201 may be either a voltage signal or a current signal. In addition, an internal configuration of the pixel is not specifically limited as long as a video signal can be input to the pixel. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current. In addition, another power supply line and a signal line may be added according to need or the like. In such a case, the power supply line may supply either a voltage or a current, and the signal line may be controlled with either a voltage or a current.

In this embodiment mode, the parasitic capacitance of the source signal line 207 affects only the pixels 203 between an output side of the source driver 201 up to and including the pixel 203 selected to be written with a video signal, by turning off the switch 205 provided in the pixel 203 selected to be written with a video signal. Therefore, the power consumption can be suppressed, which would otherwise be increased due to the charging and discharging of the source signal line 207.

In addition, since the parasitic capacitance of the source signal line 207 affects only the pixels 203 between the output side of the source driver 201 up to and including the pixel 203 selected to be written with a video signal, a writing period of a video signal into the pixel 203 can be shortened. This is a great advantage in the case of operating the pixel with a current input.

In this manner, according to this embodiment mode, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 3

A semiconductor device with a third configuration in accordance with the invention will be described, with reference to FIG. 3.

Figure 3:
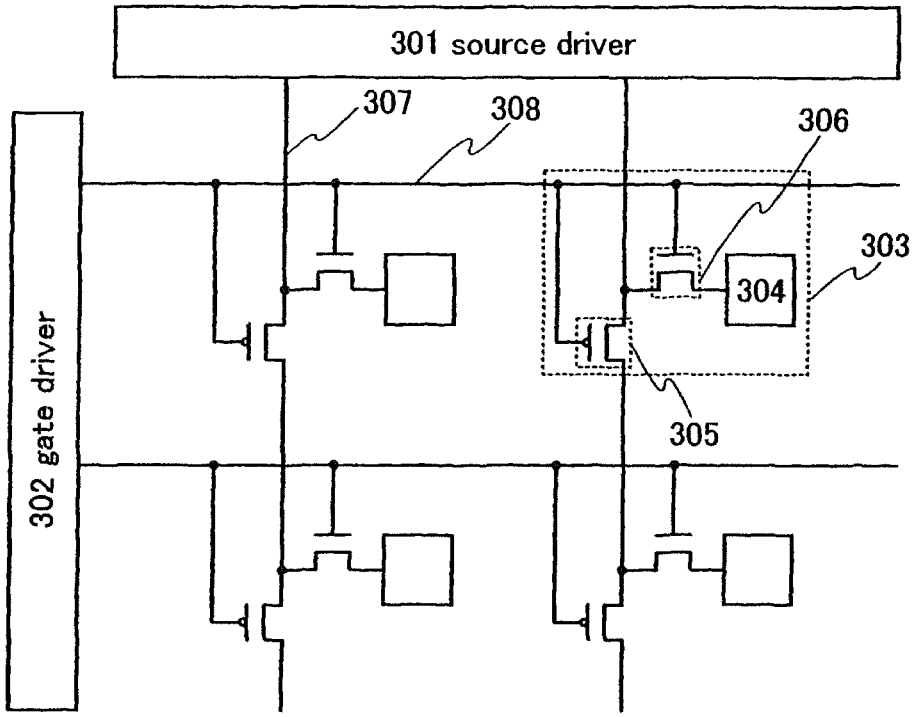
FIG. 3 shows a semiconductor device of the invention according to Embodiment Mode 3.

In FIG. 3, a plurality of pixels 303 are arranged in matrix of rows and columns. A source driver 301 is a circuit for outputting a video signal in response to a control signal input. The source driver 301 inputs a video signal into a pixel 303 which is selected to be written with a video signal, through a source signal line 307. A gate driver 302 scans a gate signal line 308 in response to a control signal input to the gate driver 302, thereby selecting a pixel to be written with a video signal.

The pixel 303 includes a light-emitting unit 304 including a light-emitting element and a circuit for controlling the light-emitting element, a TFT 305, and a TFT 306. The TFT 305 is connected in series with the source signal line 307, and the TFT 306 is disposed such that one of either a source or a drain thereof is connected to the TFT 305, while the other is connected to the light-emitting unit 304. Gates of the TFTs 305 and 306 are connected to the gate signal line 308, and thus the gate signal line 308 selects on/off of these TFTs. In FIG. 3, the TFT 305 is a p-channel TFT and the TFT 306 is an n-channel TFT; therefore, the TFT 306 is off when the TFT 305 is on, while the TFT 306 is on when the TFT 305 is off. These TFTs operate in such a manner that the TFT 305 is off and the TFT 306 is on at the time when the gate signal line 308 selects the pixel 303.

The TFTs 305 and 306 are only required to have opposite polarity (conductivity type). For example, when the TFT 305 is an n-channel TFT, the TFT 306 may be a p-channel TFT. Meanwhile, when the TFT 305 is a p-channel TFT, the TFT 306 may be an n-channel TFT.

Description is made of an operation of writing a video signal into the pixel 303 from the source driver 301 through the source signal line 307. In this case, the TFT 305 is in off state and the TFT 306 is in on state in the pixel 303 to be written with a video signal. Then, a video signal is written into the light-emitting unit 304 from the source driver 301 through the source signal line 307.

Next, description is made of an operation of writing no video signal into the pixel 303. In this case, the TFT 305 is on and the TFT 306 is off in the pixel 303 to be written with no video signal. Therefore, a video signal is not written into the light-emitting unit 304 from the source driver 301 through the source signal line 307.

A video signal output from the source driver in this embodiment mode may be either a voltage signal or a current signal. In addition, any pixel configuration with which a video signal can be input to a pixel may be employed. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current or the like.

Further, another power supply line and a signal line may be added according to need. In such a case, the power supply line may supply either a voltage or a current, and the signal line may be controlled with either a voltage or a current.

In this embodiment mode, the parasitic capacitance of the source signal line 307 affects only the pixels 303 between an output side of the source driver 301 up to and including the pixel 303 selected to be written with a video signal, by turning off the TFT 305 provided in the pixel 303 selected to be written with a video signal. Therefore, the power consumption can be suppressed, which would otherwise be increased due to the charging and discharging of the source signal line 307.

In addition, since the parasitic capacitance of the source signal line 307 affects only the pixels 303 between the output side of the source driver 301 up to and including the pixel 303 selected to be written with a video signal, a writing period of a video signal into the pixel 303 can be shortened. This is a great advantage in the case of operating the pixel 303 with a current input.

In this manner, according to this embodiment mode, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 4

A semiconductor device with a fourth configuration in accordance with the invention will be described, with reference to FIG. 4.

Figure 4:
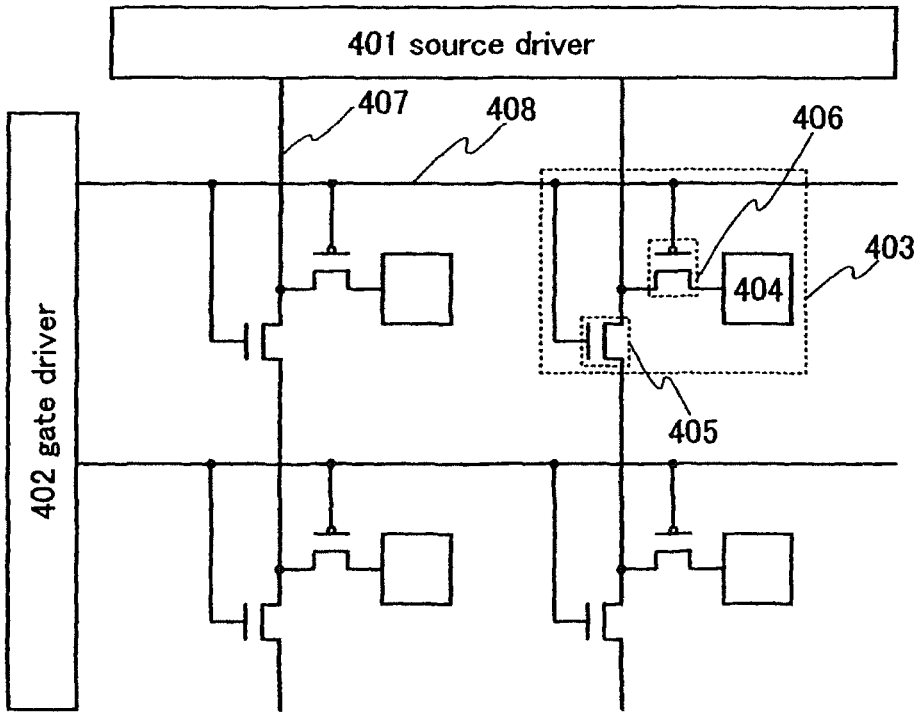
FIG. 4 shows a semiconductor device of the invention according to Embodiment Mode 4.

In FIG. 4, a plurality of pixels 403 are arranged in matrix of rows and columns. A source driver 401 is a circuit for outputting a video signal in response to a control signal input. The source driver 401 inputs a video signal into a pixel 403 which is selected to be written with a video signal, through a source signal line 407. A gate driver 402 scans a gate signal line 408 in response to a control signal input to the gate driver 402, thereby selecting a pixel to be written with a video signal.

The pixel 403 includes a light-emitting unit 404 including a light-emitting element and a circuit for controlling the light-emitting element, a TFT 405, and a TFT 406. The TFT 405 is connected in series with the source signal line 407, and the TFT 406 is disposed such that one of either a source or a drain thereof is connected to the TFT 405, while the other is connected to the light-emitting unit 404. Gates of the TFTs 405 and 406 are connected to the gate signal line 408, and thus the gate signal line 408 selects on/off of these TFTs. Since the TFT 405 is an n-channel TFT and the TFT 406 is a p-channel TFT, the TFT 406 is off when the TFT 405 is on, while the TFT 406 is on when the TFT 405 is off. These TFTs operate in such a manner that the TFT 405 is off and the TFT 406 is on at the time when the gate signal line 408 selects the pixel 403.

The TFTs 405 and 406 are only required to have opposite polarity (conductivity type). For example, when the TFT 405 is a p-channel TFT, the TFT 406 may be an n-channel TFT.

Description is made of an operation of writing a video signal into the pixel 403 from the source driver 401 through the source signal line 407. In this case, the TFT 405 is in off state and the TFT 406 is in on state in the pixel 403 to be written with a video signal. Then, a video signal is written into the light-emitting unit 404 from the source driver 401 through the source signal line 407.

Next, description is made of an operation of writing no video signal into the pixel 403. In this case, the TFT 405 is on and the TFT 406 is off in the pixel 403 to be written with no video signal. Therefore, a video signal is not written into the light-emitting unit 404 from the source driver 401 through the source signal line 407.

A video signal output from the source driver in this embodiment mode may be either a voltage signal or a current signal. In addition, any pixel configuration with which a video signal can be input to a pixel may be employed. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current or the like.

Further, another power supply line and a signal line may be added according to need. In such a case, the power supply line may supply either a voltage or a current, and the signal line may be controlled with either a voltage or a current.

In this embodiment mode, the parasitic capacitance of the source signal line 407 affects only the pixels 403 between an output side of the source driver 401 up to and including the pixel 403 selected to be written with a video signal, by turning off the TFT 405 provided in the pixel 403 selected to be written with a video signal. Therefore, the power consumption can be suppressed, which would otherwise be increased due to the charging and discharging of the source signal line 407.

In addition, since the parasitic capacitance of the source signal line 407 affects only the pixels 403 between the output side of the source driver 401 up to and including the pixel 403 selected to be written with a video signal, a writing period of a video signal into the pixel 403 can be shortened.

This is a great advantage in the case of operating the pixel 403 with a current input.

Embodiment Mode 5

A semiconductor device with a fifth configuration in accordance with the invention will be described, with reference to FIG. 5.

Figure 5:
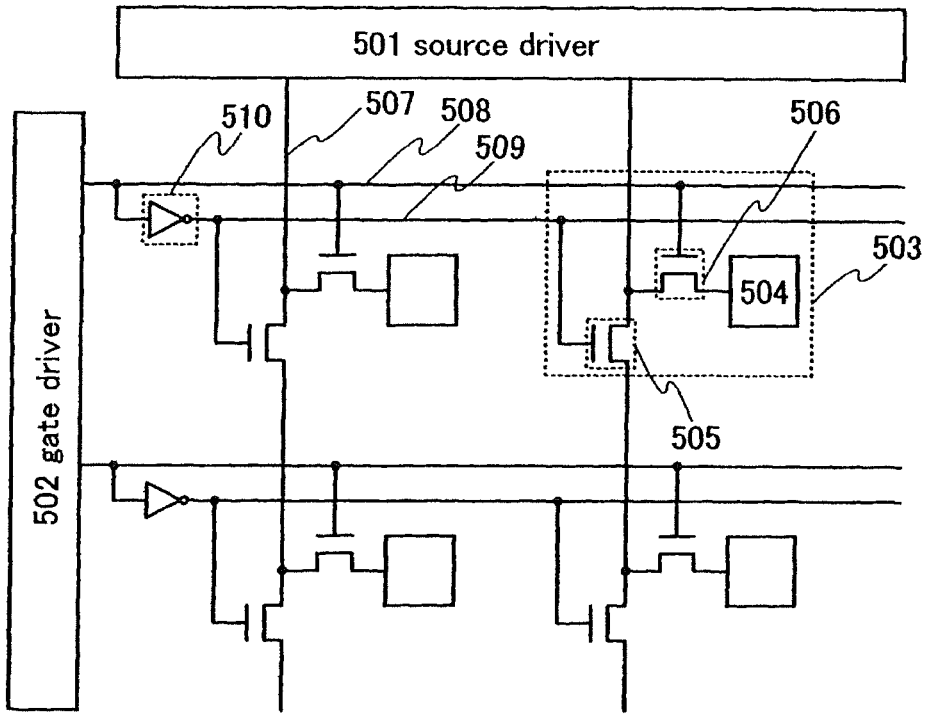
FIG. 5 shows a semiconductor device of the invention according to Embodiment Mode 5.

In FIG. 5, a plurality of pixels 503 are arranged in matrix of rows and columns. A source driver 501 is a circuit for outputting a video signal in response to a control signal input. The source driver 501 inputs a video signal into a pixel 503 which is selected to be written with a video signal, through a source signal line 507. A gate driver 502 scans a gate signal line 509 through a gate signal line 508 and an inverter 510, in response to a control signal input to the gate driver 502, so that a potential obtained by inverting the potential of the gate signal line 508 is output to the gate signal line 509, thereby selecting a pixel to be written with a video signal.

The pixel 503 includes a light-emitting unit 504 including a light-emitting element and a circuit for controlling the light-emitting element, a TFT 505, and a TFT 506. The TFT 505 is connected in series with the source signal line 507, and the TFT 506 is disposed such that one of either a source or a drain thereof is connected to the TFT 505, while the other is connected to the light-emitting unit 504. Gates of the TFTs 505 and 506 are connected to the gate signal lines 509 and 508 respectively, and thus the gate signal line 509 selects on/off of the TFT 505, and the gate signal line 508 selects on/off of the TFT 506. Since both of the TFTs 505 and 506 are n-channel TFTs, these TFTs operate in such a manner that one of them is on while the other is off.

The TFTs 505 and 506 are only required to have the same polarity (conductivity type). For example, both of the TFTs 505 and 506 may be p-channel TFTs.

Next, description is made of an operation of writing a video signal into the pixel 503 from the source driver 501 through the source signal line 507. In this case, the TFT 505 is in off state and the TFT 506 is in on state in the pixel 503 to be written with a video signal. Then, a video signal is written into the light-emitting unit 504 from the source driver 501 through the source signal line 507.

Next, description is made of an operation of writing no video signal into the pixel 503. In this case, the TFT 505 is on and the TFT 506 is off in the pixel 503 to be written with no video signal. Therefore, a video signal is not written into the light-emitting unit 504 from the source driver 501 through the source signal line 507.

A video signal output from the source driver in this embodiment mode may be either a voltage signal or a current signal. In addition, any pixel configuration with which a video signal can be input to a pixel may be employed. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current or the like.

In addition, another power supply line and a signal line may be added according to need. In such a case, the power supply line may supply either a voltage or a current, and the signal line may be controlled with either a voltage or a current.

In this embodiment mode, the parasitic capacitance of the source signal line 507 affects only the pixels 503 between an output side of the source driver 501 up to and including the pixel 503 selected to be written with a video signal, by turning off the TFT 505 provided in the pixel 503 selected to be written with a video signal. Therefore, the power consumption can be suppressed, which would otherwise be increased due to the charging and discharging of the source signal line 507.

In addition, since the parasitic capacitance of the source signal line 507 affects only the pixels 503 between the output side of the source driver 501 up to and including the pixel 503 selected to be written with a video signal, a writing period of a video signal into the pixel 503 can be shortened. This is a great advantage in the case of operating the pixel 503 with a current input.

In this manner, according to this embodiment mode, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 6

A semiconductor device with a sixth configuration in accordance with the invention will be described, with reference to FIG. 6.

Figure 6:
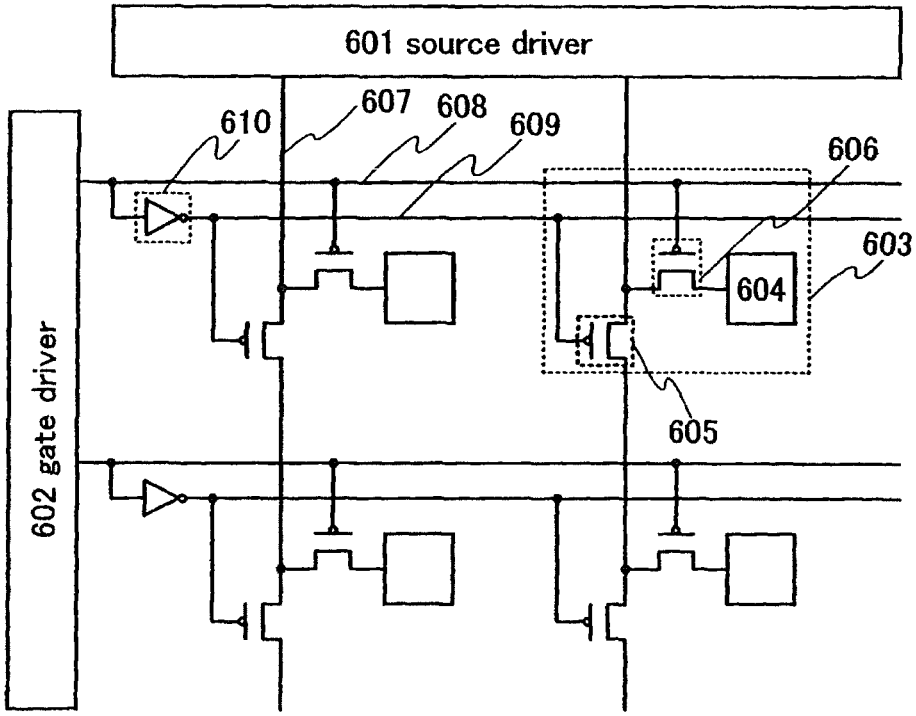
FIG. 6 shows a semiconductor device of the invention according to Embodiment Mode 6.

In FIG. 6, a plurality of pixels 603 are arranged in matrix of rows and columns. A source driver 601 is a circuit for outputting a video signal in response to a control signal input. The source driver 601 inputs a video signal into a pixel 603 which is selected to be written with a video signal, through a source signal line 607. A gate driver 602 scans a gate signal line 609 through a gate signal line 608 and an inverter 610, in response to a control signal input to the gate driver 602, so that a potential obtained by inverting the potential of the gate signal line 608 is output to the gate signal line 609, thereby selecting a pixel to be written with a video signal.

The pixel 603 includes a light-emitting unit 604 including a light-emitting element and a circuit for controlling the light-emitting element, a TFT 605, and a TFT 606. The TFT 605 is connected in series with the source signal line 607, and the TFT 606 is disposed such that one of either a source or a drain thereof is connected to the TFT 605, while the other is connected to the light-emitting unit 604. Gates of the TFTs 605 and 606 are connected to the gate signal lines 609 and 608 respectively, and thus the gate signal line 609 selects on/off of the TFT 605, and the gate signal line 608 selects on/off of the TFT 606. Since both of the TFTs 605 and 606 are p-channel TFTs, these TFTs operate in such a manner that one of them is on while the other is off.

The TFTs 605 and 606 are only required to have the same polarity (conductivity type). For example, both of the TFTs 605 and 606 may be n-channel TFTs.

Next, description is made of an operation of writing a video signal into the pixel 603 from the source driver 601 through the source signal line 607. In this case, the TFT 605 is in off state and the TFT 606 is in on state in the pixel 603 to be written with a video signal. Then, a video signal is written into the light-emitting unit 604 from the source driver 601 through the source signal line 607.

Next, description is made of an operation of writing no video signal into the pixel 603. In this case, the TFT 605 is on and the TFT 606 is off in the pixel 603 to be written with no video signal. Therefore, a video signal is not written into the light-emitting unit 604 from the source driver 601 through the source signal line 607.

A video signal output from the source driver in this embodiment mode may be either a voltage signal or a current signal. In addition, any pixel configuration with which a video signal can be input to a pixel may be employed. For example, the pixel may include a circuit for compensating the threshold voltage of a driving transistor, a circuit for determining light emission or non-light emission of a light-emitting element in order to obtain a crisp image, an erasing transistor for turning off a driving transistor which is used for performing a time division gray scale method, and the like. A signal line for controlling such a transistor or circuit may be added as well. Further, the pixel may include a power supply line for precharging the pixel with a voltage in the case of inputting a video signal to the pixel with a current.

The configuration of the light-emitting unit is not specifically limited to those described in Embodiment Modes 1 to 6. In addition, as has been already described, a video signal output from the source driver may either a voltage or a current. In either case, it is only required that a pixel operate with an input of a video signal.

In addition, a power supply line and a signal line may be added according to need. In such a case, the power supply line may supply either a voltage or a current, and the signal line may be controlled with either a voltage or a current.

In this embodiment mode, the parasitic capacitance of the source signal line 607 affects only the pixels 603 between an output side of the source driver 601 up to and including the pixel 603 selected to be written with a video signal, by turning off the TFT 605 provided in the pixel 603 selected to be written with a video signal. Therefore, the power consumption can be suppressed, which would otherwise be increased due to the charging and discharging of the source signal line 607.

In addition, since the parasitic capacitance of the source signal line 607 affects only the pixels 603 between the output side of the source driver 601 up to and including the pixel 603 selected to be written with a video signal, a writing period of a video signal into the pixel 603 can be shortened. This is a great advantage in the case of operating the pixel 603 with a current input.

In this manner, according to this embodiment mode, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 7

Description will be made of an exemplary configuration of a light-emitting unit applicable to Embodiment Modes 1 to 6, with reference to FIG. 7.

Figure 7:
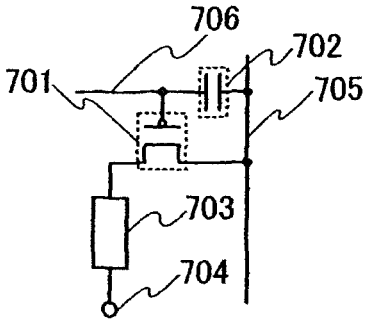
FIG. 7 shows a pixel in a semiconductor device of the invention according to Embodiment Mode 7.

In FIG. 7, a TFT 701 is a p-channel transistor, a capacitor 702 is a capacitor having a pair of electrodes, a light-emitting element 703 is a light-emitting element having a pair of electrodes, and a counter electrode 704 is an electrode of the light-emitting element 703. A power supply line 705 is a power supply line for supplying power to one of the electrodes of the light-emitting element 703 through the TFT 701, and a signal input line 706 is a signal line for inputting video signals into the light-emitting unit. The light-emitting unit of this Embodiment Mode has the light-emitting element 703 and a light-emission control circuit for controlling a light-emitting state of the light-emitting element 703 in accordance with a video signal.

The power supply line 705 is connected to one of either a source or a drain of the TFT 701, the other of either the source or the drain of the TFT 701 is connected to one of the electrodes of the light-emitting element 703, and a gate of the TFT 701 is connected to the signal input line 706 and one of the electrodes of the capacitor 702. The other electrode of the capacitor 702 is connected to the power supply line 705.

The power supply line 705 is set at a potential which is higher than the counter electrode 704, and the signal input line 706 inputs a video signal into the light-emitting unit when it is selected to be written with a video signal.

Next, description is made of an operation of writing a video signal into the light-emitting unit. A video signal input from the signal input line 706 is once held in the capacitor 702. Thus, the amount of a current to flow into the light-emitting element 703 and the luminance thereof are determined by the relationship among the potential held in the capacitor 702, a potential of the power supply line 705, and a potential of one of the electrodes of the light-emitting element 703. That is, the amount of a current to flow into the light-emitting element 703 and the luminance thereof are determined by a source-gate potential and a source-drain potential of the TFT 701. In addition, in the case of performing a time gray scale method by which gray scales (luminance) are expressed with light-emitting time, the TFT 701 may be operated as a switch, so that gray scales (luminance) are expressed by controlling on/off of the TFT 701 with a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 8

Description will be made of an exemplary configuration of a light-emitting unit applicable to Embodiment Modes 1 to 6, with reference to FIG. 8.

Figure 8:
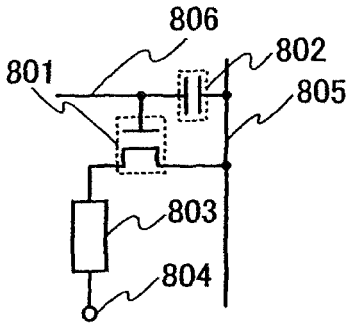
FIG. 8 shows a pixel in a semiconductor device of the invention according to Embodiment Mode 8.

In FIG. 8, a TFT 801 is an n-channel transistor, a capacitor 802 is a capacitor having a pair of electrodes, a light-emitting element 803 is a light-emitting element having a pair of electrodes, and a counter electrode 804 is an electrode of the light-emitting element 803. A power supply line 805 is a power supply line for supplying power to one of the electrodes of the light-emitting element 803, and a signal input line 806 is a signal line for inputting video signals to the light-emitting unit. The light-emitting unit of this Embodiment Mode has the light-emitting element 803 and a light-emission control circuit for controlling a light-emitting state of the light-emitting element 803 in accordance with a video signal.

The power supply line 805 is connected to one of either a source or a drain of the TFT 801, the other of either the source or the drain of the TFT 801 is connected to one of the electrodes of the light-emitting element 803, and a gate of the TFT 801 is connected to the signal input line 806 and one of the electrodes of the capacitor 802. The other electrode of the capacitor 802 is connected to the power supply line 805.

The power supply line 805 is set at a potential which is higher than the counter electrode 804, and the signal input line 806 inputs a video signal into the light-emitting unit when it is selected to be written with a video signal.

Next, description is made of an operation of writing a video signal into the light-emitting unit. A video signal input from the signal input line 806 is once held in the capacitor 802. Thus, the amount of a current to flow into the light-emitting element 803 and the luminance thereof are determined by the relationship among the potential held in the capacitor 802, a potential of the power supply line 805, and a potential of one of the electrodes of the light-emitting element 803. That is, the amount of a current to flow into the light-emitting element 803 and the luminance thereof are determined by a source-gate potential and a source-drain potential of the TFT 801. In addition, in the case of performing a time gray scale method by which gray scales (luminance) are expressed with light-emitting time, the TFT 801 may be operated as a switch, so that gray scales (luminance) are expressed by controlling on/off of the TFT 801 with a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 9

Description will be made of an exemplary configuration of a light-emitting unit applicable to Embodiment Modes 1 to 6, with reference to FIG. 9.

Figure 9:
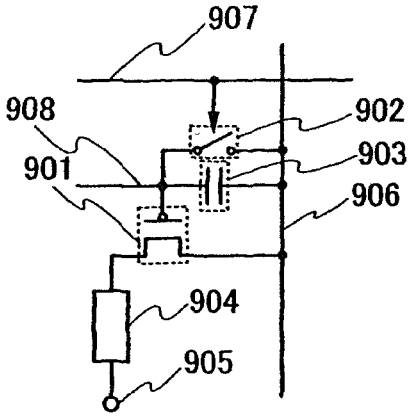
FIG. 9 shows a pixel in a semiconductor device of the invention according to Embodiment Mode 9.

In FIG. 9, a TFT 901 is a p-channel transistor, a switch 902 is a switch, on/off of which is controlled by a gate signal line 907, a capacitor 903 is a capacitor having a pair of electrodes, a light-emitting element 904 is a light-emitting element having a pair of electrodes, and a counter electrode 905 is the opposite electrode of the light-emitting element 904. A power supply line 906 is a power supply line for supplying power to one of the electrodes of the light-emitting element 904 through the TFT 901, and a signal input line 908 is a signal line for inputting video signals into the light-emitting unit. The light-emitting unit of this Embodiment Mode has the light-emitting element 904 and a light-emission control circuit for controlling a light-emitting state of the light-emitting element 904 in accordance with a video signal.

The power supply line 906 is connected to one of either a source or a drain of the TFT 901, the other of either the source or the drain of the TFT 901 is connected to one of the electrodes of the light-emitting element 904, and a gate of the TFT 901 is connected to the signal input line 908, one of the electrodes of the capacitor 903, and one of terminals of the switch 902. The other electrode of the capacitor 903 is connected to the power supply line 906. On/off of the TFT 901 is controlled by the gate signal line 907.

The power supply line 906 is set at a potential which is higher than the counter electrode 905, and the signal input line 908 inputs a video signal into the light-emitting unit when it is selected to be written with a video signal.

Next, description is made of an example of a drive in the case of expressing gray scales (luminance) by using a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, a video signal which has a binary value of H-level and L-level potentials is input from the signal input line 908, and then held in the capacitor 903. At this time, on/off of the TFT 901 which operates as a switch is controlled by the potential held in the capacitor 903. That is, the light-emitting time of the light-emitting element 904 is controlled. At this time, the switch 902 is off.

The erasing period is described next. In the erasing period, the switch 902 is in on state, and a potential of the power supply line 906 is held in the capacitor 903. Accordingly, a gate-source potential of the TFT 901 is drawn to around 0 V, and thus the TFT 901 can be turned off. That is, the light-emitting element 904 can be controlled to emit no light regardless of a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 10

Description will be made of an exemplary configuration of a light-emitting unit applicable to Embodiment Modes 1 to 6, with reference to FIG. 10.

Figure 10:
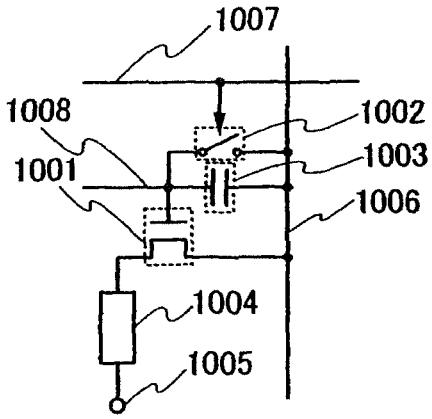
FIG. 10 shows a pixel in a semiconductor device of the invention according to Embodiment Mode 10.

In FIG. 10, a switch 1002 is an n-channel transistor, on/off of which is controlled by a gate signal line 1007. A capacitor 1003 is a capacitor having a pair of electrodes, a light-emitting element 1004 is a light-emitting element having a pair of electrodes, and a counter electrode 1005 is an electrode of the light-emitting element 1004. A power supply line 1006 is a power supply line for supplying power to one of the electrodes of the light-emitting element 1004 through the TFT 1001, the gate signal line 1007 is a gate signal line for selecting whether to allow video signals to be written into the light-emitting unit or not, and a signal input line 1008 is a signal line for inputting video signals into the light-emitting unit. The light-emitting unit of this Embodiment Mode has the light-emitting element 1004 and a light-emission control circuit for controlling a light-emitting state of the light-emitting element 1004 in accordance with a video signal.

The power supply line 1006 is connected to one of either a source or a drain of the TFT 1001, the other of either the source or the drain of the TFT 1001 is connected to one of the electrodes of the light-emitting element 1004, and a gate of the TFT 1001 is connected to the signal input line 1008, one of the electrodes of the capacitor 1003, and one of terminals of the switch 1002. The other electrode of the capacitor 1003 is connected to the power supply line 1006. On/off of the TFT 1001 is controlled by the gate signal line 1007.

The power supply line 1006 is set at a potential which is lower than the counter electrode 1005, and the signal input line 1008 inputs a video signal into the light-emitting unit when it is selected to be written with a video signal.

Next, description is made of an example of a drive in the case of expressing gray scales (luminance) by using a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, a video signal which has a binary value of H-level and L-level potentials is input from the signal input line 1008, and then held in the capacitor 1003. At this time, on/off of the TFT 1001 which operates as a switch is controlled by the potential held in the capacitor 1003. That is, the light-emitting time of the light-emitting element 1004 is controlled. At this time, the switch 1002 is off.

The erasing period is described next. In the erasing period, the switch 1002 is in on state, and a potential of the power supply line 1006 is held in the capacitor 1003. Accordingly, a gate-source potential of the TFT 1001 is drawn to around 0 V, and thus the TFT 1001 can be turned off. That is, the light-emitting element 1004 can be controlled to emit no light regardless of a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 11

Description will be made of an exemplary configuration of a light-emitting unit applicable to Embodiment Modes 1 to 6, with reference to FIG. 11.

Figure 11:
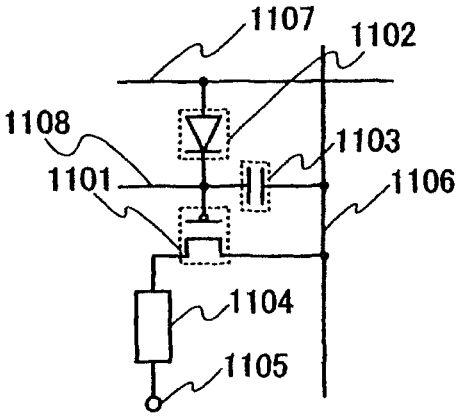
FIG. 11 shows a pixel in a semiconductor device of the invention according to Embodiment Mode 11.

In FIG. 11, a TFT 1101 is a p-channel transistor, and a diode 1102 is a diode having an input connected to a gate signal line 1107 and an output connected to a gate of the TFT 1101. A capacitor 1103 is a capacitor having a pair of electrodes, a light-emitting element 1104 is a light-emitting element having a pair of electrodes, and a counter electrode 1105 is an electrode of the light-emitting element 1104. A power supply line 1106 is a power supply line for supplying power to one of the electrodes of the light-emitting element 1104 through the TFT 1101, the gate signal line 1107 is a gate signal line for selecting whether to allow video signals to be written into the light-emitting unit or not, and a signal input line 1108 is a signal line for inputting video signals into the light-emitting unit. The light-emitting unit of this Embodiment Mode has the light-emitting element 1104 and a light-emission control circuit for controlling a light-emitting state of the light-emitting element 1104 in accordance with a video signal.

The power supply line 1106 is connected to one of either a source or a drain of the TFT 1101, the other of either the source or the drain of the TFT 1101 is connected to one of the electrodes of the light-emitting element 1104, and a gate of the TFT 1101 is connected to the signal input line 1108, one of the electrodes of the capacitor 1103, and the output of the diode 1102. The other electrode of the capacitor 1103 is connected to the power supply line 1106. The input of the diode 1102 is connected to the gate signal line 1107.

The power supply line 1106 is set at a potential which is higher than the counter electrode 1105, and the signal input line 1108 inputs a video signal into the light-emitting unit when it is selected to be written with a video signal.

Next, description is made of an example of a drive in the case of expressing gray scales (luminance) by using a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, a video signal which has a binary value of H-level and L-level potentials is input from the signal input line 1108, and then held in the capacitor 1103. At this time, on/off of the TFT 1101 which operates as a switch is controlled by the potential held in the capacitor 1103. That is, the light-emitting time of the light-emitting element 1104 is controlled. At this time, since the gate signal line 1107 is set at a potential which is lower than the potential held in the capacitor 1103, it does not affect a potential of the video signal.

The erasing period is described next. In the erasing period, a potential of the gate signal line 1107 is set to have a level which turns off the TFT 1101. By setting the potential of the gate signal line 1107 to be equal to or higher than that of the power supply line 1106, the potential of the gate signal line 1107 is held in the capacitor 1103. Accordingly, a gate-source potential of the TFT 1101 is drawn to around 0 V or higher than that, and thus the TFT 1101 can be turned off. That is, the light-emitting element 1104 can be controlled to emit no light regardless of a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 12

Description will be made of an exemplary configuration of a light-emitting unit applicable to Embodiment Modes 1 to 6, with reference to FIG. 12.

Figure 12:
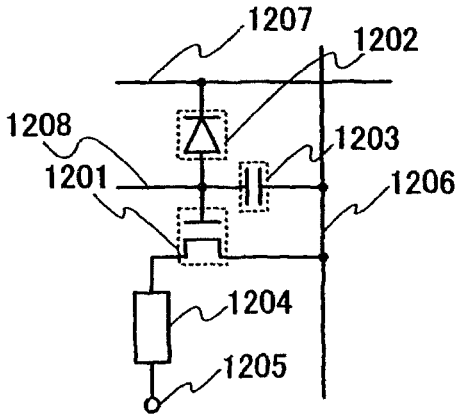
FIG. 12 shows a pixel in a semiconductor device of the invention according to Embodiment Mode 12.

In FIG. 12, a TFT 1201 is an n-channel transistor, and a diode 1202 is a diode having an input connected to a gate of the TFT 1201 and an output connected to a gate signal line 1207. A capacitor 1203 is a capacitor having a pair of electrodes, a light-emitting element 1204 is a light-emitting element having a pair of electrodes, and a counter electrode 1205 is an electrode of the light-emitting element 1204. A power supply line 1206 is a power supply line for supplying power to one of the electrodes of the light-emitting element 1204 through the TFT 1201, the gate signal line 1207 is a gate signal line for selecting whether to allow video signals to be written into the light-emitting unit or not, and a signal input line 1208 is a signal line for inputting video signals into the light-emitting unit. The light-emitting unit of this Embodiment Mode has the light-emitting element 1204 and a light-emission control circuit for controlling a light-emitting state of the light-emitting element 1204 in accordance with a video signal.

The power supply line 1206 is connected to one of either a source or a drain of the TFT 1201, the other of either the source or the drain of the TFT 1201 is connected to one of the electrodes of the light-emitting element 1204, and a gate of the TFT 1201 is connected to the signal input line 1208, one of the electrodes of the capacitor 1203, and the input of the diode 1202. The other electrode of the capacitor 1203 is connected to the power supply line 1206. The output of the diode 1202 is connected to the gate signal line 1207.

The power supply line 1206 is set at a potential which is lower than the counter electrode 1205, and the signal input line 1208 inputs a video signal into the light-emitting unit when it is selected to be written with a video signal.

Next, description is made of an example of a drive in the case of expressing gray scales (luminance) by using a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, a video signal which has a binary value of H-level and L-level potentials is input from the signal input line 1208, and then held in the capacitor 1203. At this time, on/off of the TFT 1201 which operates as a switch is controlled by the potential held in the capacitor 1203. That is, the light-emitting time of the light-emitting element 1204 is controlled. At this time, since the gate signal line 1207 is set at a potential which is higher than the potential held in the capacitor 1203, it does not affect a potential of the video signal.

The erasing period is described next. In the erasing period, a potential of the gate signal line 1207 is set to have a level which turns off the TFT 1201. By setting the potential of the gate signal line 1207 to be equal to or higher than that of the power supply line 1206, the potential of the gate signal line 1207 is held in the capacitor 1203. Accordingly, a gate-source potential of the TFT 1201 is drawn to around 0 V or lower than that, and thus the TFT 1201 can be turned off. That is, the light-emitting element 1204 can be controlled to emit no light regardless of a video signal.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 13

Description will be made of an exemplary configuration of a light-emitting unit applicable to Embodiment Modes 1 to 6, with reference to FIG. 13.

Figure 13:
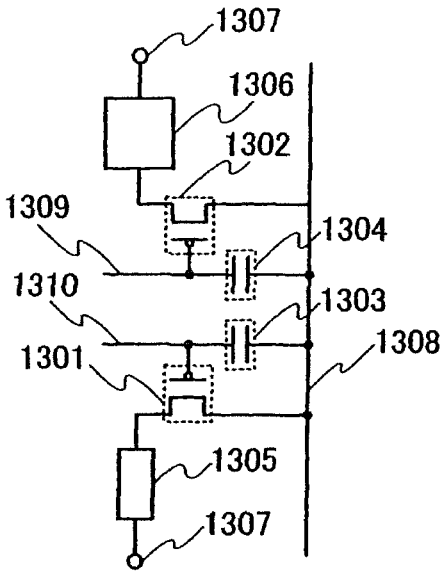
FIG. 13 shows a pixel in a semiconductor device of the invention according to Embodiment Mode 13.

In FIG. 13, TFTs 1301 and 1302 are p-channel transistors, and capacitors 1303 and 1304 are capacitors each having a pair of electrodes, light-emitting elements 1305 and 1306 are light-emitting elements each having a pair of electrodes, and a counter electrode 1307 is electrodes of the light-emitting elements 1305 and 1306. A power supply line 1308 is a power supply line for supplying power to the light-emitting elements 1305 and 1306 through the TFTs 1301 and the TFT 1302 respectively. Signal input lines 1309 and 1310 are signal lines for inputting video signals into the light-emitting unit. The light-emitting unit of this Embodiment Mode has the light-emitting element 1305 and a light-emission control circuit for controlling a light-emitting state of the light-emitting element 1305 in accordance with a video signal.

The power supply line 1308 is connected to one of either a source or a drain of the TFT 1301 and one of either a source or a drain of the TFT 1302. The other of either the source or the drain of the TFT 1301 is connected to one of the electrodes of the light-emitting element 1305, while the other of either the source or the drain of the TFT 1302 is connected to one of the electrodes of the light-emitting element 1306. A gate of the TFT 1301 is connected to the signal input line 1310 and one of the electrodes of the capacitor 1303, while a gate of the TFT 1302 is connected to the signal input line 1309 and one of the electrodes of the capacitor 1304. The other electrode of the capacitor 1303 and the other electrode of the capacitor 1304 are connected to the power supply line 1308.

The power supply line 1308 is set at a potential which is higher than the counter electrode 1307, and the signal input lines 1309 and 1310 input video signals into the light-emitting unit when it is selected to be written with a video signal.

Next, description is made of an example of a drive in the case of expressing gray scales (luminance) by using both an area gray scale method and a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, video signals each having a binary value of H-level and L-level potentials are input from the signal input lines 1309 and 1310, and then held in the capacitors 1304 and 1303 respectively. At this time, on/off of the TFTs 1301 and 1302 which operate as switches is controlled by the potentials held in the capacitors 1303 and 1304 respectively. That is, the light-emitting time of each of the light-emitting elements 1305 and 1306 is controlled.

The erasing period is described next. In the erasing period, L-level potentials of the video signals input from the signal input lines are held in the capacitors 1303 and 1304. Accordingly, a gate-source potential of each of the TFTs 1301 and 1302 is drawn to around 0 V or lower than that, and thus the TFTs 1301 and 1302 can be turned off. That is, the light-emitting elements 1305 and 1306 can be controlled to emit no light regardless of a video signal.

In addition, as has been described in Embodiment Mode 9, the light-emitting elements 1305 and 1306 can be controlled to emit no light by storing the potential of the power supply line 1308 in the capacitors 1303 and 1304. Alternatively, as has been described in Embodiment Mode 11, the light-emitting elements 1305 and 1306 can be controlled to emit no light by providing a diode having an input connected to a gate signal line and an output connected to the gates of the TFT 1301 and 1302, and by setting the gate signal line in the erasing period to have a potential level which turns off the TFTs 1301 and 1302.

In this embodiment mode, one pixel has the two light-emitting elements 1305 and 1306 having different light-emitting areas. Therefore, if the luminance of the light-emitting elements 1305 and 1306 is separately controlled, gray scales with a larger number (luminance with a higher level) can be expressed, than that can be expressed with the signal input lines 1309 and 1310.

In addition, although the description of a case of performing an area gray scale method by using two light-emitting elements has been made in this embodiment mode, the invention is not limited to this, and more than two light-emitting elements may be provided, such as three or four. In that case, gray scales that can be expressed can be increased, thereby the gray scales can be expressed more clearly.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 14

Description will be made of an exemplary configuration of a light-emitting unit applicable to Embodiment Modes 1 to 6, with reference to FIG. 14.

Figure 14:
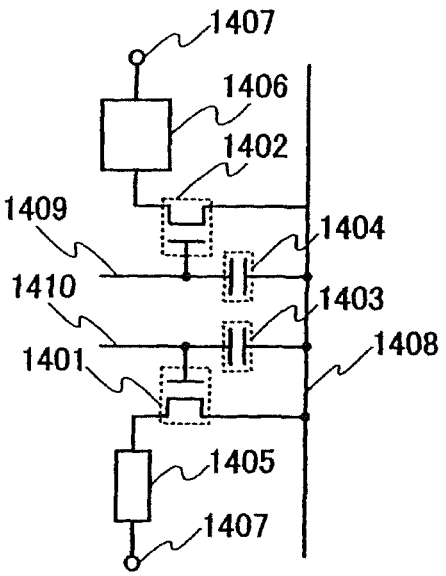
FIG. 14 shows a pixel in a semiconductor device of the invention according to Embodiment Mode 14.

In FIG. 14, TFTs 1401 and 1402 are n-channel transistors, capacitors 1403 and 1404 are capacitors each having a pair of electrodes, light-emitting elements 1405 and 1406 are light-emitting elements each having a pair of electrodes, and a counter electrode 1407 is electrodes of the light-emitting elements 1405 and 1406. A power supply line 1408 is a power supply line for supplying power to the light-emitting elements 1405 and 1406 through the TFTs 1401 and 1402 respectively. Signal input lines 1409 and 1410 are signal lines for inputting video signals into the light-emitting unit. The light-emitting unit of this Embodiment Mode has the light-emitting element 1405 and a light-emission control circuit for controlling a light-emitting state of the light-emitting element 1405 in accordance with a video signal.

The power supply line 1408 is connected to one of either a source or a drain of the TFT 1401 and one of either a source or a drain of the TFT 1402. The other of either the source or the drain of the TFT 1401 is connected to one of the electrodes of the light-emitting element 1405, while the other of either the source or the drain of the TFT 1402 is connected to one of the electrodes of the light-emitting element 1406. A gate of the TFT 1401 is connected to the signal input line 1410 and one of the electrodes of the capacitor 1403, while a gate of the TFT 1402 is connected to the signal input line 1409 and one of the electrodes of the capacitor 1404. The other electrode of the capacitor 1403 and the other electrode of the capacitor 1404 are connected to the power supply line 1408.

The power supply line 1408 is set at a potential which is lower than the counter electrode 1407, and the signal input lines 1409 and 1410 input video signals into the light-emitting unit when it is selected to be written with a video signal.

Next, description is made of an example of a drive in the case of expressing gray scales (luminance) by using both an area gray scale method and a time gray scale method. In this embodiment mode, description is made of a driving method where a writing period and an erasing period are separately provided. Note that the invention is not limited to this, and the luminance may be changed by changing a potential of a video signal, or a video signal may be input with a current.

The writing period is described first. In the writing period, video signals each having a binary value of H-level and L-level potentials are input from the signal input lines 1409 and 1410, and then held in the capacitors 1404 and 1403 respectively. At this time, on/off of the TFTs 1401 and 1402 which operate as switches is controlled by the potentials held in the capacitors 1403 and 1404 respectively. That is, the light-emitting time of each of the light-emitting elements 1405 and 1406 is controlled.

The erasing period is described next. In the erasing period, L-level potentials of the video signals input from the signal input lines are held in the capacitors 1403 and 1404. Accordingly, a gate-source potential of each of the TFTs 1401 and 1402 is drawn to around 0 V or lower than that, and thus the TFTs 1401 and 1402 can be turned off. That is, the light-emitting elements 1405 and 1406 can be controlled to emit no light regardless of a video signal.

In addition, as has been described in Embodiment Mode 9, the light-emitting elements 1405 and 1406 can be controlled to emit no light by storing the potential of the power supply line 1408 in the capacitors 1403 and 1404. Alternatively, as has been described in Embodiment Mode 11, the light-emitting elements 1405 and 1406 can be controlled to emit no light by providing diodes each having an input connected to a gate signal line and an output connected to the gates of the TFT 1401 or 1402, and by setting the gate signal line in the erasing period to have a potential level which turns off the TFTs 1401 and 1402.

In this embodiment mode, one pixel has the two light-emitting elements 1405 and 1406 having different light-emitting areas. Therefore, if the luminance of the light-emitting elements 1405 and 1406 is separately controlled, gray scales with a larger number (luminance with a higher level) can be expressed, than that can be expressed with the signal input lines 1409 and 1410.

In addition, although the description of a case of performing an area gray scale method by using two light-emitting elements has been made in this embodiment mode, the invention is not limited to this as long as the number of the light-emitting elements is more than one. With a larger number of light-emitting elements, gray scales that can be expressed can be increased, and thus the gray scales can be expressed more clearly.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 15

Description will be made of an exemplary configuration of a light-emitting unit applicable to Embodiment Modes 1 to 6, with reference to FIG. 15.

Figure 15:
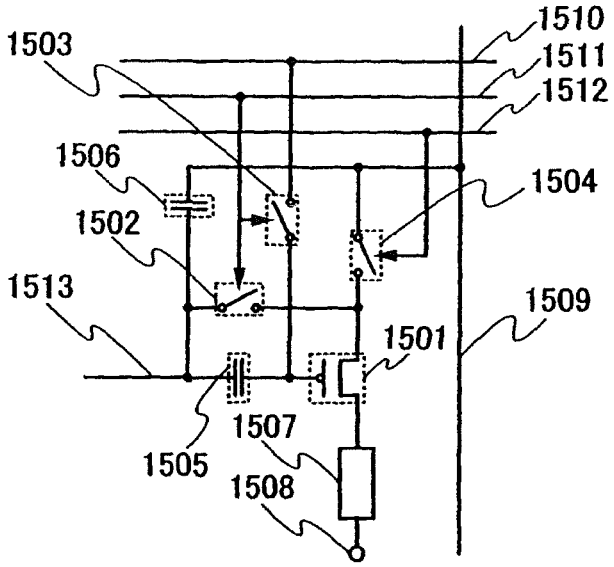
FIG. 15 shows a pixel in a semiconductor device of the invention according to Embodiment Mode 15.

In FIG. 15, a TFT 1501 is a p-channel transistor, switches 1502 and 1503 are switches, on/off of which is controlled by a gate signal line 1511, a switch 1504 is a switch, on/off of which is controlled by a gate signal line 1512, and capacitors 1505 and 1506 are capacitors each having a pair of electrodes. A light-emitting element 1507 is a light-emitting element having a pair of electrodes, a counter electrode 1508 is an electrode of the light-emitting element 1507, and a power supply line 1509 is a power supply line for supplying power to one of the electrodes of the light-emitting element 1507 through the switch 1504 and the TFT 1501. A power supply line 1510 is a power supply line for supplying a reference potential, the gate signal line 1511 is a signal line for controlling the switches 1502 and 1503, the gate signal line 1512 is a signal line for controlling the switch 1504, and a signal input line 1513 is a signal line for inputting video signals into the light-emitting unit. The light-emitting unit of this Embodiment Mode has the light-emitting element 1507 and a light-emission control circuit for controlling a light-emitting state of the light-emitting element 1507 in accordance with a video signal.

The power supply line 1509 is connected to one of terminals of the switch 1504 and one of the electrodes of the capacitor 1506. The other terminal of the switch 1504 is connected to one of either a source or a drain of the TFT 1501 and one of terminals of switch 1502. The other of either the source or the drain of the TFT 1501 is connected to one of the electrodes of the light-emitting element 1507, and a gate of the TFT 1501 is connected to one of the electrodes of the capacitor 1505 and one of terminals of the switch 1503. The other terminal of the switch 1503 is connected to the power supply line 1510. The other terminal of the switch 1502 is connected to the other electrode of the capacitor 1506, the other electrode of the capacitor 1505, and the signal input line 1513. On/off of the switches 1502 and 1503 is controlled by the gate signal line 1511, while on/off of the switch 1504 is controlled by the gate signal line 1512.

The power supply line 1509 is set at a potential which is higher than the counter electrode 1508, the power supply line 1510 is set at an arbitrary constant potential, and the signal input line 1513 inputs a video signal into the light-emitting unit when it is selected to be written with a video signal. In addition, the video signal is input with a voltage.

In this embodiment mode, the light-emitting unit is driven through a threshold voltage sampling period, a video signal writing period, and a light-emitting period; therefore, description is made below separately of the operation in each period.

Description is made of the operation in the threshold voltage sampling period in accordance with this embodiment mode. First, the switches 1502 and 1503 are set on and the switch 1504 is set off by supplying no video signal from the signal input line 1513. Then, one of the electrodes of the capacitor 1505 has a potential of the power supply line 1510, while the other electrode of the capacitor 1505 and the other electrode of the capacitor 1506 have a potential which corresponds to the sum of the potentials of the power supply line 1510 and the threshold voltage of the TFT 1501.

Next, description is made of the operation in the video signal writing period in accordance with this embodiment mode. First, a video signal is input from the signal input line 1513 to turn off the switches 1502, 1503 and 1504. Then, the other electrode of the capacitor 1505 has a potential input from the signal input line 1513, and one of the electrodes of the capacitor 1505 has a potential which is obtained by subtracting the threshold voltage of the TFT 1501 from the sum of the potentials of the power supply line 1510 and the video signal.

The operation in the light-emitting period in accordance with this embodiment mode is described. First, the switches 1502 and 1503 are set off and the switch 1504 is set on by supplying no video signal from the signal input line 1513. Therefore, a potential of one of the electrodes of the capacitor 1505 is held. Then, since the potential of one of the electrodes of the capacitor 1505 corresponds to the potential obtained by subtracting the threshold voltage of the TFT 1510 from the sum of the potentials of the power supply line 1510 and the video signal, a current corresponding to the gate-source potential of the TFT 1501 which is obtained by correcting variations of the threshold voltage of the TFT 1501 flows into the light-emitting element 1507. Accordingly, the light-emitting element 1507 can emit light.

Gray scales are expressed by controlling the current flowing into the light-emitting element 1507 by determining the gate-source potential of the TFT 1501 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 16

Description will be made of an exemplary configuration of a light-emitting unit applicable to Embodiment Modes 1 to 6, with reference to FIG. 16.

Figure 16:
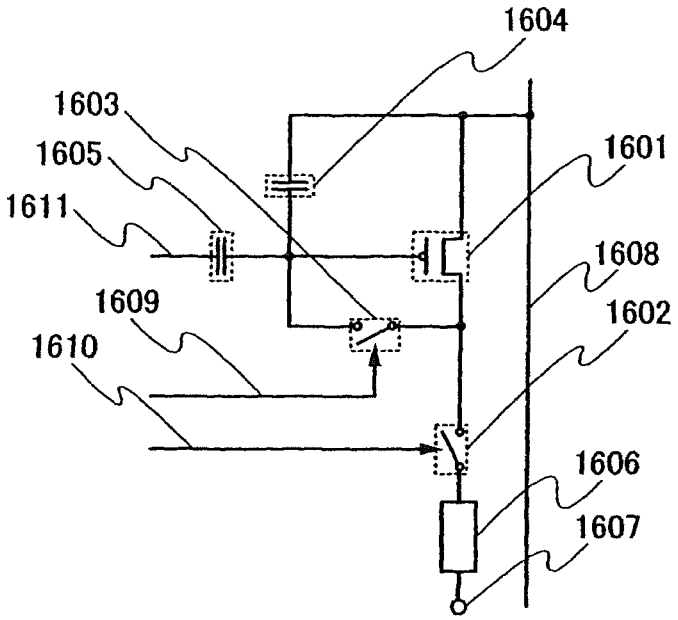
FIG. 16 shows a pixel in a semiconductor device of the invention according to Embodiment Mode 16.

In FIG. 16, a TFT 1601 is a p-channel transistor, a switch 1602 is a switch, on/off of which is controlled by a gate signal line 1610, and a switch 1603 is a switch, on/off of which is controlled by a gate signal line 1609. Capacitors 1604 and 1605 are capacitors each having a pair of electrodes. A light-emitting element 1606 is a light-emitting element having a pair of electrodes, a counter electrode 1607 is the opposite electrode of the light-emitting element 1606, and a power supply line 1608 is a power supply line for supplying power to one of the electrodes of the light-emitting element 1606 through the TFT 1601 and the switch 1602. A gate signal line 1609 is a signal line for controlling the switch 1603, the gate signal line 1610 is a signal line for controlling the switch 1602, and a signal input line 1611 is a signal line for inputting video signals into the light-emitting unit. The light-emitting unit of this Embodiment Mode has the light-emitting element 1606 and a light-emission control circuit for controlling a light-emitting state of the light-emitting element 16063 in accordance with a video signal.

The power supply line 1608 is connected to one of either a source or a drain of the TFT 1601 and one of the electrodes of the capacitor 1604. The other of either the source or the drain of the TFT 1601 is connected to one of terminals of the switch 1602 and one of terminals of the switch 1603. A gate of the TFT 1601 is connected to the other electrode of the capacitor 1604, one of the electrodes of the capacitor 1605, and the other terminal of the switch 1603. The other terminal of the switch 1602 is connected to one of the electrodes of the light-emitting element 1606. The other electrode of the capacitor 1605 is connected to the signal input line 1611. On/off of the switch 1602 is controlled by the gate signal line 1610, while on/off of the switch 1603 is controlled by the gate signal line 1609.

The power supply line 1608 is set at a potential which is higher than the counter electrode 1607, and the signal input line 1611 inputs a video signal into the light-emitting unit when it is selected to be written with a video signal. In addition, the video signal is input with a voltage.

In this embodiment mode, the light-emitting unit is driven through a threshold voltage sampling period, a video signal writing period, and a light-emitting period; therefore, description is made below separately of the operation in each period.

Description is made of the operation in the threshold voltage sampling period in accordance with this embodiment mode. First, the switches 1602 and 1603 are set off by supplying no video signal from the signal input line 1611. Then, the other electrode of the capacitor 1604 and one of the electrodes of the capacitor 1605 have a potential obtained by subtracting the threshold voltage of the TFT 1601 from the potential of the power supply line 1608.

Next, description is made of the operation in the video signal writing period in accordance with this embodiment mode. First, a video signal is input from the signal input line 1611 to turn off the switch 1602 and turn on the switch 1603. Then, the other electrode of the capacitor 1605 has a potential of the video signal input, while the other electrode of the capacitor 1604 and one of the electrodes of the capacitor 1605 have a potential obtained by subtracting the threshold voltage of the TFT 1601 from the sum of the potentials of the power supply line 1608 and the video signal.

The operation in the light-emitting period in accordance with this embodiment mode is described next. First, the switches 1602 and 1603 are set off by supplying no video signal from the signal input line 1611. Therefore, potentials of the other electrode of the capacitor 1604 and one of the electrodes of the capacitor 1605 are held. Here, since the potentials of the other electrode of the capacitor 1604 and one of the electrodes of the capacitor 1605 correspond to the potential obtained by subtracting the threshold voltage of the TFT 1601 from the sum of the potentials of the power supply line 1608 and the video signal, a current corresponding to the gate-source potential of the TFT 1601 which is obtained by correcting variations in the threshold voltage of the TFT 1601 flows into the light-emitting element 1606. Accordingly, the light-emitting element 1606 can emit light.

Gray scales are expressed by controlling the current flowing into the light-emitting element 1606 by determining the gate-source potential of the TFT 1601 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 17

Description will be made of an exemplary configuration of a light-emitting unit applicable to Embodiment Modes 1 to 6, with reference to FIG. 17.

Figure 17:
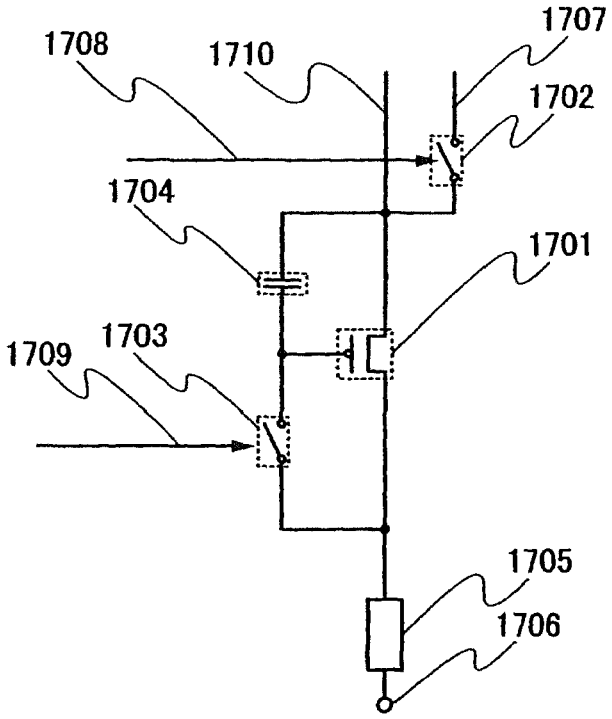
FIG. 17 shows a pixel in a semiconductor device of the invention according to Embodiment Mode 17.

In FIG. 17, a TFT 1701 is a p-channel transistor, a switch 1702 is a switch, on/off of which is controlled by a gate signal line 1708, and a switch 1703 is a switch, on/off of which is controlled by a gate signal line 1709. A capacitor 1704 is a capacitor having a pair of electrodes, a light-emitting element 1705 is a light-emitting element having a pair of electrodes, a counter electrode 1706 is an electrode of the light-emitting element 1705, and a power supply line 1707 is a power supply line for supplying power to one of the electrodes of the light-emitting element 1705 through the switch 1702 and the TFT 1701. The gate signal line 1708 is a signal line for controlling the switch 1702, the gate signal line 1709 is a signal line for controlling the switch 1703, and a signal input line 1710 is a signal line for inputting video signals into the light-emitting unit. The light-emitting unit of this Embodiment Mode has the light-emitting element 1705 and a light-emission control circuit for controlling a light-emitting state of the light-emitting element 1705 in accordance with a video signal.

The power supply line 1707 is connected to one of terminals of the switch 1702. The other terminal of the switch 1702 is connected to one of either a source or a drain of the TFT 1701, one of the electrodes of the capacitor 1704, and the signal input line 1710. The other of either the source or the drain of the TFT 1701 is connected to one of the electrodes of the light-emitting element 1705 and one of terminals of the switch 1703. A gate of the TFT 1701 is connected to the other electrode of the capacitor 1704 and the other terminal of the switch 1703. On/off of the switch 1702 is controlled by the gate signal line 1708, while on/off of the switch 1703 is controlled by the gate signal line 1709.

The power supply line 1707 is set at a potential which is higher than the counter electrode 1706, and the signal input line 1710 inputs a video signal into the light-emitting unit to be written with the signal. In addition, the video signal is input with a current.

In this embodiment mode, the light-emitting unit is driven through a video signal writing period and a light-emitting period; therefore, description is made below separately of the operation in each period.

Description is made of the operation in the video signal writing period in accordance with this embodiment mode. First, a video signal is input from the signal input line 1710 to turn off the switch 1702 and turn on the switch 1703. Then, a potential corresponding to the video signal input is held in the capacitor 1704. Since the video signal is input with a current, a current to flow into the light-emitting element 1705 is not affected by variations in the threshold voltage of the TFT 1701.

Next, description is made of the operation in the light-emitting period in accordance with this embodiment mode. First, the switch 1702 is set on and the switch 1703 is set off by supplying no video signal from the signal input line 1710. Then, since a potential of the power supply line 1707 is applied to one of the electrodes of the capacitor 1704 and one of either a source or a drain of the TFT 1701, a potential of the other electrode of the capacitor 1704 is held. Here, since the other electrode of the capacitor 1704 holds the potential which has been written in the video signal writing period, a current corresponding to the gate-source potential of the TFT 1701 which is obtained by correcting variations in the threshold voltage of the TFT 1701 flows into the light-emitting element 1705. Accordingly, the light-emitting element 1705 can emit light.

Gray scales are expressed by controlling the current flowing into the light-emitting element 1705 by determining the gate-source potential of the TFT 1701 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 18

Description will be made of an exemplary configuration of a light-emitting unit applicable to Embodiment Modes 1 to 6, with reference to FIG. 18.

Figure 18:
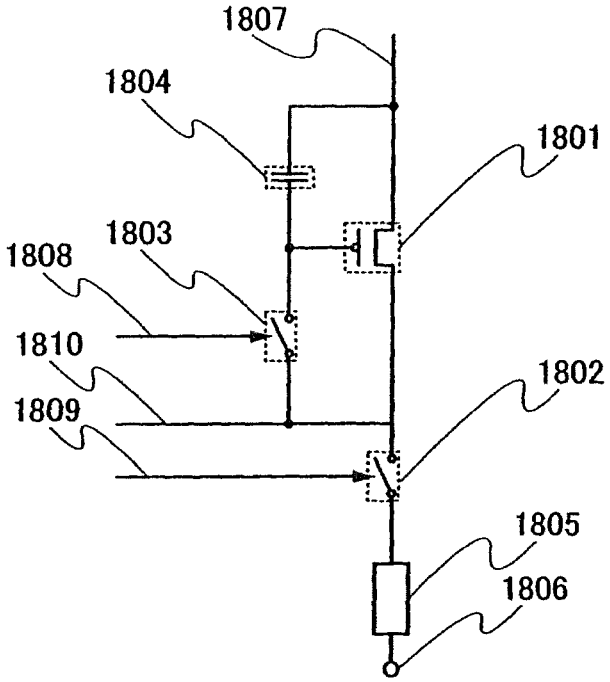
FIG. 18 shows a pixel in a semiconductor device of the invention according to Embodiment Mode 18.

In FIG. 18, a TFT 1801 is a p-channel transistor, a switch 1802 is a switch, on/off of which is controlled by a gate signal line 1809, and a switch 1803 is a switch, on/off of which is controlled by a gate signal line 1808. A capacitor 1804 is a capacitor having a pair of electrodes, a light-emitting element 1805 is a light-emitting element having a pair of electrodes, a counter electrode 1806 is an electrode of the light-emitting element 1805, and a power supply line 1807 is a power supply line for supplying power to one of the electrodes of the light-emitting element 1805 through the TFT 1801 and the switch 1802. The gate signal line 1808 is a signal line for controlling the switch 1803, the gate signal line 1809 is a signal line for controlling the switch 1802, and a signal input line 1810 is a signal line for inputting video signals into the light-emitting unit. The light-emitting unit of this Embodiment Mode has the light-emitting element 1805 and a light-emission control circuit for controlling a light-emitting state of the light-emitting element 1805 in accordance with a video signal.

The power supply line 1807 is connected to one of either a source or a drain of the TFT 1801 and one of the electrodes of the capacitor 1804. The other of either the source or the drain of the TFT 1801 is connected to one of terminals of the switch 1802, one of terminals of the switch 1803, and the signal input line 1810. The other terminal of the switch 1802 is connected to one of the electrodes of the light-emitting element 1805. A gate of the TFT 1801 is connected to the other electrode of the capacitor 1804 and the other terminal of the switch 1803. On/off of the switch 1802 is controlled by the gate signal line 1809, while on/off of the switch 1803 is controlled by the gate signal line 1808.

The power supply line 1807 is set at a potential which is higher than the counter electrode 1806, and the signal input line 1810 inputs a video signal into the light-emitting unit to be written with the signal. In addition, the video signal is input with a current.

In this embodiment mode, the light-emitting unit is driven through a video signal writing period and a light-emitting period; therefore, description is made below separately of the operation in each period.

Description is made of the operation in the video signal writing period in accordance with this embodiment mode. First, a video signal is input from the signal input line 1810 to turn off the switch 1802 and turn on the switch 1803. Then, a potential corresponding to the video signal input is held in the capacitor 1804. Since the video signal is input with a current, a current to flow into the light-emitting element 1805 is not affected by variations in the threshold voltage of the TFT 1801.

Next, description is made of the operation in the light-emitting period in accordance with this embodiment mode. First, the switch 1802 is set on and the switch 1803 is set off by supplying no video signal from the signal input line 1810. Then, since a potential of the power supply line 1807 is applied to one of the electrodes of the capacitor 1804 and one of either a source or a drain of the TFT 1801, a potential of the other electrode of the capacitor 1804 is held. Here, since the other electrode of the capacitor 1804 holds the potential which has been written in the video signal writing period, a current corresponding to the gate-source potential of the TFT 1801 which is obtained by correcting variations in the threshold voltage of the TFT 1801 flows into the light-emitting element 1805. Accordingly, the light-emitting element 1805 can emit light.

Gray scales are expressed by controlling the current flowing into the light-emitting element 1805 by determining the gate-source potential of the TFT 1801 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 19

Description will be made of an exemplary configuration of a light-emitting unit applicable to Embodiment Modes 1 to 6, with reference to FIG. 19.

Figure 19:
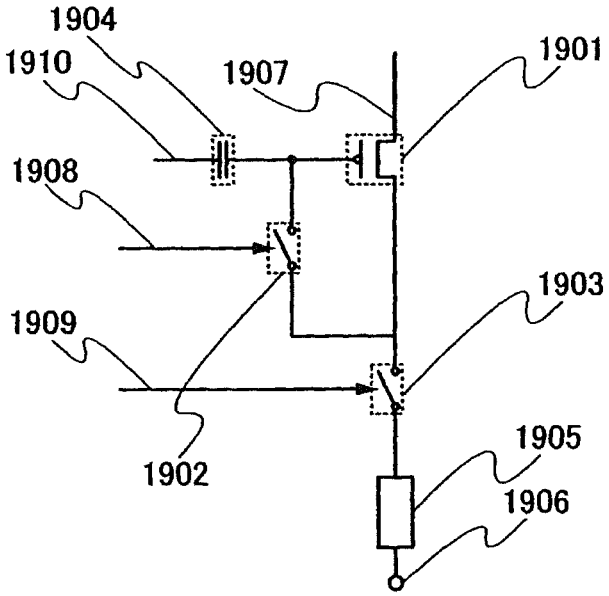
FIG. 19 shows a pixel in a semiconductor device of the invention according to Embodiment Mode 19.

In FIG. 19, a TFT 1901 is a p-channel transistor, a switch 1902 is a switch, on/off of which is controlled by a gate signal line 1908, and a switch 1903 is a switch, on/off of which is controlled by a gate signal line 1909. A capacitor 1904 is a capacitor having a pair of electrodes, a light-emitting element 1905 is a light-emitting element having a pair of electrodes, a counter electrode 1906 is the opposite electrode of the light-emitting element 1905, and a power supply line 1907 is a power supply line for supplying power to one of the electrodes of the light-emitting element 1905 through the TFT 1901 and the switch 1903. The gate signal line 1908 is a signal line for controlling the switch 1902, the gate signal line 1909 is a signal line for controlling the switch 1903, and a signal input line 1910 is a signal line for inputting video signals into the light-emitting unit. The light-emitting unit of this Embodiment Mode has the light-emitting element 1905 and a light-emission control circuit for controlling a light-emitting state of the light-emitting element 1905 in accordance with a video signal.

The power supply line 1907 is connected to one of either a source or a drain of the TFT 1901. The other of either the source or the drain of the TFT 1901 is connected to one of terminals of the switch 1903 and one of terminals of the switch 1902. The other terminal of the switch 1903 is connected to one of the electrodes of the light-emitting element 1905. A gate of the TFT 1901 is connected to the other terminal of the switch 1902 and one of the electrodes of the capacitor 1904. The other electrode of the capacitor 1904 is connected to the signal input line 1910. On/off of the switch 1902 is controlled by the gate signal line 1908, while on/off of the switch 1903 is controlled by the gate signal line 1909.

The power supply line 1907 is set at a potential which is higher than the counter electrode 1906, and the signal input line 1910 inputs a video signal into the light-emitting unit to be written with the signal. In addition, the video signal is input with a voltage.

In this embodiment mode, the light-emitting unit is driven through a threshold voltage sampling period, a video signal writing period, and a light-emitting period; therefore, description is made below separately of the operation in each period.

Description is made of the operation in the threshold voltage sampling period and the video signal writing period in accordance with this embodiment mode. First, a video signal is input from the signal input line 1910 to turn on the switch 1902 and turn off the switch 1903. Then, one of the electrodes of the capacitor 1904 has a potential obtained by subtracting the threshold voltage of the TFT 1901 from the potential of the power supply line 1907. The other electrode of the capacitor 1904 has a potential of the video signal.

Next, description is made of the operation in the light-emitting period in accordance with this embodiment mode. First, a triangular wave is input from the signal input line 1910 to turn off the switch 1902 and turn on the switch 1903. Then, since one of the electrodes of the capacitor 1904 has a potential which corresponds to a difference between the potential of the signal input line 1910 and a potential obtained by subtracting the threshold voltage of the TFT 1901 from the potential of the power supply line 1907, the light-emitting time changes depending on the potential of the video signal input in the threshold voltage sampling period and the video signal writing period.

Gray scales are expressed by controlling the current flowing into the light-emitting element 1905 by determining the gate-source potential of the TFT 1901 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 20

Description will be made of an exemplary configuration of a light-emitting unit applicable to Embodiment Modes 1 to 6, with reference to FIG. 20.

Figure 20:
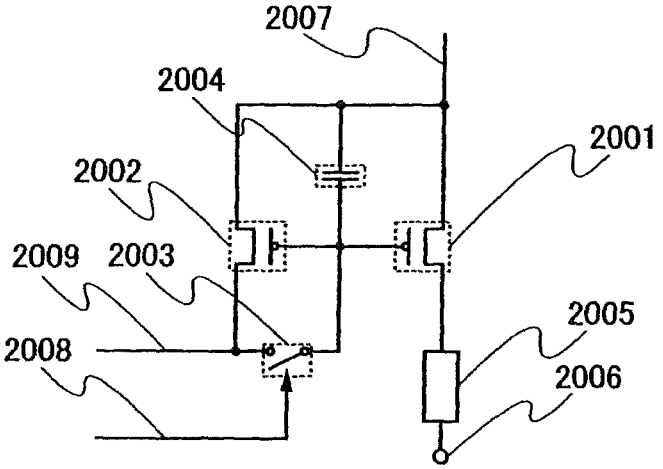
FIG. 20 shows a pixel in a semiconductor device of the invention according to Embodiment Mode 20.

In FIG. 20, TFTs 2001 and 2002 are p-channel transistors, and a switch 2003 is a switch, on/off of which is controlled by a gate signal line 2008. A capacitor 2004 is a capacitor having a pair of electrodes, a light-emitting element 2005 is a light-emitting element having a pair of electrodes, and a counter electrode 2006 is the opposite electrode of the light-emitting element 2005. A power supply line 2007 is a power supply line for supplying power to one of the electrodes of the light-emitting element 2005 through the TFT 2001. The gate signal line 2008 is a signal line for controlling the switch 2003, and a signal input line 2009 is a signal line for inputting video signals into the light-emitting unit. The light-emitting unit of this Embodiment Mode has the light-emitting element 2005 and a light-emission control circuit for controlling a light-emitting state of the light-emitting element 2005 in accordance with a video signal.

The power supply line 2007 is connected to one of either a source or a drain of the TFT 2001, one of either a source or a drain of the TFT 2002, and one of the electrodes of the capacitor 2004. The other of either the source or the drain of the TFT 2001 is connected to one of the electrodes of the light-emitting element 2005. The other of either the source or the drain of the TFT 2002 is connected to one of terminals of the switch 2003 and the signal input line 2009. A gate of the TFT 2001 is connected to a gate of the TFT 2002, the other electrode of the capacitor 2004, and the other terminal of the switch 2003. On/off of the switch 2003 is controlled by the gate signal line 2008.

The power supply line 2007 is set at a potential which is higher than the counter electrode 2006, and the signal input line 2009 inputs a video signal into the light-emitting unit to be written with the signal. In addition, the video signal is input with a current.

In this embodiment mode, the light-emitting unit is driven through a video signal writing period and a light-emitting period; therefore, description is made below separately of the operation in each period.

Description is made of the operation in the video signal writing period in accordance with this embodiment mode. First, a video signal is input from the signal input line 2009 to turn on the switch 2003. Then, a potential corresponding to the video signal input is held in the capacitor 2004. Since the video signal is input with a current, a current to flow into the light-emitting element 2005 is not affected by variations in the threshold voltage of the TFT 2002.

Next, description is made of the operation in the light-emitting period in accordance with this embodiment mode. First, the switch 2003 is set off by supplying no video signal from the signal input line 2009. Thus, a potential of the other electrode of the capacitor 2004 is held. Then, since the other electrode of the capacitor 2004 holds the potential which has been written in the video signal writing period, variations in the threshold voltage of the TFT 2002 are corrected. In addition, since the TFTs 2001 and 2002 have a common gate and a common source or drain, if the threshold voltages of the TFTs 2001 and 2002 are set the same, a current corresponding to the gate-source potential of the TFT 2001 which is obtained by correcting variations in the threshold voltage of the TFT 2001 flows into the light-emitting element 2005. Accordingly, the light-emitting element 2005 can emit light.

Gray scales are expressed by controlling the current flowing into the light-emitting element 2005 by determining gate-source potentials of the TFTs 2001 and 2002 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 21

Description will be made of an exemplary configuration of a light-emitting unit applicable to Embodiment Modes 1 to 6, with reference to FIG. 21.

Figure 21:
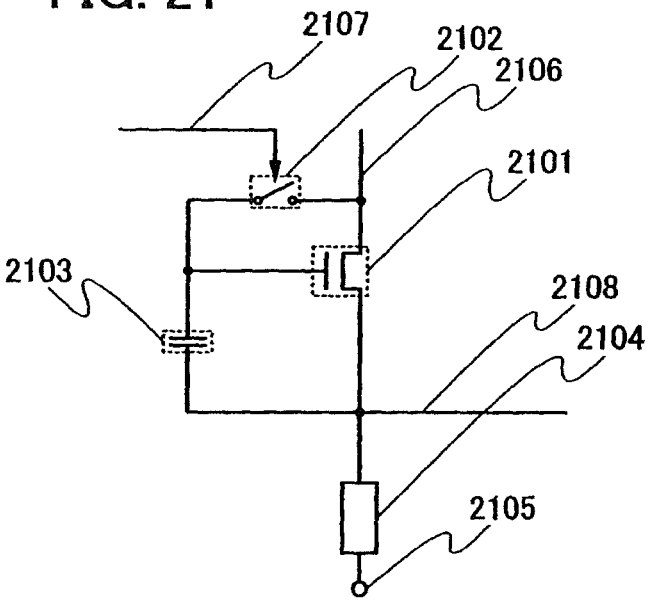
FIG. 21 shows a pixel in a semiconductor device of the invention according to Embodiment Mode 21.

In FIG. 21, a TFT 2101 is an n-channel transistor, and a switch 2102 is a switch, on/off of which is controlled by a gate signal line 2107. A capacitor 2103 is a capacitor having a pair of electrodes, a light-emitting element 2104 is a light-emitting element having a pair of electrodes, and a counter electrode 2105 is an electrode of the light-emitting element 2104. A power supply line 2106 is a power supply line for supplying power to one of the electrodes of the light-emitting element 2104 through the TFT 2101. The gate signal line 2107 is a signal line for controlling the switch 2102, and a signal input line 2108 is a signal line for inputting video signals into the light-emitting unit. The light-emitting unit of this Embodiment Mode has the light-emitting element 2104 and a light-emission control circuit for controlling a light-emitting state of the light-emitting element 2104 in accordance with a video signal.

The power supply line 2106 is connected to one of either a source or a drain of the TFT 2101 and one of terminals of the switch 2102. The other of either the source or the drain of the TFT 2101 is connected to one of the electrodes of the light-emitting element 2104, one of the electrodes of the capacitor 2103, and the signal input line 2108. A gate of the TFT 2101 is connected to the other terminal of the switch 2102 and the other electrode of the capacitor 2103. On/off of the switch 2102 is controlled by the gate signal line 2107.

The power supply line 2106 is set at a potential which is lower than the counter electrode 2105, and the signal input line 2108 inputs a video signal into the light-emitting unit to be written with the signal. In addition, the video signal is input with a current.

In this embodiment mode, the light-emitting unit is driven through a video signal writing period and a light-emitting period; therefore, description is made below separately of the operation in each period.

Description is made of the operation in the video signal writing period in accordance with this embodiment mode. First, a video signal is input from the signal input line 2108 to turn on the switch 2102. Then, a potential corresponding to the video signal input is held in the capacitor 2103. Since the video signal is input with a current, a current to flow into the light-emitting element 2104 is not affected by variations in the threshold voltage of the TFT 2101.

Next, description is made of the operation in the light-emitting period in accordance with this embodiment mode. First, the switch 2102 is set off by supplying no video signal from the signal input line 2108. Thus, a potential of the other electrode of the capacitor 2103 is held. Then, since the other electrode of the capacitor 2103 holds the potential which has been written in the video signal writing period, a current corresponding to the gate-source potential of the TFT 2101 which is obtained by correcting variations in the threshold voltage of the TFT 2101 flows into the light-emitting element 2104. Accordingly, the light-emitting element 2104 can emit light.

Gray scales are expressed by controlling the current flowing into the light-emitting element 2104 by determining the gate-source potential of the TFT 2101 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 22

Description will be made of an exemplary configuration of a light-emitting unit applicable to Embodiment Modes 1 to 6, with reference to FIG. 22.

Figure 22:
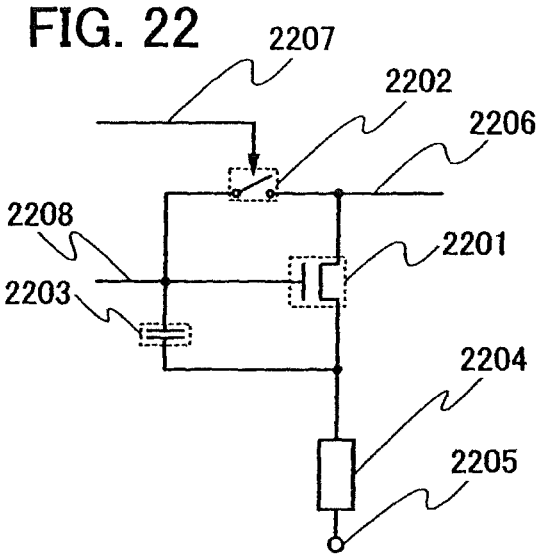
FIG. 22 shows a pixel in a semiconductor device of the invention according to Embodiment Mode 22.

In FIG. 22, a TFT 2201 is an n-channel transistor, and a switch 2202 is a switch, on/off of which is controlled by a gate signal line 2207. A capacitor 2203 is a capacitor having a pair of electrodes, a light-emitting element 2204 is a light-emitting element having a pair of electrodes, and a counter electrode 2205 is an electrode of the light-emitting element 2204. A power supply line 2206 is a power supply line for supplying power to one of the electrodes of the light-emitting element 2204 through the TFT 2201. The gate signal line 2207 is a signal line for controlling the switch 2202, and a signal input line 2208 is a signal line for inputting video signals into the light-emitting unit. The light-emitting unit of this Embodiment Mode has the light-emitting element 2204 and a light-emission control circuit for controlling a light-emitting state of the light-emitting element 2204 in accordance with a video signal.

The power supply line 2206 is connected to one of either a source or a drain of the TFT 2201 and one of terminals of the switch 2202. The other of either the source or the drain of the TFT 2201 is connected to one of the electrodes of the light-emitting element 2204 and one of the electrodes of the capacitor 2203. A gate of the TFT 2201 is connected to the other terminal of the switch 2202, the other electrode of the capacitor 2203, and the signal input line 2208. On/off of the switch 2202 is controlled by the gate signal line 2207.

The power supply line 2206 is set at a potential which is lower than the counter electrode 2205, and the signal input line 2208 inputs a video signal into the light-emitting unit when it is selected to be written with a video signal. In addition, the video signal is input with a voltage.

In this embodiment mode, the light-emitting unit is driven through a threshold voltage sampling period, a video signal writing period, and a light-emitting period; therefore, description is made below separately of the operation in each period.

Description is made of the operation in the threshold voltage sampling period in accordance with this embodiment mode. First, the switch 2202 is set on by supplying no video signal from the signal input line 2208. Then, the threshold voltage of the TFT 2201 is held between the other electrode of the capacitor 2203 and the other electrode of the light-emitting element 2204.

Next, description is made of the operation in the video signal writing period in accordance with this embodiment mode. First, a video signal is input from the signal input line 2208 to turn off the switch 2202. Then, the other electrode of the capacitor 2203 has about a potential which is obtained by subtracting the threshold voltage of the TFT 2201 from a potential of the video signal.

Description is made of the operation in the light-emitting period in accordance with this embodiment mode. First, the switch 2202 is set off by supplying no video signal from the signal input line 2208. Thus, a potential of the other electrode of the capacitor 2203 is held. Then, since the other electrode of the capacitor 2203 holds the potential which is obtained by subtracting the threshold voltage of the TFT 2201 from the sum of the potentials of the counter electrode 2205 and the video signal, a current corresponding to the gate-source potential of the TFT 2201 which is obtained by correcting variations in the threshold voltage of the TFT 2201 flows into the light-emitting element 2204. Accordingly, the light-emitting element 2204 can emit light.

Gray scales are expressed by controlling the current flowing into the light-emitting element 2204 by determining the gate-source potential of the TFT 2201 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 23

Description will be made of an exemplary configuration of a light-emitting unit applicable to Embodiment Modes 1 to 6, with reference to FIG. 23.

Figure 23:
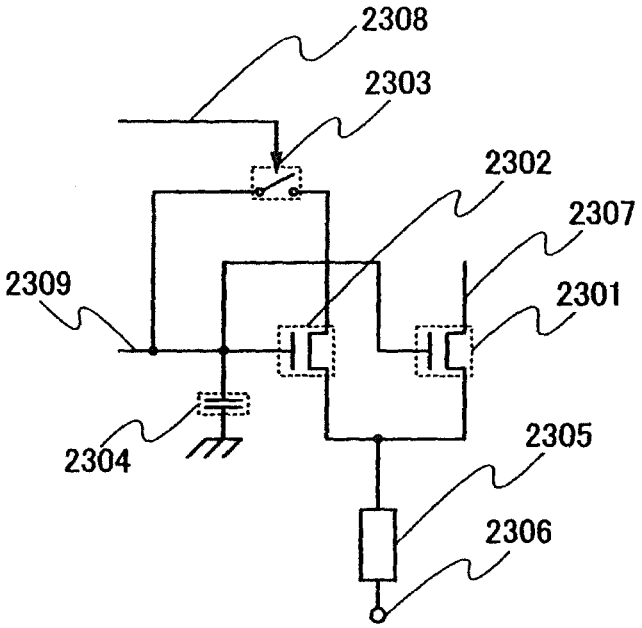
FIG. 23 shows a pixel in a semiconductor device of the invention according to Embodiment Mode 23.

In FIG. 23, TFTs 2301 and 2302 are n-channel transistors, and a switch 2303 is a switch, on/off of which is controlled by a gate signal line 2308. A capacitor 2304 is a capacitor having a pair of electrodes, a light-emitting element 2305 is a light-emitting element having a pair of electrodes, and a counter electrode 2306 is the opposite electrode of the light-emitting element 2305. A power supply line 2307 is a power supply line for supplying power to one of the electrodes of the light-emitting element 2305 through the TFT 2301. The gate signal line 2308 is a signal line for controlling the switch 2303, and a signal input line 2309 is a signal line for inputting video signals into the light-emitting unit. The light-emitting unit of this Embodiment Mode has the light-emitting element 2305 and a light-emission control circuit for controlling a light-emitting state of the light-emitting element 2305 in accordance with a video signal.

The power supply line 2307 is connected to one of either a source or a drain of the TFT 2301. The other of either the source or the drain of the TFT 2301 is connected to one of the electrodes of the light-emitting element 2305 and the other of either the source or the drain of the TFT 2302. A gate of the TFT 2301 is connected to a gate of the TFT 2302, one of the electrodes of the capacitor 2304, the signal input line 2309, and one of terminals of the switch 2303. One of either a source or a drain of the TFT 2302 is connected to the other terminal of the switch 2303. On/off of the switch 2303 is controlled by the gate signal line 2308.

The power supply line 2307 is set at a potential which is higher than the counter electrode 2306, and the signal input line 2309 inputs a video signal into the light-emitting unit when it is selected to be written with a video signal. In addition, the video signal is input with acurrent.

In this embodiment mode, the light-emitting unit is driven through a video signal writing period and a light-emitting period; therefore, description is made below separately of the operation in each period.

Description is made of the operation in the video signal writing period in accordance with this embodiment mode. First, a video signal is input from the signal input line 2309 to turn on the switch 2303. Then, the capacitor 2304 holds a potential corresponding to the video signal input. Since the video signal is input with a current, a current to flow into the light-emitting element 2304 is not affected by variations in the threshold voltage of the TFT 2302.

Description is made of the operation in the light-emitting period in accordance with this embodiment mode. First, the switch 2303 is set off by supplying no video signal from the signal input line 2309. Thus, a potential of the other electrode of the capacitor 2304 is held. Then, since the other electrode of the capacitor 2304 holds the potential which has been written in the video signal writing period, variations in the threshold voltage of the TFT 2302 are corrected. In addition, since the TFTs 2301 and 2302 have a common gate and a common source or drain, if the threshold voltages of the TFTs 2301 and 2302 are set the same, a current corresponding to the gate-source potential of the TFT 2301 which is obtained by correcting variations in the threshold voltage of the TFT 2301 flows into the light-emitting element 2305. Accordingly, the light-emitting element 2305 can emit light.

Gray scales are expressed by controlling the current flowing into the light-emitting element 2305 by determining the gate-source potential of the TFT 2301 in accordance with a video signal input.

The light-emitting unit in accordance with this embodiment mode can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between the output side of the source driver up to and including the pixel selected to be written with a video signal. Accordingly, power consumed by the charging and discharging of the source signal line can be reduced, and thus low power consumption can be achieved.

Embodiment Mode 24

As has been described in Embodiment Modes 1 to 6, a source signal line is provided with a switch or a TFT functioning as a switch in accordance with the invention. Therefore, the pixel configuration of the invention can be applied not only to the pixels shown in Embodiment Modes 7 to 23, but also to other pixels which are supplied with video signals through source signal lines. Further, the invention can be also applied to a liquid crystal display device and the like, in which a voltage or a current having an amplitude is output from source signal lines.

Although an n-channel transistor or a p-channel transistor is used as the switch provided in the source signal line in Embodiment Modes 3 to 6, it may be an analog switch.

Although a transistor is used as an example of a switching element, the invention is not limited to this. Anything that can control a current flow can be used as a switching element, such as an electrical switch or a mechanical switch. For example, it may be a diode or a logic circuit constructed from a diode and a transistor.

In addition, a transistor applicable to a switching element of the invention is not limited to a certain type, and a TFT using a non-single crystalline semiconductor film typified by amorphous silicon or polycrystalline silicon can be used as well as a MOS transistor formed with a semiconductor substrate or an SOI substrate, a junction transistor, a bipolar transistor, a transistor using an organic semiconductor or a carbon nanotube, or other transistors. In addition, a substrate over which transistors are formed is not limited to a certain type, and various kinds of substrates can be used such as a single crystalline substrate, an SOI substrate, a quartz substrate, a glass substrate, or a resin substrate.

Since the transistor is operated just as a switching element, the polarity (conductivity type) thereof is not particularly limited, and either an n-channel transistor or a p-channel transistor may be employed. However, when off-current is preferred to be small, a transistor of a polarity with small off-current is desirably used. As a transistor with small off-current, there is a transistor provided with a region (called an LDD region) doped with impurities which impart conductivity type at a low concentration between a channel formation region and a source or drain region.

Further, it is desirable that an n-channel transistor be employed if it is driven with a source potential being closer to the low-potential-side power supply, while a p-channel transistor be employed if it is driven with a source potential being closer to the high-potential-side power supply. This helps the switch operate efficiently because the absolute value of the gate-source voltage of the transistor can be increased. Further, a CMOS switching element may be constructed by using n-channel and p-channel transistors.

The circuit configurations in the block diagrams in Embodiment Modes 1 to 6 may be any circuit configurations as long as the drive described herein can be realized.

Embodiment 1

In this embodiment, description is made of an exemplary structure of a light-emitting unit including a transistor and a light-emitting element. The structure in this embodiment can be applied to the light-emitting units shown in FIGS. 7 to 23.

The signal input line 706 in FIG. 7 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 806 in FIG. 8 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 908 in FIG. 9 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1008 in FIG. 10 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1108 in FIG. 11 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1208 in FIG. 12 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1309 or 1310 in FIG. 13 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1409 or 1410 in FIG. 14 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1513 in FIG. 15 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1611 in FIG. 16 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1710 in FIG. 17 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1810 in FIG. 18 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 1910 in FIG. 19 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 2009 in FIG. 20 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 2108 in FIG. 21 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 2208 in FIG. 22 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

The signal input line 2309 in FIG. 23 corresponds to the source signal line 107 in FIG. 1, the source signal line 207 in FIG. 2, the source signal line 307 in FIG. 3, the source signal line 407 in FIG. 4, the source signal line 507 in FIG. 5, and the source signal line 607 in FIG. 6.

Note that the other wires shown in FIGS. 7 to 23 are not shown in FIGS. 1 to 6.

Figure 24A:
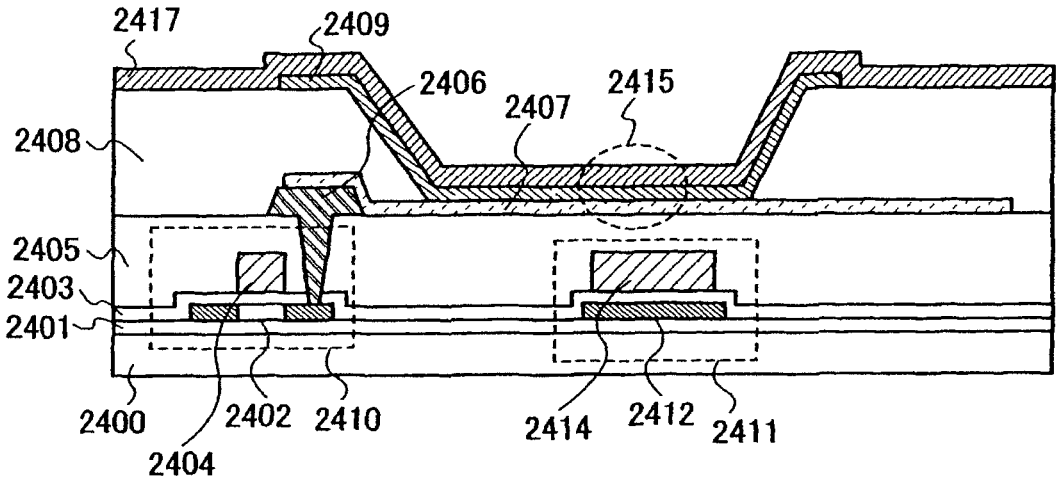
FIGS. 24A and 24B show cross sections of light emitting units according to Embodiment 1.

Referring to FIG. 24A, a substrate 2400 can be formed with a glass substrate such as barium borosilicate glass or alumino borosilicate glass, a quartz substrate, a ceramic substrate, or the like. Alternatively, a metal substrate containing stainless steel or a semiconductor substrate having an insulating film formed on its surface can be used. A substrate formed of a flexible synthetic resin such as plastic can also be used. The surface of the substrate 2400 may be planarized by polishing such as CMP.

As a base film 2401, an insulating film containing silicon oxide, silicon nitride, silicon nitride oxide, or the like can be used. The base film 2401 can prevent alkaline metals such as Na or alkaline earth metals contained in the substrate 2400 from diffusing into a semiconductor layer 2402, and adversely affecting the characteristics of a TFT 2410. Although the base film 2401 is formed as a single layer in FIG. 24A, it may have two or more layers. Note that the base film 2401 is not necessarily provided when diffusion of impurities is not a big concern, for example in the case of using a quartz substrate.

As a semiconductor layer 2402 and a semiconductor layer 2412, a patterned crystalline semiconductor film or amorphous semiconductor film can be used. The crystalline semiconductor film can be obtained by crystallizing an amorphous semiconductor film. As the crystallization method, laser crystallization, thermal crystallization using RTA or an annealing furnace, thermal crystallization using metal elements which promote crystallization, or the like can be used. The semiconductor layer 2402 includes a channel formation region and a pair of impurity regions doped with impurity elements which impart conductivity type. Note that another impurity region which is doped with the aforementioned impurity elements at a low concentration may be provided between the channel formation region and the pair of impurity regions. The semiconductor layer 2412 may have a structure where the entire layer is doped with impurity elements which impart conductivity type.

A first insulating film 2403 can be formed by stacking silicon oxide, silicon nitride, silicon nitride oxide or/and the like, either in a single layer or a plurality of layers.

Note that the first insulating film 2403 may be formed with a film containing hydrogen so as to hydrogenate the semiconductor layer 2402.

A gate electrode 2404 and a electrode 2414 may be formed with one element selected from among Ta, W, Ti, Mo, Al, Cu, Cr, and Nd, or an alloy or compound containing such elements, either in a single layer or stacked layers.

The TFT 2410 is formed to have the semiconductor layer 2402, the gate electrode 2404, and the first insulating film 2403, which is sandwiched between the semiconductor layer 2402 and the gate electrode 2404. Although FIG. 24A shows only the TFT 2410 connected to a first electrode 2407 of a light-emitting element 2415 as a TFT which partially constitutes a pixel, a structure with a plurality of TFTs may be provided. In addition, although this embodiment illustrates a top-gate transistor as the TFT 2410, the TFT 2410 may be a bottom-gate transistor having a gate electrode below a semiconductor layer, or a dual-gate transistor having gate electrodes above and below a semiconductor layer.

A capacitor 2411 is formed to have the first insulating film 2403 as a dielectric, and a pair of electrodes, namely, the semiconductor layer 2412 and the electrode 2414 facing each other with the first insulating film 2403 sandwiched therebetween. Although FIG. 24A illustrates an example of a capacitor where the semiconductor layer 2412 which is formed concurrently with the semiconductor layer 2402 of the TFT 2410 is used as one of a pair of electrodes, while the electrode 2414 which is formed concurrently with the gate electrode 2404 of the TFT 2410 is used as the other electrode, the invention is not limited to such a structure.

A second insulating film 2405 can be formed to have either a single layer or stacked layers, using an inorganic insulating film or an organic insulating film. As the inorganic insulating film, there is a silicon oxide film formed by CVD or a silicon oxide film formed by SOG (Spin On Glass). As the organic insulating film, there is a film made of polyimide, polyamide, BCB (benzocyclobutene), acrylic, a positive photosensitive organic resin, a negative photosensitive organic resin, or the like.

The second insulating film 2405 may also be formed with a material having a skeletal structure with the bond of silicon (Si) and oxygen (O). As a substituent of such a material, an organic group containing at least hydrogen (e.g., an alkyl group or aromatic hydrocarbon) is used. Alternatively, a fluoro group may be used as the substituent, or both the fluoro group and the organic group containing at least hydrogen may be used as the substituent.

Note that the surface of the second insulating film 2405 may be nitrided by high-density plasma treatment. High-density plasma is generated by using microwaves with a high frequency, for example 2.45 GHz. Note that as the high-density plasma, plasma with an electron density ranging from $1\times10^{11}$ $cm^{-3}$ to $1\times10^{13}$ $cm^{-3}$ and an electron temperature ranging from 0.2 to 2.0 eV (preferably, 0.5 to 1.5 eV) is used. Thus, since high-density plasma is characterized by its low electron temperature, and has low kinetic energy of activated species, a film with little plasma damage and few defects can be formed, compared with a film formed by the conventional plasma treatment. In performing high-density plasma treatment, the substrate 2400 is set at a temperature in the range of 350 to 450° C. In addition, the distance between an antenna for generating microwaves and the substrate 2400 in an apparatus for generating high-density plasma is set at 20 to 80 mm (preferably, 20 to 60 mm).

The surface of the second insulating film 2405 is nitrided by performing the aforementioned high-density plasma treatment under a nitrogen atmosphere, for example, an atmosphere containing nitrogen and a rare gas (at least one of He, Ne, Ar, Kr, and Xe), an atmosphere containing nitrogen, hydrogen, and a rare gas, or an atmosphere containing $NH_3$ and a rare gas. The surface of the second insulating film 2405 formed by such nitridation treatment with high-density plasma is mixed with elements such as nitrogen, and He, Ne, Ar, Kr, or Xe. For example, by using a silicon oxide film or a silicon oxynitride film as the second insulating film 2405 and treating the surface of the film with high-density plasma, a silicon nitride film is formed. Hydrogen contained in the silicon nitride film formed in this manner may be used for hydrogenating the semiconductor layer 2402 of the TFT 2410. Note that this hydrogenation treatment may be combined with the aforementioned hydrogenation treatment using hydrogen contained in the first insulating film 2403.

Note that another insulating film may be formed over the nitride film formed by the high-density plasma treatment, and used as the second insulating film 2405.

An electrode 2406 can be formed with an element selected from among Al, Ni, C, W, Mo, Ti, Pt, Cu, Ta, Au, and Mn, or alloys containing such elements, so as to have either a single-layer structure or a stacked-layer structure.

One or both of the first electrode 2407 and a second electrode 2417 can be formed as a light-transmissive electrode. The light-transmissive electrode can be formed with indium oxide containing tungsten oxide, indium zinc oxide containing tungsten oxide, indium oxide containing titanium oxide, indium tin oxide containing titanium oxide, or the like. Needless to say, indium tin oxide (ITO), indium zinc oxide, indium tin oxide doped with silicon oxide, or the like may also be used.

The light-emitting layer is preferably formed with a plurality of layers having different functions, such as a hole injecting/transporting layer, a light-emitting layer, and an electron injecting/transporting layer.

The hole injecting/transporting layer is preferably formed with a composite material containing an organic compound material having a hole transporting property and an inorganic compound material which exhibits an electron accepting property with respect to the organic compound material. By using such a structure, many hole carriers are generated in the organic compound, which has few inherent carriers, thereby an excellent hole injecting/transporting property can be obtained. Due to such an effect, driving voltage can be suppressed more than in the conventional structure. Further, since the hole injecting/transporting layer can be formed to be thick without increasing the driving voltage, short circuits of the light-emitting element resulting from dust or the like can also be suppressed.

As examples of an organic compound material having a hole transporting property, there are 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-diphenyl-N,N'-bis(3-methylphenyl)-1,1'-biphenyl-4,4'-diamine (abbreviation: TPD); 4,4'-bis[N-(1-naphthyl)-N-phenylamino]biphenyl (abbreviation: NPB); and the like. However, the invention is not limited to these.

As examples of an inorganic compound material which exhibits an electron accepting property, there are titanium oxide, zirconium oxide, vanadium oxide, molybdenum oxide, tungsten oxide, rhenium oxide, ruthenium oxide, zinc oxide, and the like. In particular, it is preferable to use vanadium oxide, molybdenum oxide, tungsten oxide, and rhenium oxide because they can be deposited in vacuum, and thus are easily handled.

The electron injecting/transporting layer is formed with an organic compound material having an electron transporting property. As specific examples, there are tris(8-quinolinolato)aluminum (abbreviation: $Alq_3$), tris(4-methyl-8-quinolinolato)aluminum (abbreviation: $Almq_3$), and the like. However, the invention is not limited to these.

The light-emitting layer can be formed with, for example, 9,10-di(2-naphthyl)anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl)perylene (abbreviation: TBP); 9,10-diphenylanthracene (abbreviation: DPA); 5,12-diphenyltetracene; 4-(dicyanomethylene)-2-methyl-6-(p-dimethylaminostyryl)-4H-pyran (abbreviation: DCM1); 4-(dicyanomethylene)-2-methyl-6-[2-(julolidine-9-yl)ethenyl]-4H-pyran (abbreviation: DCM2); 4-(dicyanomethylene)-2,6-bis[p-(dimethylamino)styryl]-4H-pyran (abbreviation: BisDCM); or the like. Alternatively, the following compounds capable of emitting phosphorescence can be used: bis[2-(4',6'-difluorophenyl)pyridinato-N,$C^{2'}$]iridium(III)picolinate (abbreviation: FIrpic); bis{2-[3',5'-bis(trifluoromethyl)phenyl]pyridinato-N,$C^{2'}$}iridium(picolinate) (abbreviation: $Ir(CF_3ppy)_2(pic)$); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(2'-thienyl)pyridinato-N,$C^{3'}$]iridium(acetylacetonate) (abbreviation: $Ir(thp)_2(acac)$); bis(2-phenylquinolinato-N,$C^{2'}$)iridium(acetylacetonate) (abbreviation: $Ir(pq)_2(acac)$); bis[2-(2'-benzothienyl)pyridinato-N,C']iridium(acetylacetonate) (abbreviation: $Ir(btp)_2(acac)$); or the like.

As further alternatives, the light-emitting layer may be formed with an electroluminescent polymeric material such as a polyparaphenylene-vinylene-based material, a polyparaphenylene-based material, a polythiophene-based material, or a polyfluorene-based material.

As a host material for forming the light-emitting layer, an inorganic material can be used. As the inorganic material, it is preferable to use sulfide, oxide, or nitride of a metal material such as zinc, cadmium, or gallium. As examples of the sulfide, there are zinc sulphide (ZnS), cadmium sulfide (CdS), calcium sulfide (CaS), yttrium sulfide ($Y_2S_3$), gallium sulfide ($Ga_2S_3$), strontium sulfide (SrS), barium monosulfide (BaS), and the like. As examples of the oxide, there are zinc oxide (ZnO), yttrium oxide ($Y_2O_3$), and the like. In addition, as examples of the nitride, there are aluminum nitride (MN), gallium nitride (GaN), indium nitride (InN), and the like. Furthermore, zinc selenide (ZnSe), zinc telluride (ZnTe), or the like can be used as well. Alternatively, ternary mixed crystal such as calcium sulfide-gallium ($CaGa_2S_4$), strontium sulfide-gallium ($SrGa_2S_4$), or barium sulfide-gallium ($BaGa_2S_4$), may be used.

As an impurity element, a metal element such as manganese (Mn), copper (Cu), samarium (Sm), terbium (Tb), erbium (Er), thulium (Tm), europium (Eu), cerium (Ce), or praseodymium (Pr) can be used to form a light-emission center which utilizes inner-shell electron transition of metal ions. As charge compensation, a halogen element such as fluorine (F) or chlorine (Cl) may be added.

In addition, as a light-emission center utilizing donor-acceptor recombination, a light-emitting material containing a first impurity element and a second impurity element can be used. For example, as the first impurity element, silicon (Si), or a metal element such as copper (Cu), silver (Ag), gold (Au), or platinum (Pt) can be used. The second impurity element may be, for example, fluorine (F), chlorine (Cl), bromine (Br), iodine (I), boron (B), aluminum (Al), gallium (Ga), indium (In), thallium (Tl), or the like.

A light-emitting material is obtained by solid-phase reaction, specifically by weighing a host material and an impurity element, mixing them in a mortar, and heating the mixture in an electric furnace so that the host material contains the impurity element. For example, the host material, a first impurity element or a compound containing the first impurity element, and a second impurity element or a compound containing the second impurity element are each weighed. After mixing them in a mortar, the mixture is heated and baked in an electric furnace. A baking temperature is preferably 700 to 1500° C. because the solid-phase reaction does not advance when the temperature is too low, whereas the host material decomposes when the temperature is too high. Note that the mixture may be baked in a powdered state, however, it is preferable to perform baking in a pellet state.

Further, as an impurity element in the case where solid-phase reaction is used, a compound formed by combining the first impurity element and the second impurity element may be used. In that case, the solid-phase reaction advances easily, since the impurity elements are easily diffused. Therefore, a uniform light-emitting material can be obtained. Moreover, since no unnecessary impurity elements are mixed, a light-emitting material with high purity can be obtained. As examples of a compound formed of the first impurity element and the second impurity element, there are copper fluoride ($CuF_2$), copper chloride (CuCl), copper iodide (CuI), copper bromide (CuBr), copper nitride ($Cu_3N$), copper phosphide ($Cu_3P$), silver fluoride (CuF), silver chloride (CuCl), silver iodide (CuI), silver bromide (CuBr), gold chloride ($AuCl_3$), gold bromide ($AuBr_3$), platinum chloride ($PtCl_2$), and the like. In addition, a light-emitting material containing the third impurity element instead of the second impurity element may be used.

For example, the third impurity element may be lithium (Li), sodium (Na), potassium (K), rubidium (Rb), cesium (Cs), nitrogen (N), phosphorus (P), arsenic (As), antimony (Sb), bismuth (Bi), or the like. The concentration of these impurity elements in the host material is preferably 0.01 to 10 mol %, and more preferably in the range of 0.1 to 5 mol %.

As a light-emitting material having high electric conductivity, the aforementioned material can be used as a host material, and a light-emitting material containing the aforementioned first impurity element, second impurity element, and third impurity element may be added thereto. The concentration of these impurity elements in the host material is preferably 0.01 to 10 mol %, and more preferably in the range of 0.1 to 5 mol %.

As a compound formed of the second impurity element and the third impurity element, for example, alkali halide such as lithium fluoride (LiF), lithium chloride (LiCl), lithium iodide (LiI), copper bromide (LiBr), or sodium chloride (NaCl) can be used as well as boron nitride (BN), aluminum nitride (MN), aluminum antimony (AlSb), gallium phosphorus (GaP), gallium arsenide (GaAs), indium phosphorus (InP), indium arsenic (InAs), indium antimonide (InSb), or the like.

A light-emitting layer formed by using the aforementioned material as a host material, and a light-emitting material containing the aforementioned first impurity element, second impurity element, and third impurity element, can emit light without a hot electron accelerated by a high electric field. That is to say, there is no need to apply high voltage to a light-emitting element, therefore, a light-emitting element which can operate with a low driving voltage can be obtained. Moreover, since the light-emitting element can emit light with a low driving voltage, power consumption can be reduced. In addition, an element which becomes another light-emission center may also be included.

Furthermore, a light-emitting material that uses the aforementioned material as a host material, and contains a light-emission center utilizing inner-shell electron transition of the second and third impurity elements and the aforementioned metal ion can be used. In this case, it is desirable that the concentration of the metal ion that becomes a light-emission center be contained in the host material at a concentration of 0.05 to 5 atom %. Moreover, it is preferable that the concentration of the second impurity element in the host material be 0.05 to 5 atom %. Moreover, it is preferable that the concentration of the third impurity element in the host material be 0.05 to 5 atom %. A light-emitting material with such a structure can emit light with a low voltage. Therefore, a light-emitting element which can emit light with a low driving voltage with reduced power consumption can be obtained. Moreover, an element which becomes another light-emission center may also be included. By using such a light-emitting material, luminance decay of a light-emitting element can be suppressed, and further, a light-emitting element can be driven with a low voltage by using a transistor.

In any case, the light-emitting layer may have various layer structures, and modification is possible as long as it can achieve its object as a light-emitting element. For example, a structure can be employed in which no specific hole or electron injecting/transporting layer is provided, but instead, a substitute electrode layer for this purpose is provided, or a light-emitting material is dispersed in the layer.

The other one of either the first electrode 2407 or the second electrode 2417 may be formed with a material which does not transmit light. For example, it may be formed with alkaline metals such as Li or Cs, alkaline earth metals such as Mg, Ca, or Sr, alloys containing such metals (e.g., MgAg, AlLi, or MgIn), compounds containing such metals (e.g., $CaF_2$), or rare earth metals such as Yb or Er.

A third insulating film 2408 can be formed with a similar material to that of the second insulating film 2405. The third insulating film 2408 is formed on the periphery of the first electrode 2407, so as to cover edges of the first electrode 2407, and has a function of separating light-emitting layers 2409 of adjacent pixels.

The light-emitting layer 2409 is formed in a single layer or a plurality of layers. In the case where the light-emitting layer 2409 is formed in a plurality of layers, the layers can be divided into a hole injecting layer, a hole transporting layer, a light-emitting layer, an electron transporting layer, an electron injecting layer, and the like, in terms of the carrier transporting properties. Note that the boundary between the respective layers is not necessarily clear, and there may be a case where materials forming adjacent layers are partially mixed with each other, which makes the interface between the respective layers indistinct. Each layer can be formed with an organic material or an inorganic material.

The organic material may be any one of a high molecular, medium molecular, or low molecular materials.

The light-emitting element 2415 is formed to have the light-emitting layer 2409 and the first electrode 2407 and the second electrode 2417, which overlap with each other with the light-emitting element 2409 sandwiched therebetween. One of either the first electrode 2407 or the second electrode 2417 corresponds to an anode, while the other corresponds to a cathode. When a forward-bias voltage which is higher than the threshold voltage is applied between the anode and the cathode of the light-emitting element 2415, a current flows from the anode to the cathode, and thus the light-emitting element 2415 emits light.

Figure 24B:
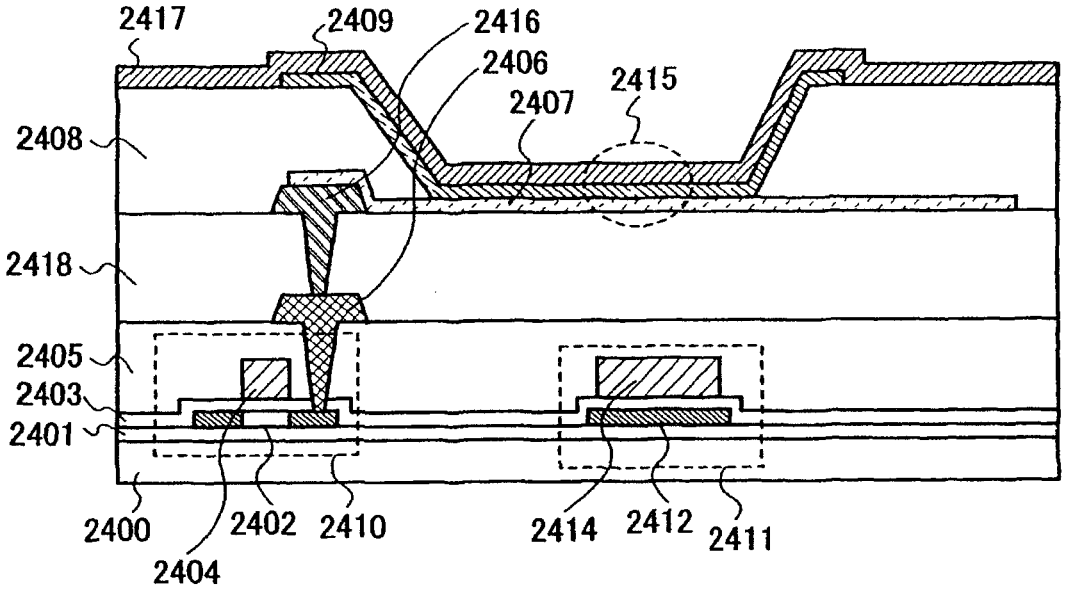

A structure of FIG. 24B is described next. Note that portions common to FIGS. 24A and 24B are denoted by common reference numerals, and thus their description will be omitted.

FIG. 24B shows a structure where another insulating film 2418 is provided between the second insulating layer 2405 and the third insulating film 2408 in FIG. 24A. The electrode 2406 and the first electrode 2407 are connected with the electrode 2416 in a contact hole provided in the insulating film 2418.

The insulating film 2418 can be formed to have a similar structure to that of the second insulating film 2405. The electrode 2416 can be formed to have a similar structure to that of the electrode 2406.

This embodiment illustrates exemplary structures of the light-emitting units shown in FIGS. 7 to 23. That is, the light-emitting units shown in FIGS. 7 to 23 can be constructed by using the TFT 2410, the capacitor 2411, and the light-emitting element 2415 shown in FIGS. 24A and 24B. Such light-emitting units can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between an output side of a source driver up to and including the pixel selected to be written with a video signal. Accordingly, power consumed by the charging and discharging of the source signal line can be reduced, and thus low power consumption can be achieved.

Embodiment 2

Figure 28A:
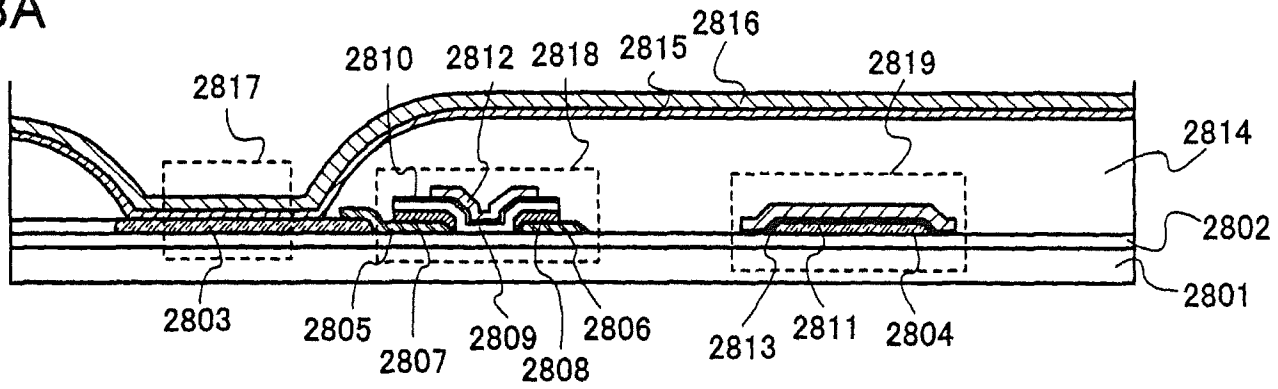
FIGS. 28A and 28B show cross sections of transistors according to Embodiment 2.
Figure 28B:
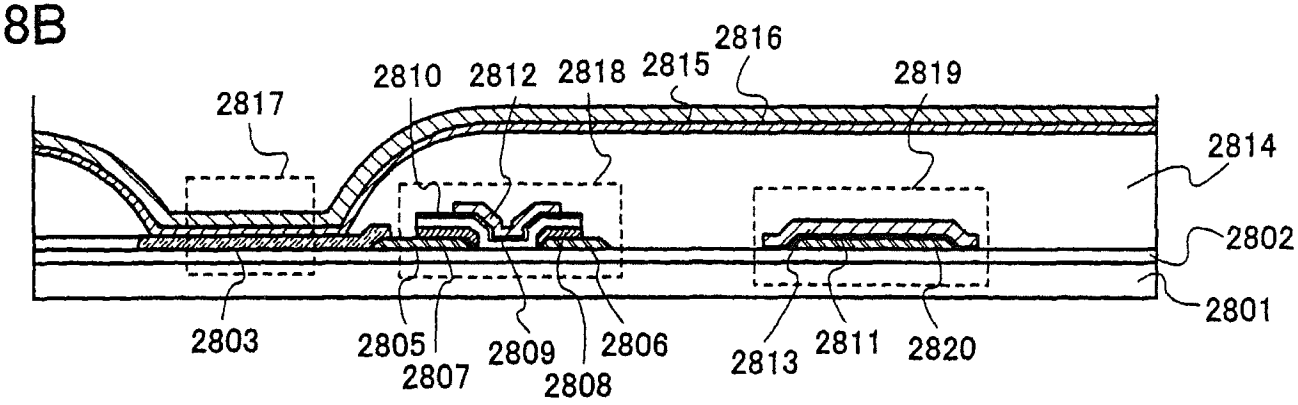

In this embodiment, description is made of a case where hydrogenated amorphous silicon (a-Si:H) is used as a semiconductor layer of a transistor. FIGS. 28A and 28B show top-gate transistors, while FIGS. 29A to 30B show bottom-gate transistors.

FIG. 28A shows a cross section of a transistor with a top-gate structure, where hydrogenated amorphous silicon is used for a semiconductor layer. As shown in FIG. 28A, a base film 2802 is formed over a substrate 2801. Further, a pixel electrode 2803 is formed over the base film 2802. In addition, a first electrode 2804 is formed with the same material and in the same layer as the pixel electrode 2803.

The substrate may be a glass substrate, a quartz substrate, a ceramic substrate, or the like. In addition, the base film 2802 may be formed with aluminum nitride (AlN), silicon oxide ($SiO_2$), silicon oxynitride ($SiO_xN_y$), and/or the like, either in a single layer or stacked layers.

Further, wires 2805 and 2806 are formed over the base film 2802, and an edge of the pixel electrode 2803 is covered with the wire 2805. N-type semiconductor layers 2807 and 2808 each having n-type conductivity are formed over the wires 2805 and 2806 respectively. In addition, a semiconductor layer 2809 is formed between the wires 2805 and 2806, and over the base film 2802. The semiconductor layer 2809 is extended to partially cover the n-type semiconductor layers 2807 and 2808. Note that the semiconductor layer 2809 is formed of an amorphous semiconductor film such as hydrogenated amorphous silicon (a-Si:H), a microcrystalline semiconductor (μ-Si:H), or the like. A gate insulating film 2810 is formed over the semiconductor layer 2809. In addition, an insulating film 2811 is formed with the same material and in the same layer as the gate insulating film 2810, over the first electrode 2804. Note that the gate insulating film 2810 is formed with a silicon oxide film, a silicon nitride film, or the like.

A gate electrode 2812 is formed over the gate insulating film 2810. In addition, a second electrode 2813 is formed with the same material and in the same layer as the gate electrode 2812, over the first electrode 2804 with the insulating film 2811 sandwiched therebetween. Thus, a capacitor 2819 is formed to have a structure where the insulating film 2811 is sandwiched between the first electrode 2804 and the second electrode 2813. In addition, an interlayer insulating film 2814 is formed covering edges of the pixel electrode 2803, a driving transistor 2818, and the capacitor 2819.

A layer 2815 containing an organic compound and a counter electrode 2816 are formed over the interlayer insulating film 2814 and the pixel electrode 2803 positioned in an opening of the interlayer insulating film 2814. Thus, a light-emitting element 2817 is formed in a region where the layer 2815 containing an organic compound is sandwiched between the pixel electrode 2803 and the counter electrode 2816.

The first electrode 2804 shown in FIG. 28A may be replaced with a first electrode 2820 as shown in FIG. 28B. The first electrode 2820 is formed of the same material and in the same layer as the wires 2805 and 2806.

Figure 29A:
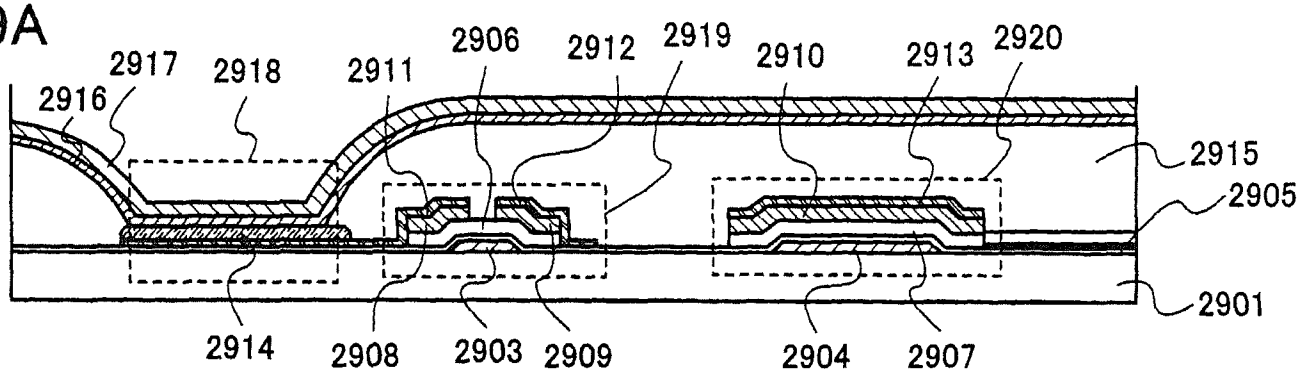
FIGS. 29A and 29B show cross sections of transistors according to Embodiment 2.
Figure 29B:
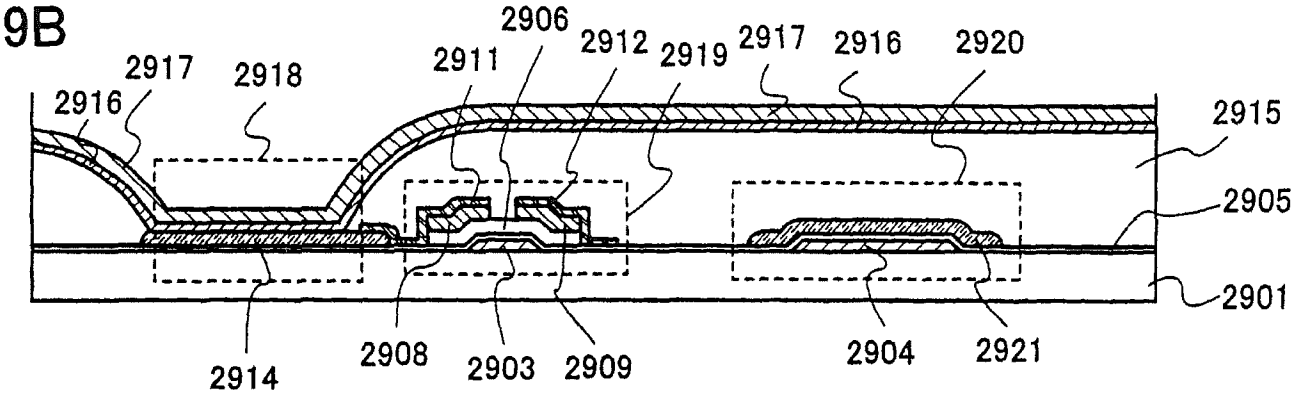

FIGS. 29A and 29B show partial cross sections of a panel of a semiconductor device which has a bottom-gate transistor using hydrogenated amorphous silicon for its semiconductor layer.

A gate electrode 2903 is formed over a substrate 2901. In addition, a first electrode 2904 is formed with the same material and in the same layer as the gate electrode 2903. As a material of the gate electrode 2903, polycrystalline silicon doped with phosphorus can be used. Silicide which is a compound of a metal and silicon may be used as well as the polycrystalline silicon.

In addition, a gate insulating film 2905 is formed covering the gate electrode 2903 and the first electrode 2904. The gate insulating film 2905 is formed with a silicon oxide film, a silicon nitride film, or the like.

A semiconductor layer 2906 is formed over the gate insulating film 2905. In addition, a semiconductor layer 2907 is formed with the same material and in the same layer as the semiconductor layer 2906. The substrate may be any of a glass substrate, a quartz substrate, a ceramic substrate, and the like.

N-type semiconductor layers 2908 and 2909 each having n-type conductivity are formed over the semiconductor layer 2906, while an n-type semiconductor layer 2910 is formed over the semiconductor layer 2907.

Wires 2911 and 2912 are formed over the n-type semiconductor layers 2908 and 2909 respectively, and a conductive layer 2913 is formed with the same material and in the same layer as the wires 2911 and 2912, over the n-type semiconductor layer 2910.

A second electrode is formed to have the semiconductor layer 2907, the n-type semiconductor layer 2910, and the conductive layer 2913. Note that a capacitor 2920 is formed to have a structure where the gate insulating film 2905 is sandwiched between the second electrode and the first electrode 2904.

In addition, an edge of the wire 2911 is extended, and a pixel electrode 2914 is formed in contact with the top surface of the extended portion of the wire 2911.

An insulating layer 2915 is formed covering edges of the pixel electrode 2914, a driving transistor 2919, and the capacitor 2920.

A layer 2916 containing an organic compound and a counter electrode 2917 are formed over the pixel electrode 2914 and the insulating layer 2915, and a light-emitting element 2918 is formed in a region where the layer 2916 containing an organic compound is sandwiched between the pixel electrode 2914 and the counter electrode 2917.

The semiconductor layer 2907 and the n-type semiconductor layer 2910 which partially function as a second electrode of the capacitor are not necessarily provided. That is, the conductive layer 2913 may be used as the second electrode, so that a capacitor is provided with a structure where a gate insulating film is sandwiched between the first electrode 2904 and the conductive layer 2913.

Note that if the pixel electrode 2914 is formed before forming the wire 2911 shown in FIG. 29A, a capacitor 2920 as shown in FIG. 29B can be formed, which has a structure where the gate insulating film 2905 is sandwiched between the first electrode 2904 and a second electrode 2921 formed of the same material and in the same layer as the pixel electrode 2914.

Although FIGS. 29A and 29B show examples of an inversely staggered transistor with a channel-etched structure, a transistor with a channel-protected structure may be employed as well. Next, description is made of a transistor with a channel-protected structure, with reference to FIGS. 30A and 30B.

Figure 30A:
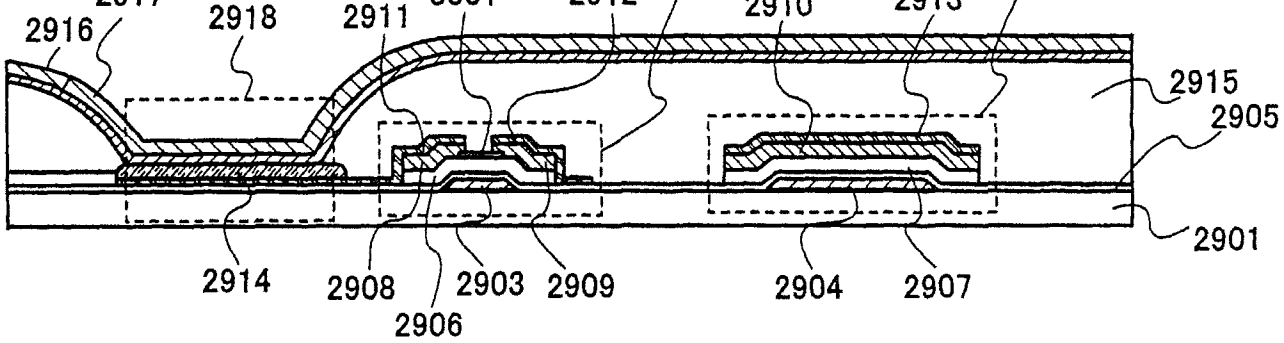
FIGS. 30A and 30B show cross sections of transistors according to Embodiment 2.

A transistor with a channel-protected structure shown in FIG. 30A differs from the driving transistor 2919 with a channel-etched structure shown in FIG. 29A in that an insulating layer 3001 serving as an etching mask is provided over a channel formation region in the semiconductor layer 2906. Portions common to FIGS. 29A and 30A are denoted by common reference numerals.

Figure 30B:
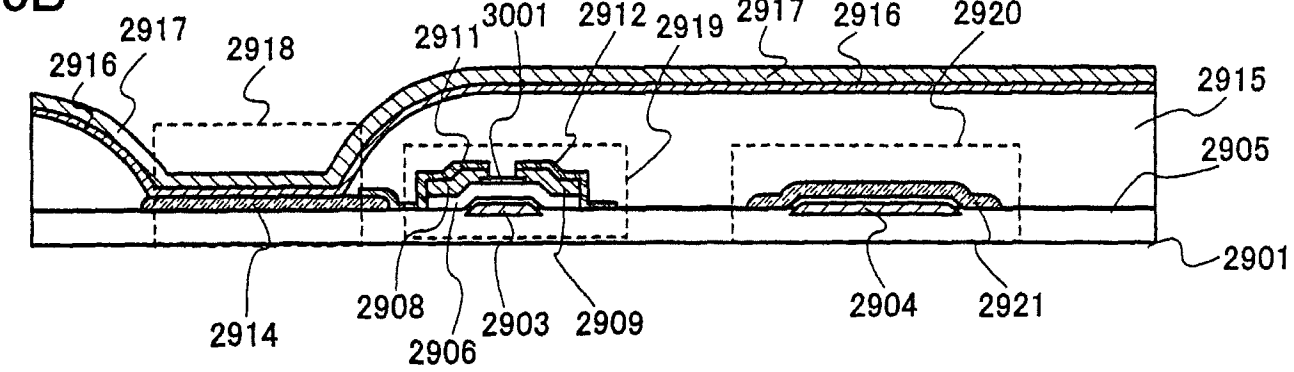

Similarly, a transistor with a channel-protected structure shown in FIG. 30B differs from the driving transistor 2919 with a channel-etched structure shown in FIG. 29B in that an insulating layer 3001 serving as an etching mask is provided over a channel formation region in the semiconductor layer 2906. Portions common to FIGS. 29B and 30B are denoted by common reference numerals.

By using an amorphous semiconductor film for a semiconductor layer (e.g., a channel formation region, a source region, or a drain region) of a transistor which is one constituent element of a pixel of the invention, manufacturing cost can be reduced. For example, an amorphous semiconductor film can be used in the case of using the pixel structure shown in FIGS. 28A to 30B.

Note that the structures of transistors or capacitors to which the pixel structure of the invention can be applied are not limited to the structures described above, and various structures of transistors or capacitors can be employed.

FIGS. 28A and 28B show structures of top-gate transistors, while FIGS. 29A to 30B show structures of bottom-gate transistors. This embodiment illustrates exemplary structures of the light-emitting units shown in FIGS. 7 to 23. That is, the light-emitting units shown in FIGS. 7 to 23 can be constructed by using the driving transistor 2818, the capacitor 2819, and the light-emitting element 2817 shown in FIGS. 28A and 28B, or the driving transistor 2929, the capacitor 2920, and the light-emitting element 2918 shown in FIGS. 29A to 30B. Such light-emitting units can be applied to the light-emitting unit 104 shown in FIG. 1, the light-emitting unit 204 shown in FIG. 2, the light-emitting unit 304 shown in FIG. 3, the light-emitting unit 404 shown in FIG. 4, the light-emitting unit 504 shown in FIG. 5, and the light-emitting unit 604 shown in FIG. 6. Accordingly, the parasitic capacitance of the source signal line which stores and releases electric charges affects only pixels between an output side of a source driver up to and including the pixel selected to be written with a video signal. Accordingly, power consumed by the charging and discharging of the source signal line can be reduced, and thus low power consumption can be achieved.

Embodiment 3

In this embodiment, description is made of a method of manufacturing a semiconductor device using plasma treatment, as a manufacturing method of a transistor applicable to Embodiments 1 and 2.

Figure 31A:
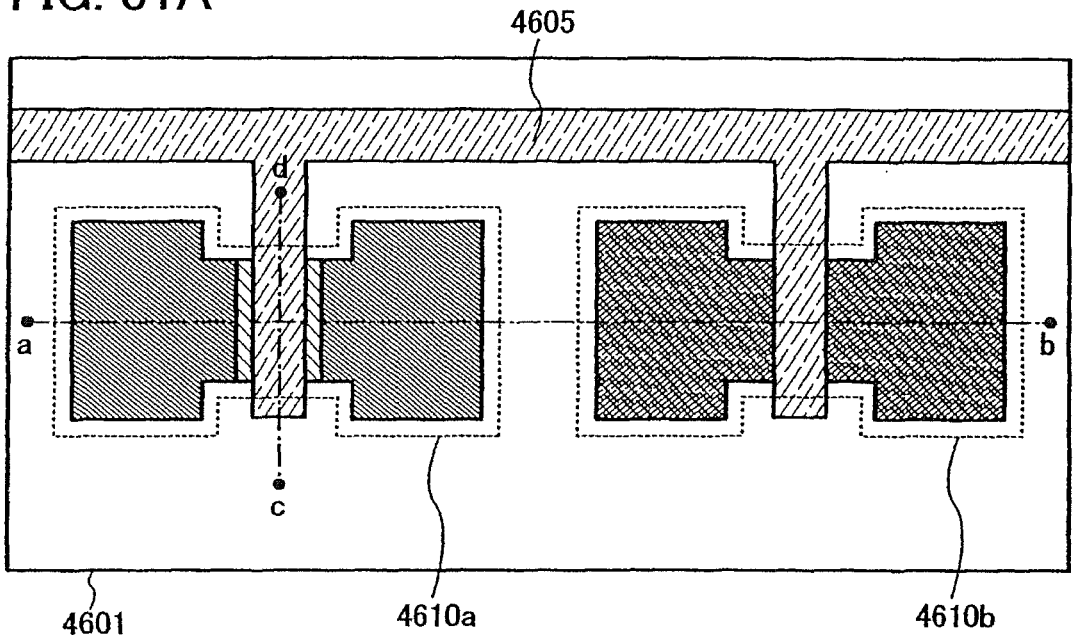
FIG. 31A is a top view of a semiconductor device, and each of FIGS. 31B and 31C is a cross section taken along a line of FIG. 31A according to Embodiment 3.
Figure 31B:
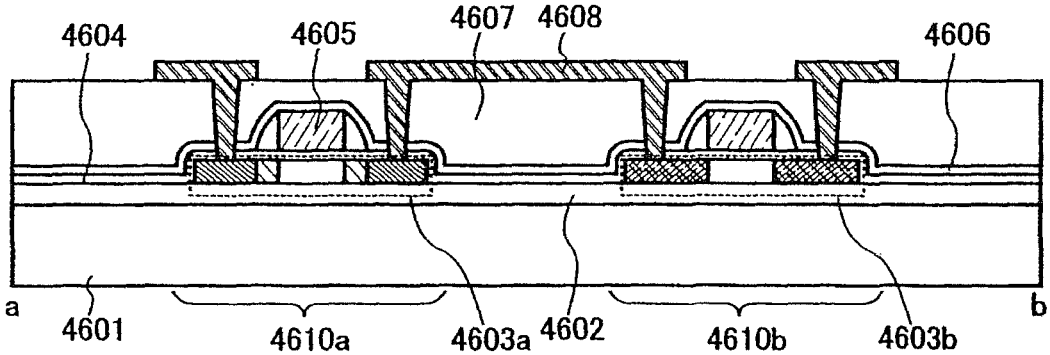
Figure 31C:
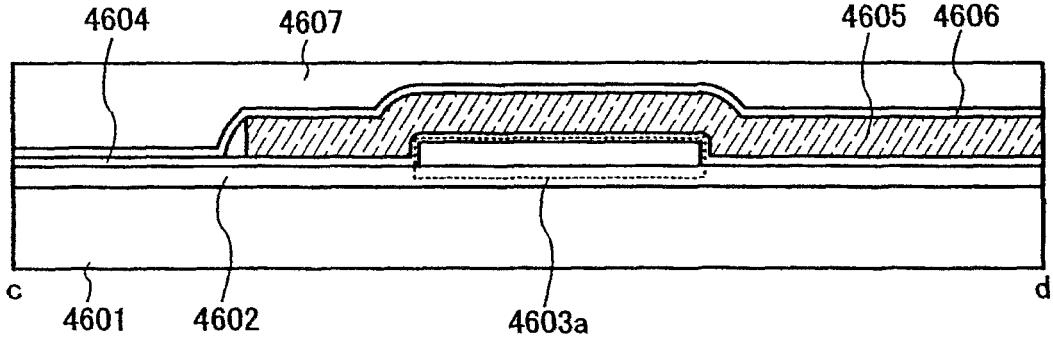

FIGS. 31A to 31C show exemplary structures of a semiconductor device including transistors. Note that FIG. 31B corresponds to a cross section taken along a line a-b in FIG. 31A, while FIG. 31C corresponds to a cross section taken along a line c-d in FIG. 31A.

The semiconductor device shown in FIGS. 31A to 31C includes semiconductor films 4603*a* and 4603*b* provided over a substrate 4601 with an insulating film 4602 sandwiched therebetween, gate electrodes 4605 provided over the semiconductor films 4603*a* and 4603*b* with a gate insulating layer 4604 sandwiched therebetween, insulating films 4606 and 4607 provided to cover the gate electrodes 4605, and a conductive film 4608 provided over the insulating film 4607 in a manner electrically connected to a source region or a drain region of the semiconductor films 4603*a* and 4603*b*. Although FIGS. 31A to 31C show a case of providing an n-channel transistor 4610*a* which uses a part of the semiconductor film 4603*a* as a channel region, and a p-channel transistor 4610*b* which uses a part of the semiconductor film 4603*b* as a channel region, the invention is not limited to such a structure. For example, although the n-channel transistor 4610*a* is provided with LDD regions, while the p-channel transistor 4610*b* is not provided with LDD regions in FIGS. 31A to 31C, a structure where both of the transistors are provided with LDD regions may be employed as well as a structure where neither of the transistors is provided with LDD regions.

In this embodiment mode, the semiconductor device shown in FIGS. 31A to 31C is manufactured by oxidizing or nitriding a semiconductor film or an insulating film, that is, by performing plasma oxidation or nitridation treatment to at least one layer among the substrate 4601, the insulating film 4602, the semiconductor films 4603*a* and 4603*b*, the gate insulating film 4604, the insulating film 4606, and the insulating film 4607. In this manner, by oxidizing or nitriding a semiconductor film or an insulating film by plasma treatment, the surface of the semiconductor film or the insulating film can be modified, thereby a denser insulating film can be formed, compared with an insulating film formed by CVD or sputtering. Therefore, defects such as pin holes can be suppressed, and thus the characteristics and the like of the semiconductor device can be improved.

In this embodiment, description is made of a method of manufacturing a semiconductor device by oxidizing or nitriding the semiconductor films 4603*a* and 4603*b* or the gate insulating film 4604 shown in FIGS. 31A to 31C by plasma treatment, with reference to the drawings. Note that FIG. 32A1 to 32D1 each correspond to a cross section taken along a line a-b in FIG. 31A, while FIG. 32A2 to 32D2 each correspond to a cross section taken along a line c-d in FIG. 31A.

First, description is made of a case of providing a semiconductor film with an island shape over the substrate, to have an edge of about 90 degrees.

First, the semiconductor films 4603*a* and 4603*b* with island shapes are formed over the substrate 4601 (FIGS. 32A1 and 32A2). The island-shaped semiconductor films 4603*a* and 4603*b* can be provided by forming an amorphous semiconductor film by sputtering, LPCVD, plasma CVD, or the like, using a material containing silicon (Si) as a main component (e.g., $Si_xGe_{1-x}$) over the insulating film 4602 which is formed in advance over the substrate 4601, and then crystallizing the amorphous semiconductor film, and further etching the semiconductor film selectively. Note that crystallization of the amorphous semiconductor film can be performed by laser crystallization, thermal crystallization using RTA or an annealing furnace, thermal crystallization using metal elements which promote crystallization, or a combination of these methods. Note that in FIGS. 32A1 and 32A2, the island-shaped semiconductor films 4603*a* and 4603*b* are each formed to have an edge with about 90 degrees (θ=85 to 100 degrees).

Next, the semiconductor films 4603*a* and 4603*b* are oxidized or nitrided by plasma treatment to form oxide or nitride films 4621*a* and 4621*b* (hereinafter also called insulating films 4621*a* and 4621*b*) on the surfaces of the semiconductor films 4603*a* and 4603*b* respectively (FIGS. 32B1 and 32B2). For example, when Si is used for the semiconductor films 4603*a* and 4603*b*, silicon oxide ($SiO_x$) or silicon nitride ($SiN_x$) is formed as the insulating films 4621*a* and 4621*b*. Further, after being oxidized by plasma treatment, the semiconductor films 4603*a* and 4603*b* may be subjected to plasma treatment again, so as to be nitrided. In this case, silicon oxide ($SiO_x$) is formed on the semiconductor films 4603*a* and 4604*b* first, and then silicon nitride oxide ($SiN_xO_y$) (x>y) is formed on the surface of the silicon oxide. Note that in the case of oxidizing the semiconductor film by plasma treatment, the plasma treatment is performed under an oxygen atmosphere (e.g., an atmosphere containing oxygen ($O_2$) and a rare gas (at least one of He, Ne, Ar, Kr, and Xe), an atmosphere containing oxygen, hydrogen ($H_2$), and a rare gas, or an atmosphere containing nitrous oxide and a rare gas). Meanwhile, in the case of nitriding the semiconductor film by plasma treatment, the plasma treatment is performed under a nitrogen atmosphere (e.g., an atmosphere containing nitrogen ($N_2$) and a rare gas (at least one of He, Ne, Ar, Kr, and Xe), an atmosphere containing nitrogen, hydrogen, and a rare gas, or an atmosphere containing $NH_3$ and a rare gas). As the rare gas, Ar can be used, for example. Alternatively, a mixed gas of Ar and Kr may be used. Therefore, the insulating films 4621*a* and 4621*b* contain the rare gas (at least one of He, Ne, Ar, Kr, and Xe) used in the plasma treatment, and in the case where Ar is used, the insulating films 4621*a* and 4621*b* contain Ar.

The plasma treatment is performed in the atmosphere containing the aforementioned gas, with the conditions of a plasma electron density ranging from $1\times10^{11}$ to $1\times10^{13}$ $cm^{-3}$, and a plasma electron temperature ranging from 0.5 to 1.5 eV. Since the plasma electron density is high and the electron temperature in the vicinity of the treatment subject (here, the semiconductor films 4603*a* and 4603*b*) formed over the substrate 4601 is low, plasma damage to the subject of treatment can be prevented. In addition, since the plasma electron density is as high as $1\times10^{11}$ $cm^{-3}$ or more, an oxide or nitride film formed by oxidizing or nitriding the treatment subject by plasma treatment is superior in its uniform thickness and the like, as well as being dense, compared with a film formed by CVD, sputtering, or the like. Further, since the plasma electron temperature is as low as 1 eV, oxidation or nitridation treatment can be performed at a lower temperature, compared with the conventional plasma treatment or thermal oxidation. For example, oxidation or nitridation treatment can be performed sufficiently even when plasma treatment is performed at a temperature lower than the strain point of a glass substrate by 100 degrees or more. Note that as a frequency for generating plasma, high frequencies such as microwaves (2.45 GHz) can be used. Note also that the plasma treatment is to be performed using the aforementioned conditions unless otherwise specified.

Next, the gate insulating film 4604 is formed so as to cover the insulating films 4621*a* and 4621*b* (FIGS. 32C1 and 32C2). The gate insulating film 4604 can be formed by sputtering, LPCVD, plasma CVD, or the like, to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y). For example, when Si is used for the semiconductor films 4603*a* and 4603*b*, and the Si is oxidized by plasma treatment to form silicon oxide as the insulating films 4621*a* and 4621*b* on the surfaces of the semiconductor films 4603*a* and 4603*b*, silicon oxide ($SiO_x$) is formed as a gate insulating film on the insulating films 4621*a* and 4621*b*. In addition, referring to FIGS. 32B1 and 32B2, if the insulating films 4621*a* and 4621*b* formed by oxidizing or nitriding the semiconductor films 4603*a* and 4603*b* by plasma treatment are sufficiently thick, the insulating films 4621*a* and 4621*b* can be used as the gate insulating film.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIGS. 32Da and 32D2).

In this manner, by oxidizing or nitriding the surfaces of the semiconductor films 4603*a* and 4603*b* by plasma treatment before providing the gate insulating film 4604 over the semiconductor films 4603*a* and 4603*b*, short circuits or the like between the gate electrodes and the semiconductor films, which would otherwise be caused by coverage defects of the gate insulating film 4604 at edges 4651*a* and 4651*b* of the channel regions, can be prevented. That is, if the edges of the island-shaped semiconductor films have an angle of about 90 degrees (θ=85 to 100 degrees), there is a concern that the edges of the semiconductor films might not be properly covered with a gate insulating film. However, such coverage defects or the like of the gate insulating film at the edges of the semiconductor films can be prevented by oxidizing or nitriding the surfaces of the semiconductor films by plasma treatment in advance.

Alternatively, referring to FIGS. 32C1 and 32C2, the gate insulating film 4604 may be oxidized or nitrided by performing plasma treatment after forming the gate insulating film 4604. In this case, an oxide or nitride film (hereinafter also referred to as an insulating film 4623) is formed on the surface of the gate insulating film 4604 (FIGS. 33B1 and 33B2) by oxidizing or nitriding the gate insulating film 4604 by performing plasma treatment to the gate insulating film 4604 which is formed to cover the semiconductor films 4603*a* and 4603*b* (FIGS. 33A1 and 33A2). The plasma treatment can be performed using similar conditions to those in FIGS. 32B1 and 32B2. In addition, the insulating film 4623 contains a rare gas which is used in the plasma treatment, and for example contains Ar if Ar is used for the plasma treatment.

Alternatively, referring to FIGS. 33B1 and 33B2, after oxidizing the gate insulating film 4604 by performing plasma treatment under an oxygen atmosphere, the gate insulating film 4604 may be subjected to plasma treatment again under a nitrogen atmosphere, so as to be nitrided. In this case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed to be in contact with the gate electrodes 4605. After that, by forming the gate electrodes 4605 or the like over the insulating film 4623, a semiconductor device having the n-channel transistor 4610*a* and the p-channel transistor 4610*b* which respectively have the island-shaped semiconductor films 4603*a* and 4603*b* as channel regions can be manufactured (FIGS. 33C1 and 33C2). In this manner, by oxidizing or nitriding the surface of the gate insulating film by plasma treatment, the surface of the gate insulating film can be modified to form a dense film. The insulating film obtained by plasma treatment is denser and has few defects such as pin holes, compared with an insulating film formed by CVD or sputtering. Therefore, the characteristics of the transistors can be improved.

Although FIGS. 33A1 to 33C2 show the case where the surfaces of the semiconductor films 4603*a* and 4603*b* are oxidized or nitrided by performing plasma treatment to the semiconductor films 4603*a* and 4603*b* in advance, a method where plasma treatment is not performed to the semiconductor films 4603*a* and 4603*b*, but plasma treatment is performed after forming the gate insulating film 4604 may be employed. In this manner, by performing plasma treatment before forming a gate electrode, a semiconductor film can be oxidized or nitrided even if the semiconductor film is exposed due to a coverage defect such as breaking of a gate insulating film at edges of the semiconductor film; therefore, short circuits or the like between the gate electrode and the semiconductor film, which would otherwise be caused by a coverage defect of the gate insulating film at the edges of the semiconductor film, can be prevented.

In this manner, by oxidizing or nitriding the semiconductor films or the gate insulating film by plasma treatment, short circuits or the like between the gate electrodes and the semiconductor films, which would otherwise be caused by a coverage defect of the gate insulating film at the edges of the semiconductor films, can be prevented, even if the island-shaped semiconductor films are formed to have edges with an angle of about 90 degrees.

Next, a case is shown where the island-shaped semiconductor films formed over the substrate are provided with tapered edges (θ=30 to 85 degrees).

First, the island-shaped semiconductor films 4603*a* and 4603*b* are formed over the substrate 4601 (FIGS. 34A1 and 34A2). The island-shaped semiconductor films 4603*a* and 4603*b* can be provided by forming an amorphous semiconductor film over the insulating film 4602 which is formed over the substrate 4601 in advance, by sputtering, LPCVD, plasma CVD, or the like, using a material containing silicon (Si) as a main component (e.g., $Si_xGe_{1-x}$), and then crystallizing the amorphous semiconductor film. Crystallization of the amorphous semiconductor film is performed by laser crystallization, thermal crystallization using RTA or an annealing furnace, or thermal crystallization using metal elements which promote crystallization. Note that in FIGS. 34A1 and 34A2, the island-shaped semiconductor films are etched to have tapered edges (θ=30 to 85 degrees).

Next, the gate insulating film 4604 is formed so as to cover the semiconductor films 4603*a* and 4603*b* (FIGS. 34B1 and 34B2). The gate insulating film 4604 can be provided to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y) by sputtering, LPCVD, plasma CVD, or the like.

Next, an oxide or nitride film (hereinafter also referred to as an insulating film 4624) is formed on the surface of the gate insulating film 4604 by oxidizing or nitriding the gate insulating film 4604 by plasma treatment (FIGS. 34C1 and 34C2). The plasma treatment can be performed using similar conditions to the aforementioned ones. For example, if silicon oxide ($SiO_x$) or silicon oxynitride ($SiO_xN_y$) (x>y) is used as the gate insulating film 4604, the gate insulating film 4604 is oxidized by performing plasma treatment under an oxygen atmosphere, thereby a dense insulating film with few defects such as pin holes can be formed on the surface of the gate insulating film, compared with a gate insulating film formed by CVD, sputtering, or the like. On the other hand, if the gate insulating film 4604 is nitrided by plasma treatment under a nitrogen atmosphere, silicon nitride oxide ($SiN_xO_y$) (x>y) can be provided as the insulating film 4624 on the surface of the gate insulating film 4604. Alternatively, after oxidizing the gate insulating film 4604 by performing plasma treatment under an oxygen atmosphere, the gate insulating film 4604 may be subjected to plasma treatment again under a nitrogen atmosphere, so as to be nitrided. In addition, the insulating film 4624 contains a rare gas which is used in the plasma treatment, and for example contains Ar if Ar is used in the plasma treatment.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIGS. 34D1 and 34D2).

In this manner, by performing plasma treatment to the gate insulating film, an insulating film made of an oxide or nitride film can be provided on the surface of the gate insulating film, and thus the surface of the gate insulating film can be modified. The insulating film obtained by oxidation or nitridation with plasma treatment is denser and has few defects such as pin holes, compared with a gate insulating film formed by CVD or sputtering; therefore, the characteristics of the transistors can be improved. In addition, while short circuits or the like between the gate electrodes and the semiconductor films, which would otherwise be caused by a coverage defect of the gate insulating film at the edges of the semiconductor films, can be prevented by forming the semiconductor films to have tapered edges, short circuits or the like between the gate electrodes and the semiconductor films can be prevented even more effectively by performing plasma treatment after forming the gate insulating film.

Next, description is made of a manufacturing method of a semiconductor device which differs from that in FIGS. 34A1 to 34D2, with reference to the drawings. Specifically, a case is shown where plasma treatment is selectively performed to semiconductor films having tapered edges.

First, the island-shaped semiconductor films 4603*a* and 4603*b* are formed over the substrate 4601 (FIGS. 35A1 and 35A2). The island-shaped semiconductor films 4603*a* and 4603*b* can be provided by forming an amorphous semiconductor film over the insulating film 4602 which is formed over the substrate 4601 in advance, by sputtering, LPCVD, plasma CVD, or the like, using a material containing silicon (Si) as a main component (e.g., $Si_xGe_{1-x}$) or the like, and crystallizing the amorphous semiconductor film. Resists 4625*a* and 4625*b* are used for etching the semiconductor film into island shapes. Note that crystallization of the amorphous semiconductor film can be performed by laser crystallization, thermal crystallization using RTA or an annealing furnace, thermal crystallization using metal elements which promote crystallization, or a combination of these methods.

Next, the edges of the island-shaped semiconductor films 4603*a* and 4603*b* are selectively oxidized or nitrified by plasma treatment before removing the resists 4625*a* and 4625*b* which are used for etching the semiconductor films, thereby an oxide or nitride film (hereinafter also referred to as an insulating film 4626) is formed on each edge of the semiconductor films 4603*a* and 4603*b* (FIGS. 35B1 and 35B2). The plasma treatment is performed using the aforementioned conditions. In addition, the insulating film 4626 contains a rare gas which is used in the plasma treatment.

Next, the gate insulating film 4604 is formed to cover the semiconductor films 4603*a* and 4603*b* (FIGS. 35C1 and 35C2). The gate insulating film 4604 can be formed in a similar manner to the aforementioned one.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIGS. 35D1 and 35D2).

If the semiconductor films 4603*a* and 4603*b* are provided with tapered edges, edges 4652*a* and 4652*b* of the channel regions which are formed in parts of the semiconductor films 4603*a* and 4603*b* are also tapered, thereby the thickness of the semiconductor films and the gate insulating film in that portion differs from that in the central portion, which may adversely affect the characteristics of the transistors. However, such effects on the transistors due to the edges of the channel regions can be reduced by forming insulating films on the edges of the semiconductor films, namely, the edges of the channel regions, by selectively oxidizing or nitriding the edges of the channel regions by plasma treatment here.

Although FIGS. 35A1 to 35D2 show an example where only the edges of the semiconductor films 4603*a* and 4603*b* are oxidized or nitrided by plasma treatment, the gate insulating film 4604 can also be oxidized or nitrided by plasma treatment to form the insulating film 4624, as shown in FIGS. 34C1 and 34C2 (FIGS. 37A1 and 37A2).

Next, description is made of a manufacturing method of a semiconductor device which differs from the aforementioned manufacturing method, with reference to the drawings. Specifically, a case is shown where plasma treatment is performed to semiconductor films with tapered shapes.

First, the island-shaped semiconductor films 4603*a* and 4603*b* are formed over the substrate 4601 in a similar manner to the aforementioned one (FIGS. 36A1 and 36A2).

Next, the semiconductor films 4603*a* and 4603*b* are oxidized or nitrided by plasma treatment, thereby forming oxide or nitride films (hereinafter also referred to as insulating films 4627*a* and 4627*b*) on the respective surfaces of the semiconductor films 4603*a* and 4603*b* (FIGS. 36B1 and 36B2). The plasma treatment can be similarly performed with the aforementioned conditions. For example, when Si is used for the semiconductor films 4603*a* and 4603*b*, silicon oxide ($SiO_x$) or silicon nitride ($SiN_x$) is formed as the insulating films 4627*a* and 4627*b*. In addition, after oxidizing the semiconductor films 4603*a* and 4603*b* by plasma treatment, the semiconductor films 4603*a* and 4603*b* may be subjected to plasma treatment again, so as to be nitrided. In this case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed on the surface of the silicon oxide or the silicon oxynitride. Therefore, the insulating films 4627*a* and 4627*b* contain a rare gas which is used in the plasma treatment. Note that the edges of the semiconductor films 4603*a* and 4603*b* are concurrently oxidized or nitrided by performing plasma treatment.

Next, the gate insulating film 4604 is formed to cover the insulating films 4627*a* and 4627*b* (FIGS. 36C1 and 36C2). The gate insulating film 4604 can be formed to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y) by sputtering, LPCVD, plasma CVD, or the like. For example, when Si is used for the semiconductor films 4603*a* and 4603*b*, and the surfaces of the semiconductor films 4603*a* and 4603*b* are oxidized by plasma treatment to form silicon oxide as the insulating films 4627 and 4627*b*, silicon oxide ($SiO_x$) is formed as a gate insulating film over the insulating films 4627*a* and 4627*b*.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIGS. 36D1 and 36D2).

If the semiconductor films are provided with tapered edges, edges of the channel regions which are formed in parts of the semiconductor films are also tapered, which might adversely affect the characteristics of the semiconductor elements. However, such effects on the semiconductor elements can be reduced by oxidizing or nitriding the semiconductor films by plasma treatment, since the edges of the channel regions can be also oxidized or nitrided accordingly.

Although FIGS. 36A1 to 36D2 show an example where only the semiconductor films 4603*a* and 4603*b* are oxidized or nitrided by plasma treatment, it is needless to say that the gate insulating film 4604 may be oxidized or nitrided by plasma treatment as shown in FIGS. 34C1 and 34C2 so as to form the insulating film 4624 (FIGS. 37B1 and 37B2). In this case, after oxidizing the gate insulating film 4604 by plasma treatment under an oxygen atmosphere, the gate insulating film 4604 may be subjected to plasma treatment again to be nitrided. In such a case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed to be in contact with the gate electrodes 4605.

Although this embodiment shows an example where plasma treatment is performed to the semiconductor films 4603*a* and 4603*b* or the gate insulating film 4604 shown in FIGS. 31A to 31C so as to oxidize or nitride the semiconductor films 4603*a* and 4603*b* or the gate insulating film 4604, a layer to be subjected to the oxidation or nitridation by plasma treatment is not limited to these. For example, plasma treatment may be performed to the substrate 4601 or the insulating film 4602, or to the insulating film 4607.

Note that this embodiment can be implemented by freely combining it with Embodiment 1 or 2.

Embodiment 4

In this embodiment, description is made of a halftone process as a manufacturing method of a transistor which is applicable to Embodiments 1 and 2.

Figure 38:
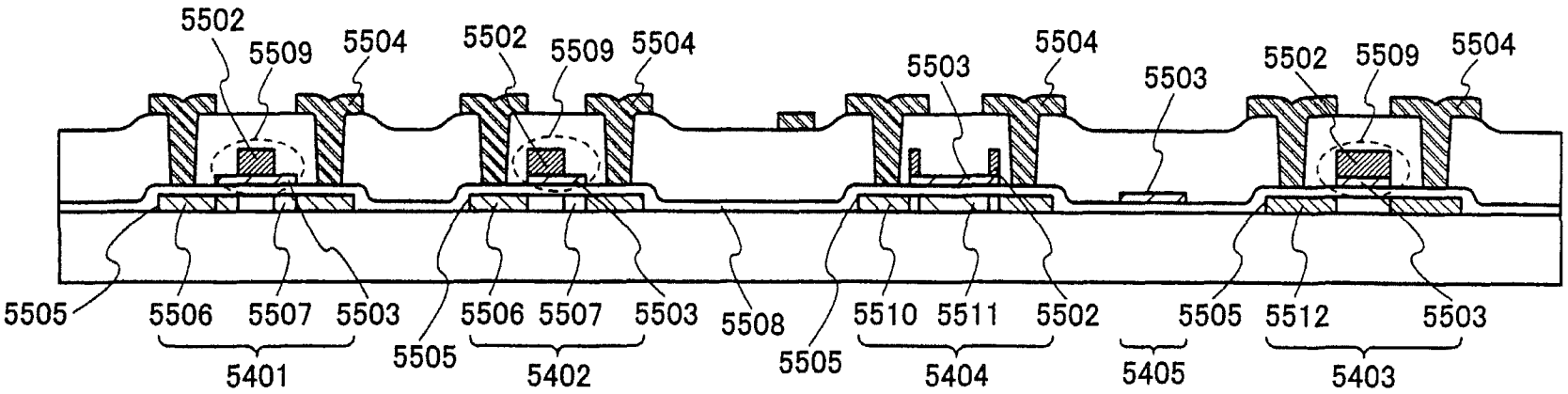
FIG. 38 shows a semiconductor device according to Embodiment 4.

FIG. 38 shows a cross-sectional structure of a semiconductor device including transistors, a capacitor, and a resistor. FIG. 38 shows n-channel transistors 5401 and 5402, a capacitor 5404, a resistor 5405, and a p-channel transistor 5403. Each transistor and a the resistor has a semiconductor layer 5505 and an insulating layer 5508, and each transistor further has a gate electrode 5509. The gate electrode 5509 is formed to have a stacked structure of a first conductive layer 5503 and a second conductive layer 5502. FIGS. 39A to 39E are top views of the transistors, the capacitor, and the resistor shown in FIG. 38, which can be referred to in conjunction with FIG. 38.

Referring to FIG. 38, the n-channel transistor 5401 has impurity regions 5507 (also called lightly doped drain: LDD regions) in the semiconductor layer 5505, which are doped with impurities at a lower concentration than impurity regions 5506 which form source and drain regions. In forming the n-channel transistor 5401, the impurity regions 5506 and 5507 are doped with phosphorus as impurities which impart n-type conductivity. The LDD regions are formed in order to suppress hot-electron degradation and short-channel effects.

Figure 39A:
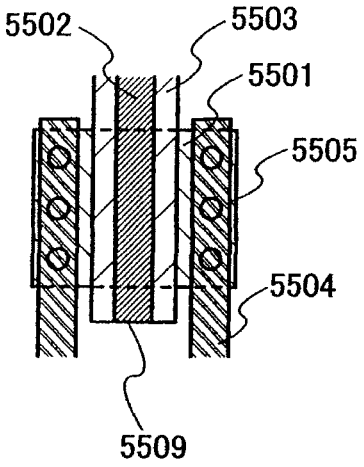
FIGS. 39A to 39E show elements in the semiconductor device according to Embodiment 4.

As shown in FIG. 39A, the first conductive layer 5503 is formed wider than each side of the second conductive layer 5502 in the gate electrode 5509 of the n-channel transistor 5401. In this case, the first conductive layer 5503 is formed thinner than the second conductive layer 5502. The first conductive layer 5503 is formed to have a thickness enough for ion species which are accelerated with an electric field of 10 to 100 kV to travel through. The impurity regions 5507 are formed to overlap with the first conductive layer 5503 of the gate electrode 5509. That is, LDD regions which overlap with the gate electrode 5509 are formed. In this structure, the impurity regions 5507 are formed in a self-aligned manner by doping the semiconductor layer 5505 with impurities having one conductivity type through the first conductive layer 5503 of the gate electrode 5509, using the second conductive layer 5502 as a mask. That is, the LDD regions which overlap with the gate electrode are formed in a self-aligned manner.

Figure 39B:
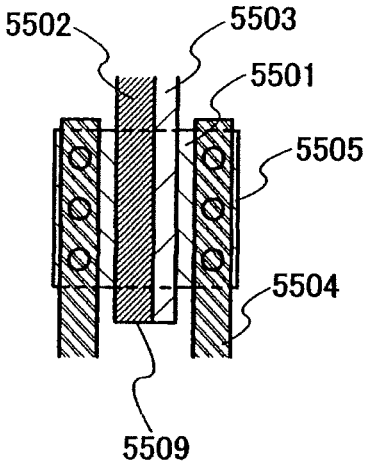

Referring again to FIG. 38, the n-channel transistor 5402 has the impurity region 5507 on one side of the impurity region 5506 in the semiconductor layer 5505, which is doped with impurities at a lower concentration than the impurity region 5506. As shown in FIG. 39B, the first conductive layer 5503 is formed wider than one side of the second conductive layer 5502 in the gate electrode 5509 of the n-channel transistor 5402. In this case also, an LDD region can be formed in a self-aligned manner by doping the semiconductor layer 5505 with impurities having one conductivity type through the first conductive layer 5503 using the second conductive layer 5502 as a mask.

A transistor having an LDD region on one side of the impurity region 5506 may be used as a transistor where only a positive voltage or a negative voltage is applied between source and drain electrodes. Specifically, such a transistor may be applied to a transistor which partially constitutes a logic gate such as an inverter circuit, a NAND circuit, a NOR circuit, or a latch circuit, or a transistor which partially constitutes an analog circuit such as a sense amplifier, a constant voltage generation circuit, or a VCO.

Figure 39C:
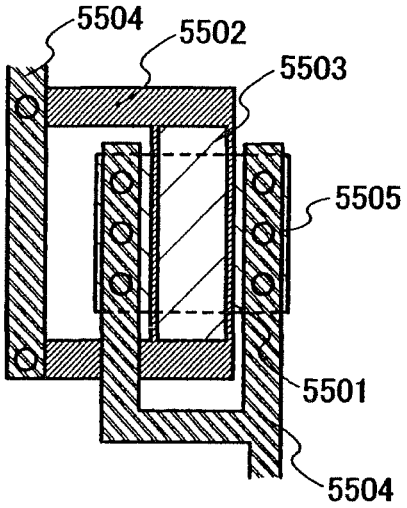

Referring again to FIG. 38, the capacitor 5404 is formed by sandwiching the insulating layer 5508 with the first conductive layer 5503 and the semiconductor layer 5505. The semiconductor layer 5505 for forming the capacitor 5404 is provided with impurity regions 5510 and 5511. The impurity region 5511 is formed in the semiconductor layer 5505 in a position overlapping only with the first conductive layer 5503. The impurity region 5510 forms a contact with the wire 5504. The impurity region 5511 can be formed by doping the semiconductor layer 5505 with impurities having one conductivity type through the first conductive layer 5503; therefore, the concentration of impurities having one conductivity type which are contained in the impurity regions 5510 and 5511 can be set either the same or different. In either case, since the semiconductor layer 5505 in the capacitor 5404 functions as an electrode, it is preferably lowered in resistance by adding impurities with one conductivity type thereto. Further, the first conductive layer 5503 can fully function as an electrode by utilizing the second conductive layer 5502 as an auxiliary electrode as shown in FIG. 39C. In this manner, by forming a composite electrode structure where the first conductive layer 5503 and the second conductive layer 5502 are combined, the capacitor 5404 can be formed in a self-aligned manner.

Referring again to FIG. 38, the resistor 5405 is formed of the first conductive layer 5503. The first conductive layer 5503 is formed to have a thickness of 30 to 150 nm; therefore, the resistor can be formed by appropriately setting the width and length of the first conductive layer 5503.

Figure 39D:
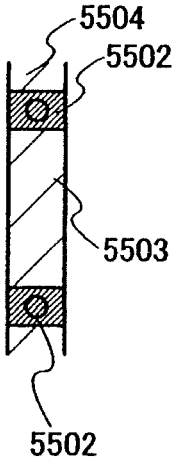

The resistor may be formed with a semiconductor layer containing impurity elements at a high concentration or a thin metal layer. A metal layer is preferable since the resistance value thereof is determined by the thickness and quality of the film itself, and thus has small variations, whereas the resistance value of a semiconductor layer is determined by the thickness and quality of the film, the concentration and activation rate of impurities, and the like. FIG. 39D shows a top view of the resistor 5405.

Figure 39E:
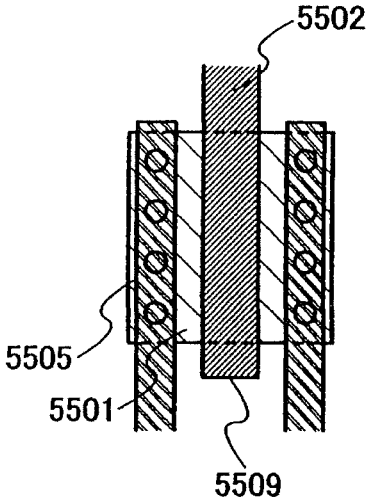

Referring again to FIG. 38, the semiconductor layer 5505 in the p-channel transistor 5403 has the impurity region 5512. This impurity region 5512 forms a source or drain region for forming a contact with the wire 5504. The gate electrode 5509 has a structure where the first conductive layer 5503 and the second conductive layer 5502 overlap with each other. The p-channel transistor 5403 is a transistor with a single-drain structure where no LDD region is provided. In forming the p-channel transistor 5403, the impurity region 5512 is doped with boron or the like as impurities which impart p-type conductivity. On the other hand, an n-channel transistor with a single-drain structure can be formed if the impurity region 5512 is doped with phosphorus. FIG. 39E shows a top view of the p-channel transistor 5403.

One or both of the semiconductor layer 5505 and the gate insulating layer 5508 may be oxidized or nitrided by high-density plasma treatment using conditions of microwave excitation, an electron temperature of 2 eV or less, an ion energy of 5 eV or less, and an electron density ranging from about $1\times10^{11}$ to $1\times10^{13}$ $cm^{-3}$. At this time, by treating the layer in an oxygen atmosphere (e.g., $O_2$ or $N_2O$) or a nitrogen atmosphere (e.g., $N_2$, or $NH_3$) with the substrate temperature being set at 300 to 450° C., a defect level of an interface between the semiconductor layer 5505 and the gate insulating layer 5508 can be lowered. By performing such treatment to the gate insulating layer 5508, the gate insulating layer 5508 can be densified. That is, generation of defective charges can be suppressed, and thus fluctuations of the threshold voltage of the transistor can be suppressed. In addition, in the case of driving the transistor with a voltage of 3 V or less, an insulating layer oxidized or nitrided by the aforementioned plasma treatment can be used as the gate insulating layer 5508. Meanwhile, in the case of driving the transistor with a voltage of 3 V or more, the gate insulating layer 5508 can be formed by combining an insulating layer formed on the surface of the semiconductor layer 5505 by the aforementioned plasma treatment and an insulating layer deposited by CVD (plasma CVD or thermal CVD). Similarly, such an insulating layer can be utilized as a dielectric layer of the capacitor 5404 as well. In this case, the insulating layer formed by the plasma treatment is a dense film with a thickness of 1 to 10 nm; therefore, a capacitor with high capacity can be formed.

As has been described with reference to FIGS. 38 and 39A to 39E, elements with various structures can be formed by combining conductive layers with various thickness. A region where only the first conductive layer is formed and a region where both the first conductive layer and the second conductive layer are formed can be formed with a photomask or a reticle having an auxiliary pattern which is formed of a diffraction grating pattern or a semi-transmissive film and has a function of reducing the light intensity. That is, the thickness of the resist mask to be developed is varied by controlling the quantity of light that the photomask transmits, at the time of exposing the photoresist to light in the photolithography process. In this case, a resist with the aforementioned complex shape may be formed by providing the photomask or the reticle with slits with a resolution limit or narrower. Further, the mask pattern formed of the photoresist material may be transformed by baking at around 200° C. after development.

By using a photomask or a reticle having an auxiliary pattern which is formed of a diffraction grating pattern or a semi-transmissive film and has a function of reducing the light intensity, the region where only the first conductive layer is formed and the region where the first conductive layer and the second conductive layer are stacked can be continuously formed. As shown in FIG. 39A, the region where only the first conductive layer is formed can be selectively formed over the semiconductor layer. Whereas such a region is effective over the semiconductor layer, it is not required in other regions (a wire region connecting to a gate electrode). With such a photomask or reticle, the region where only the first conductive layer is formed is not required in the wire portion; therefore, the density of the wire can be substantially increased.

In FIGS. 38 and 39A to 39E, the first conductive layer is formed with a thickness of 30 to 50 nm, using high-melting-point metals such as tungsten (W), chromium (Cr), tantalum (Ta), tantalum nitride (TaN), or molybdenum (Mo), or alloys or compounds containing such metals as a main component, while the second conductive layer is formed with a thickness of 300 to 600 nm, using high-melting-point metals such as tungsten (W), chromium (Cr), tantalum (Ta), tantalum nitride (TaN), or molybdenum (Mo), or alloys or compounds containing such metals as a main component. For example, the first conductive layer and the second conductive layer are formed with different conductive materials, so that the etching rate of each conductive layer can be varied in the etching process to be performed later. For example, TaN can be used for the first conductive layer, while a tungsten film can be used for the second conductive layer.

This embodiment shows that transistors, a capacitor, and a resistor each having a different electrode structure can be formed concurrently by the same patterning process, using a photomask or a reticle having an auxiliary pattern which is formed of a diffraction grating pattern or a semi-transmissive film and has a function of reducing the light intensity. Accordingly, elements with different modes can be formed and integrated in accordance with the characteristics required for a circuit, without increasing the number of manufacturing steps.

Note that this embodiment can be implemented by freely combining it with any of Embodiments 1 to 3.

Embodiment 5

In this embodiment, description is made of an exemplary mask pattern used for a manufacturing method of a transistor applicable to Embodiments 1 and 2, with reference to FIGS. 40A to 42B.

Figure 40A:
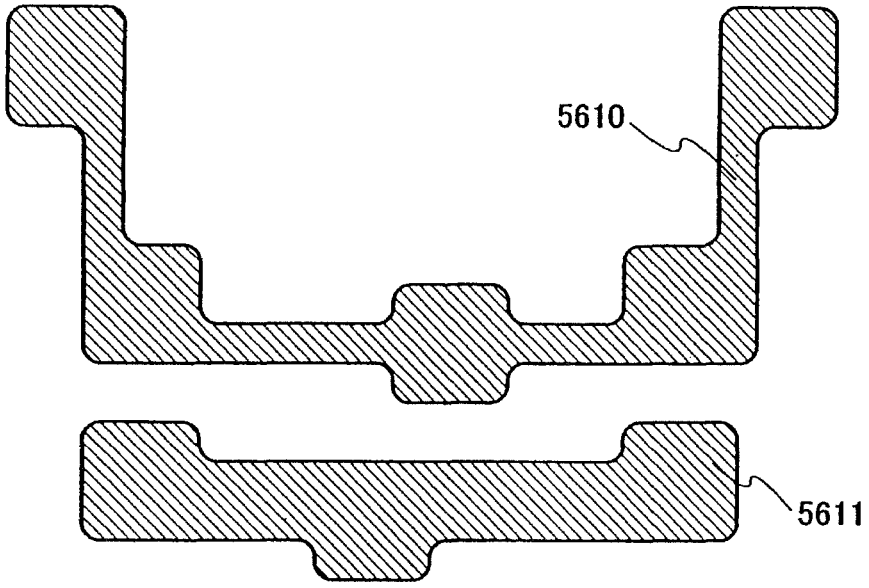
FIG. 40A shows semiconductor layers and 40B shows a mask pattern thereof according to Embodiment 5.

Semiconductor layers 5610 and 5611 shown in FIG. 40A are preferably formed with silicon or a crystalline semiconductor containing silicon as a main component. For example, single crystalline silicon, polycrystalline silicon obtained by crystallizing a silicon film by laser annealing, or the like can be employed. Alternatively, a metal oxide semiconductor, amorphous silicon, or an organic semiconductor which exhibits semiconductor characteristics can be employed.

In this case, a semiconductor to be formed first is provided over the entire surface of a substrate having an insulating surface, or a part thereof (a region having a larger area than the area which is defined as a semiconductor region of a transistor). Then, a mask pattern is formed over the semiconductor layer by a photolithography technique. By etching the semiconductor layer using the mask pattern, the semiconductor layers 5610 and 5611 each having a specific island shape are formed. They include source and drain regions and a channel formation region of a transistor. The semiconductor layers 5610 and 5611 are determined in accordance with the layout design.

Figure 40B:
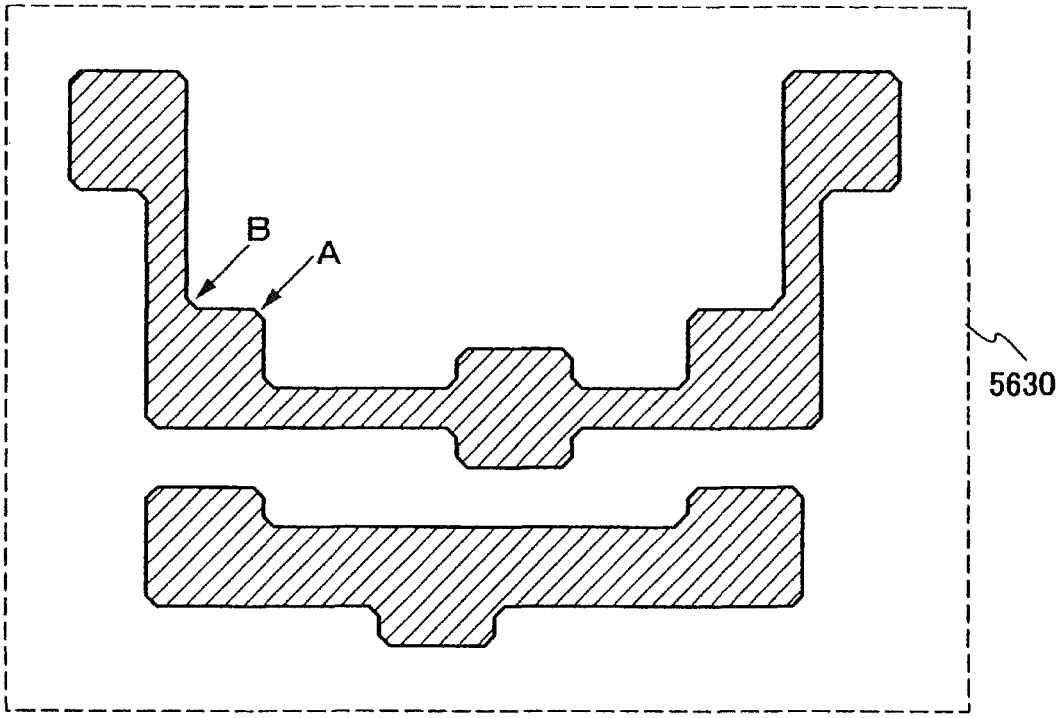

The photomask for forming the semiconductor layers 5610 and 5611 which are shown in FIG. 40A is provided with a mask pattern 5630 shown in FIG. 40B. The shape of this mask pattern 5630 differs depending on whether the resist used for the photolithography process is a positive type or a negative type. In the case of using a positive resist, the mask pattern 5630 shown in FIG. 40B is formed as a light-blocking portion. The mask pattern 5630 has such a shape that a vertex A of a polygon is removed. In addition, a corner B has such a shape that a plurality of gradations are provided so as not to form a right-angled corner.

The semiconductor layers 5610 and 5611 shown in FIG. 40A reflect the mask pattern 5630 shown in FIG. 40B at the photolithography process. In this case, the mask pattern 5630 may be transferred in such a manner that a pattern similar to the original mask pattern is formed or corners of the transferred pattern are rounded more than the vertex A and the corner B of the original mask pattern. That is, the semiconductor layers 5610 and 5611 can be formed to have corner portions with an even rounder and smoother shape, than those of the mask pattern 5630.

Figure 41A:
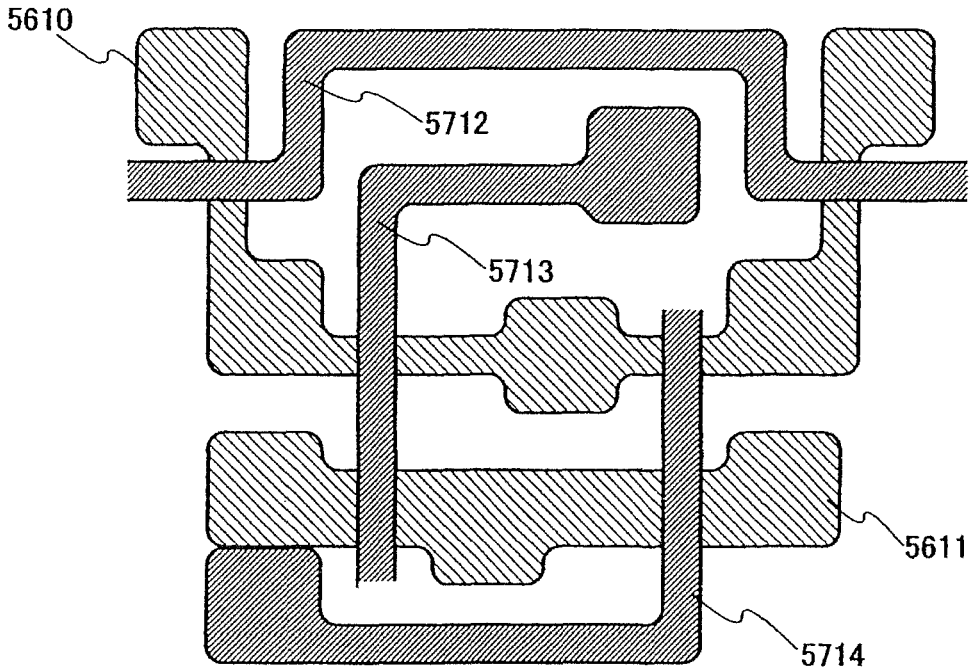
FIG. 41A shows gate wirings and 41B shows a mask pattern thereof according to Embodiment 5.

An insulating layer which at least partially contains silicon oxide or silicon nitride is formed over the semiconductor layers 5610 and 5611. One of the purposes of forming this insulating layer is to form a gate insulating layer. Then, gate wires 5712, 5713, and 5714 are formed so as to partially overlap with the semiconductor layers as shown in FIG. 41A. The gate wire 5712 is formed corresponding to the semiconductor layer 5610. The gate wire 5713 is formed corresponding to the semiconductor layers 5610 and 5611. The gate wire 5714 is formed corresponding to the semiconductor layers 5610 and 5611. The gate wires are formed by depositing a metal layer or a highly conductive semiconductor layer over the insulating layer and then printing a pattern onto the layer by a photolithography technique.

Figure 41B:
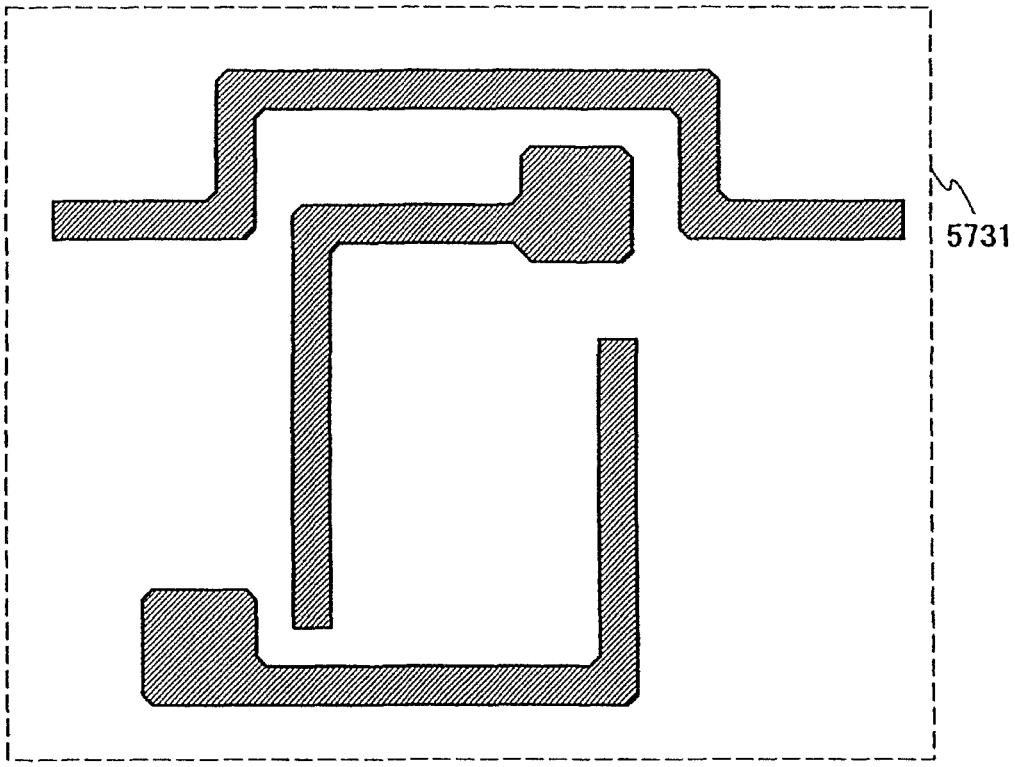

The photomask for forming such gate wires is provided with a mask pattern 5731 shown in FIG. 41B. This mask pattern 5731 is formed so that the outer circumference and the inner circumference of a corner do not bend at an acute angle. That is, a pattern having a corner which does not bend at a right angle is formed by removing a vertex of the outer circumference of the corner while forming the inner circumference thereof to be roundish.

The gate wires 5712, 5713, and 5714 shown in FIG. 41A reflect the shape of the mask pattern 5731 shown in FIG. 41B. In this case, the mask pattern 5731 may be transferred in such a manner that a pattern similar to the original mask pattern is formed or corners of the transferred pattern are rounded more than those of the original mask pattern. That is, corner portions with an even rounder and smoother shape than those of the mask pattern 5731 may be provided. When there is an acute portion in the pattern of the wire, a defect occurs such that fine particles are generated in dry etching, due to overdischarge of an electric field concentrated in that portion. Such a defect can be eliminated by forming a corner of a wire pattern to be roundish. In addition, by forming a wire pattern with a smooth corner, there is the advantage that in the washing process, fine particles can be completely washed away, so that they do not gather in the bent corner.

An interlayer insulating layer is a layer to be formed after the gate wires 5712, 5713, and 5714. The interlayer insulating layer is formed with an inorganic insulating material such as silicon oxide or an organic insulating material such as polyimide or an acrylic resin. Another insulating layer such as silicon nitride or silicon nitride oxide may be provided between the interlayer insulating layer and the gate wires 5712, 5713, and 5714. Further, an insulating layer such as silicon nitride or silicon nitride oxide may be provided over the interlayer insulating layer as well. Such an insulating layer can prevent contamination of the semiconductor layer and the gate insulating layer with impurities which would otherwise adversely affect the transistor, such as extrinsic metal ions or moisture.

Figure 42A:
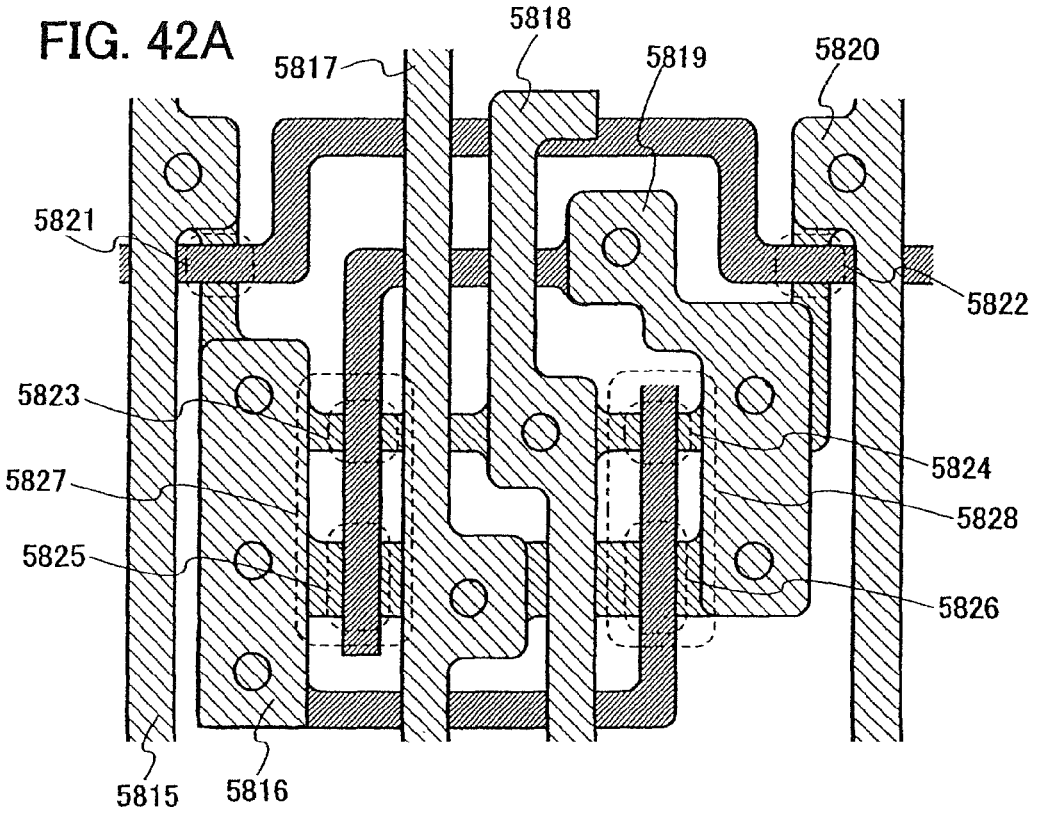
FIG. 42A shows wires and 42B shows a mask pattern thereof according to Embodiment 5.

Openings are formed in predetermined positions of the interlayer insulating layer. For example, the openings are provided in corresponding positions to the gate wires and the semiconductor layers located below the interlayer insulating layer. A wire layer which has a single layer or a plurality of layers of metals or metal compounds is formed by photolithography with the use of a mask pattern, and then by etching into a desired pattern. Then, the wires 5815 to 5820 are formed to partially overlap with the semiconductor layers as shown in FIG. 42A. A wire connects a specific element to another element, which means a wire connects specific elements not linearly but connects them so as to include corners that are formed due to the restriction of a layout. In addition, the width of the wire varies in a contact portion and other portions. As for the contact portion, if the width of a contact hole is equal to or wider than the wire width, the wire in the contact portion is formed wider than in the other portions.

Figure 42B:
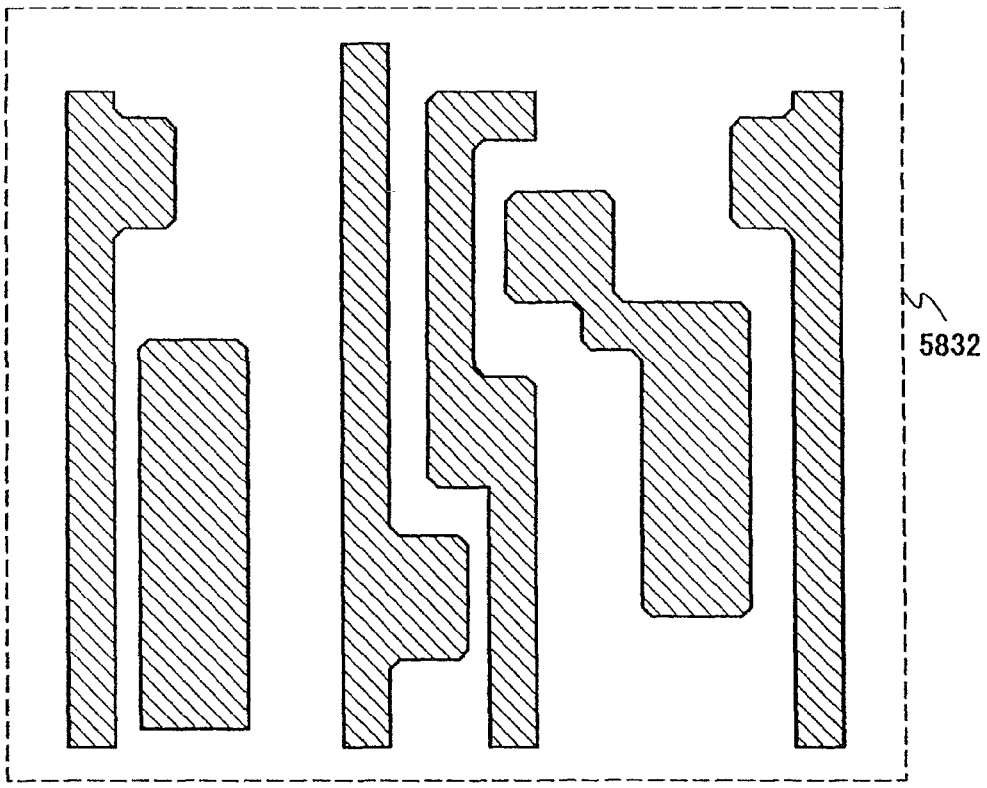

A photomask for forming the wires 5815 to 5820 has a mask pattern 5832 shown in FIG. 42B. In this case also, by forming each wire to have a roundish corner, fine particles can be prevented from being generated in dry etching due to overdischarge, and fine particles can be prevented from remaining even after the washing process.

In FIG. 42A, n-channel transistors 5821 to 5824 and p-channel transistors 5825 and 5826 are formed. The n-channel transistor 5823 and the p-channel transistor 5825, and the n-channel transistor 5824 and the p-channel transistor 5826 constitute inverters 5827 and 5828 respectively. Note that a circuit including the six transistors constitutes an SRAM. An insulating layer such as silicon nitride or silicon oxide may be formed over these transistors.

Note that this embodiment mode can be implemented by freely combining it with any of Embodiments 1 to 4.

Embodiment 6

Figure 25A:
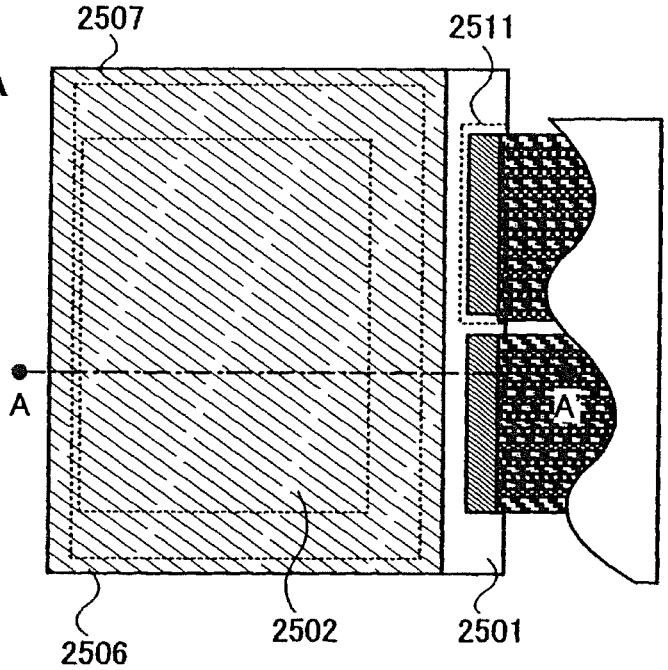
FIG. 25A is a top view of a panel.
Figure 25B:
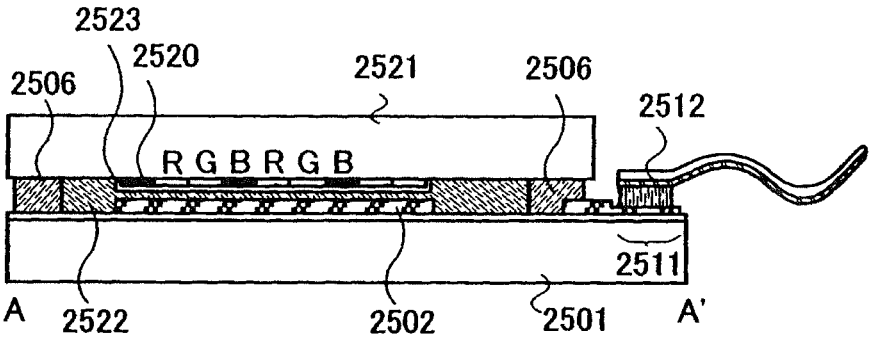
FIGS. 25B and 25C are cross sections taken along a line of FIG. 25A according to Embodiment 6.
Figure 25C:
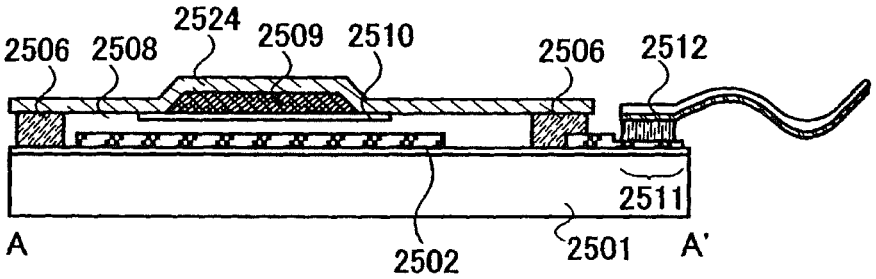

In this embodiment, description is made of a structure where a substrate formed with pixels is sealed, with reference to FIGS. 25A to 25C. FIG. 25A is a top view of a panel where a substrate formed with pixels is sealed, and FIGS. 25B and 25C are cross sections taken along a line A-A' of FIG. 25A. FIGS. 25B and 25C show examples of different sealing methods.

In FIGS. 25A to 25C, a pixel portion 2502 having a plurality of pixels is provided over a substrate 2501, and a sealing material 2506 is provided so as to surround the pixel portion 2502, while a sealing material 2507 is attached thereto. For the structure of pixels, those shown in embodiment modes or Embodiment 1 can be employed.

In the display panel in FIG. 25B, the sealing material 2507 in FIG. 25A corresponds to a counter substrate 2521. The counter substrate 2521 which transmits light is attached to the substrate 2501 using the sealing material 2506 as an adhesive layer, and a hermetically sealed space 2522 is formed by the substrate 2501, the counter substrate 2521, and the sealing member 2506. The counter substrate 2521 is provided with a color filter 2520 and a protective film 2523 for protecting the color filter. Light emitted from light-emitting elements disposed in the pixel portion 2502 is emitted to the outside through the color filter 2520. The hermetically sealed space 2522 is filled with an inert resin or liquid. Note that the resin for filling the hermetically sealed space 2522 may be a light-transmissive resin in which a moisture absorbent is dispersed. In addition, the same materials may be used for the sealing material 2506 and the hermetically sealed space 2522, so that the adhesion of the counter substrate 2521 and the sealing of the pixel portion 2502 may be performed concurrently.

In the display panel shown in FIG. 25C, the sealing material 2507 in FIG. 25A corresponds to a sealing material 2524. The sealing material 2524 is attached to the substrate 2501 using the sealing material 2506 as an adhesive layer, and a hermetically sealed space 2508 is formed by the substrate 2501, the sealing material 2506, and the sealing material 2524. The sealing material 2524 is provided with a moisture absorbent 2509 in its depressed portion in advance, and the moisture absorbent 2509 functions to keep a clean atmosphere in the hermetically sealed space 2508 by adsorbing moisture, oxygen, and the like, and to suppress degradation of the light-emitting elements. The depressed portion is covered with a fine-meshed cover material 2510. Whereas the cover material 2510 transmits air and moisture, does not transmit the moisture absorbent 2509. Note that the hermetically sealed space 2508 may be filled with a rare gas such as nitrogen or argon, or an inert resin or liquid.

An input terminal portion 2511 for transmitting signals to the pixel portion 2502 and the like is provided over the substrate 2501. Signals such as video signals are transmitted to the input terminal portion 2511 through an FPC (Flexible Printed Circuit) 2512. At the input terminal portion 2511, wires formed over the substrate 2501 are electrically connected to wires provided in the FPC 2512 with the use of a resin in which conductors (anisotropic conductive resin: ACF) are dispersed.

A driver circuit for inputting signals to the pixel portion 2502 may be formed over the same substrate 2501 as the pixel portion 2502. Alternatively, the driver circuit for inputting signals to the pixel portion 2502 may be formed in an IC chip so as to be connected onto the substrate 2501 by COG (Chip-On-Glass) bonding, or the IC chip may be disposed on the substrate 2501 by TAB (Tape Automated Bonding) or by use of a printed board.

This embodiment can be implemented by freely combining it with any of Embodiment Modes 1 to 6 and Embodiments 1 to 5.

Embodiment 7

The invention can be applied to a display module where a circuit for inputting signals to a panel is mounted on the panel.

Figure 26:
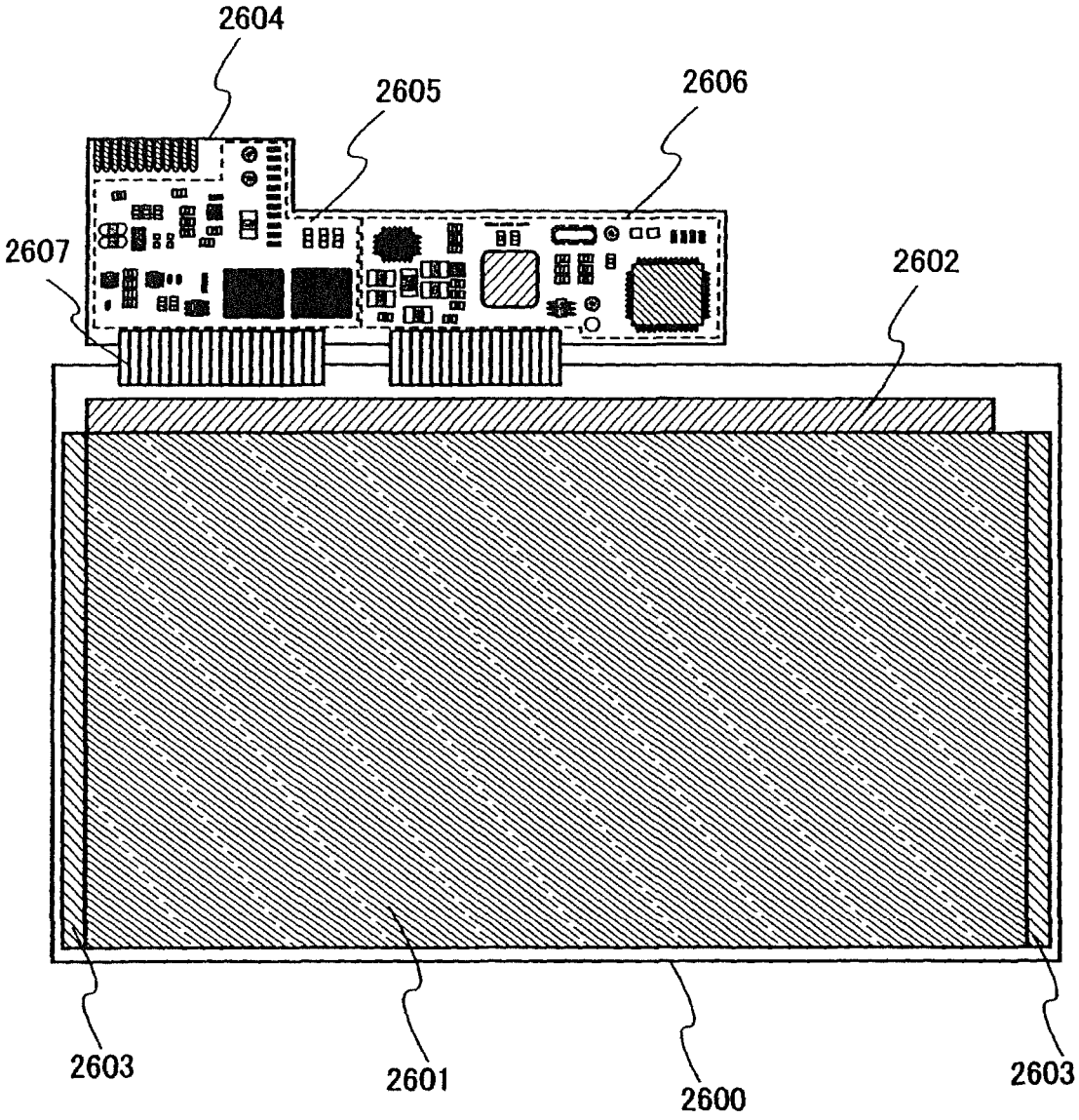
FIG. 26 shows a display module according to Embodiment 7.

FIG. 26 shows a display module where a panel 2600 and a circuit board 2604 are combined. Although FIG. 26 shows an example where a controller 2605, a signal dividing circuit 2606, and the like are formed over the circuit board 2604, circuits formed over the circuit board 2604 are not limited to these. Any circuit which can generate signals for controlling the panel may be employed.

Signals output from the circuits formed over the circuit board 2604 are input to the panel 2600 through a connecting wire 2607.

The panel 2600 includes a pixel portion 2601, a source driver 2602, and gate drivers 2603. The structure of the panel 2600 may be similar to those shown in Embodiments 1, 2, and the like. Although FIG. 26 shows an example where the source driver 2602 and the gate drivers 2603 are formed over the same substrate as the pixel portion 2601, the display module of the invention is not limited to this. A structure where only the gate drivers 2603 are formed over the same substrate as the pixel portion 2601, while the source driver 2602 is formed over a circuit board may also be employed. Alternatively, both of the source driver and the gate drivers may be formed over a circuit board.

By incorporating such a display module, display portions of various electronic devices can be formed.

This embodiment can be implemented by freely combining it with any of Embodiment Modes 1 to 6 and Embodiments 1 to 7.

Embodiment 8

The invention can be applied to various electronic devices. The electronic devices include a camera (e.g., a video camera or a digital camera), a projector, a head-mounted display (a goggle display), a navigation system, a car stereo, a personal computer, a game machine, a portable information terminal (e.g., a mobile computer, a portable phone, or an electronic book), an image reproducing device provided with a recording medium (specifically, a device for reproducing a recording medium such as a digital versatile disc (DVD), and having a display portion for displaying the reproduced image), and the like. FIGS. 27A to 27D show examples of such electronic devices.

Figure 27A:
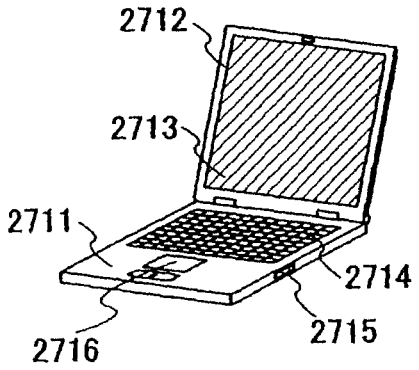
FIGS. 27A to 27D show examples of electronic devices according to Embodiment 8.

FIG. 27A shows a computer which includes a main body 2711, a housing 2712, a display portion 2713, a keyboard 2714, an external connecting port 2715, a pointing mouse 2716, and the like. The invention is applied to the display portion 2713. By using the invention, power consumption of the display portion can be reduced.

Figure 27B:
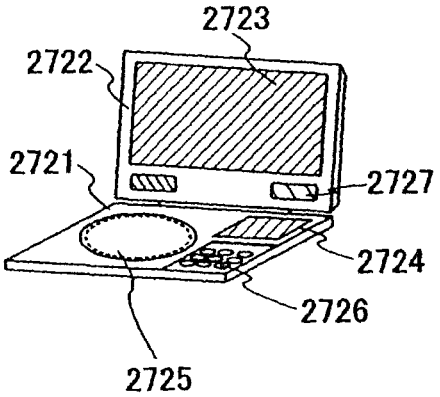

FIG. 27B shows an image reproducing device provided with a recording medium (specifically, a DVD reproducing device) which includes a main body 2721, a housing 2722, a first display portion 2723, a second display portion 2724, a recording medium (e.g., DVD) reading portion 2725, an operating key 2726, a speaker portion 2727, and the like. The first display portion 2723 mainly displays image data, while the second display portion 2724 mainly displays text data. The invention is applied to the first display portion 2723 and the second display portion 2724. By using the invention, power consumption of the display portion can be reduced.

Figure 27C:
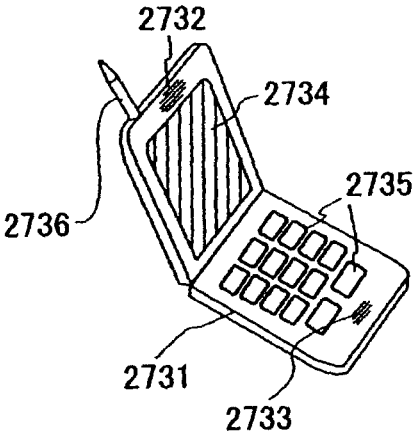

FIG. 27C shows a portable phone, which includes a main body 2731, an audio output portion 2732, an audio input portion 2733, a display portion 2734, operating switches 2735, an antenna 2736, and the like. The invention is applied to the display portion 2734. By using the invention, power consumption of the display portion can be reduced.

Figure 27D:
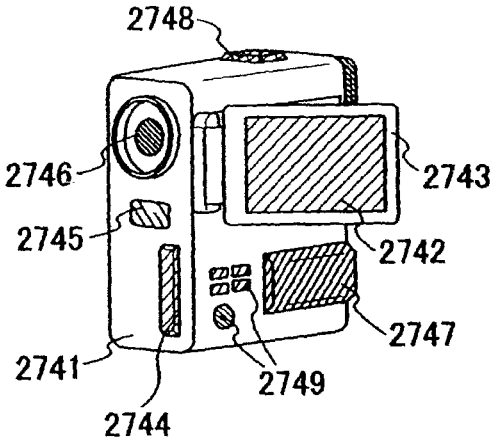

FIG. 27D shows a camera, which includes a main body 2741, a display portion 2742, a housing 2743, an external connecting port 2744, a remote-control receiving portion 2745, an image receiving portion 2746, a battery 2747, an audio input portion 2748, operating keys 2749, and the like. The invention is applied to the display portion 2742. By using the invention, power consumption of the display portion can be reduced.

This embodiment can be implemented by freely combining it with any of Embodiment Modes 1 to 6 and Embodiments 1 to 7.

The present application is based on Japanese Priority Application No. 2005-205147 filed on Jul. 14, 2005 with the Japanese Patent Office, the entire contents of which are hereby incorporated by reference.

What is claimed is:

1. A semiconductor device comprising:

a transistor;

a first capacitor whose first terminal is electrically connected to a gate terminal of the transistor;

a second capacitor whose first terminal is electrically connected to a second terminal of the first capacitor;

a first switch whose first terminal is directly connected to a first terminal of the transistor, and whose second terminal is electrically connected to a second terminal of the second capacitor;

a second switch whose first terminal is directly connected to the first terminal of the transistor, and whose second terminal is electrically connected to the second terminal of the first capacitor and the first terminal of the second capacitor;

a third switch whose first terminal is electrically connected to the gate terminal of the transistor, and whose second terminal is electrically connected to a line;

a first gate signal line, wherein on/off of the second switch and the third switch are controlled by the first gate signal line;

a second gate signal line, wherein on/off of the first switch is controlled by the second gate signal line; and a display element directly connected to a second terminal of the transistor, wherein the first terminal of the transistor is electrically connected to the second terminal of the second capacitor via the first switch, and wherein the second switch is connected between the first terminal of the transistor and the first terminal of the second capacitor.

2. The semiconductor device according to claim 1, wherein the transistor comprises an electrode, and wherein the electrode comprises an element selected from the group consisting of aluminum (Al), nickel (Ni), carbon (C), tungsten (W), molybdenum (Mo), titanium (Ti), platinum (Pt), copper (Cu), tantalum (Ta), gold (Au), and manganese (Mn), or an alloy comprising the element.

3. The semiconductor device according to claim 1, wherein the transistor comprises a gate electrode, and wherein the gate electrode comprises an element selected from the group consisting of tantalum (Ta), tungsten (W), titanium (Ti), molybdenum (Mo), aluminum (Al), copper (Cu), chromium (Cr), and neodymium (Nd), or an alloy comprising the element.

4. The semiconductor device according to claim 1, wherein the display element is an electroluminescence element.

5. The semiconductor device according to claim 1, wherein the display element comprises a counter electrode.

6. The semiconductor device according to claim 1, wherein the semiconductor device is any one of a portable information terminal and an electronic book.

7. The semiconductor device according to claim 1, wherein the second terminal of the first switch is directly connected to the second terminal of the second capacitor, and wherein the second terminal of the second switch is directly connected to the second terminal of the first capacitor.

8. The semiconductor device according to claim 1, wherein the first terminal of the third switch is directly connected to the gate terminal of the transistor.

9. A semiconductor device comprising:

a transistor;

a first capacitor whose first terminal is electrically connected to a gate terminal of the transistor;

a second capacitor whose first terminal is electrically connected to a second terminal of the first capacitor;

a first switch whose first terminal is directly connected to a first terminal of the transistor, and whose second terminal is electrically connected to a second terminal of the second capacitor;

a second switch whose first terminal is directly connected to the first terminal of the transistor, and whose second terminal is electrically connected to the second terminal of the first capacitor and the first terminal of the second capacitor;

a third switch whose first terminal is electrically connected to the gate terminal of the transistor, and whose second terminal is electrically connected to a line;

a first gate signal line, wherein on/off of the second switch and the third switch are controlled by the first gate signal line;

a second gate signal line, wherein on/off of the first switch is controlled by the second gate signal line; and a display element directly connected to a second terminal of the transistor, wherein the transistor comprises an oxide semiconductor comprising In, Ga, and Zn, wherein the first terminal of the transistor is electrically connected to the second terminal of the second capacitor via the first switch, and wherein the second switch is connected between the first terminal of the transistor and the first terminal of the second capacitor.

10. The semiconductor device according to claim 9, wherein the transistor comprises an electrode, and wherein the electrode comprises an element selected from the group consisting of aluminum (Al), nickel (Ni), carbon (C), tungsten (W), molybdenum (Mo), titanium (Ti), platinum (Pt), copper (Cu), tantalum (Ta), gold (Au), and manganese (Mn), or an alloy comprising the element.

11. The semiconductor device according to claim 9, wherein the transistor comprises a gate electrode, and wherein the gate electrode comprises an element selected from the group consisting of tantalum (Ta), tungsten (W), titanium (Ti), molybdenum (Mo), aluminum (Al), copper (Cu), chromium (Cr), and neodymium (Nd), or an alloy comprising the element.

12. The semiconductor device according to claim 9, wherein the display element is an electroluminescence element.

13. The semiconductor device according to claim 9, wherein the display element comprises a counter electrode.

14. The semiconductor device according to claim 9, wherein the semiconductor device is any one of a portable information terminal and an electronic book.

15. The semiconductor device according to claim 9, wherein the second terminal of the first switch is directly connected to the second terminal of the second capacitor, and wherein the second terminal of the second switch is directly connected to the second terminal of the first capacitor.

16. The semiconductor device according to claim 9, wherein the first terminal of the third switch is directly connected to the gate terminal of the transistor.

17. A semiconductor device comprising:

a transistor;

a first capacitor whose first terminal is electrically connected to a gate terminal of the transistor;

a second capacitor whose first terminal is electrically connected to a second terminal of the first capacitor;

a first switch whose first terminal is directly connected to a first terminal of the transistor, and whose second terminal is electrically connected to a second terminal of the second capacitor;

a second switch whose first terminal is directly connected to the first terminal of the transistor, and whose second terminal is electrically connected to the second terminal of the first capacitor and the first terminal of the second capacitor;

a third switch whose first terminal is electrically connected to the gate terminal of the transistor, and whose second terminal is electrically connected to a line;

a first gate signal line, wherein on/off of the second switch and the third switch are controlled by the first gate signal line;

a second gate signal line, wherein on/off of the first switch is controlled by the second gate signal line; and a display element directly connected to a second terminal of the transistor, wherein the transistor comprises a metal oxide semiconductor, wherein the first terminal of the transistor is electrically connected to the second terminal of the second capacitor via the first switch, and wherein the second switch is connected between the first terminal of the transistor and the first terminal of the second capacitor.

18. The semiconductor device according to claim 17, wherein the transistor comprises an electrode, and wherein the electrode comprises an element selected from the group consisting of aluminum (Al), nickel (Ni), carbon (C), tungsten (W), molybdenum (Mo), titanium (Ti), platinum (Pt), copper (Cu), tantalum (Ta), gold (Au), and manganese (Mn), or an alloy comprising the element.

19. The semiconductor device according to claim 17, wherein the transistor comprises a gate electrode, and wherein the gate electrode comprises an element selected from the group consisting of tantalum (Ta), tungsten (W), titanium (Ti), molybdenum (Mo), aluminum (Al), copper (Cu), chromium (Cr), and neodymium (Nd), or an alloy comprising the element.

20. The semiconductor device according to claim 17, wherein the display element is an electroluminescence element.

21. The semiconductor device according to claim 17, wherein the display element comprises a counter electrode.

22. The semiconductor device according to claim 17, wherein the semiconductor device is any one of a portable information terminal and an electronic book.

23. The semiconductor device according to claim 17, wherein the second terminal of the first switch is directly connected to the second terminal of the second capacitor, and wherein the second terminal of the second switch is directly connected to the second terminal of the first capacitor.

24. The semiconductor device according to claim 17, wherein the first terminal of the third switch is directly connected to the gate terminal of the transistor.

* * * * *